US008465889B2

(12) United States Patent
Sekido et al.

(10) Patent No.: US 8,465,889 B2
(45) Date of Patent: Jun. 18, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Kunihiko Sekido, Numazu (JP); Hideaki Nagasaka, Suntou-gun (JP); Michiyo Sekiya, Mishima (JP); Shinji Takagi, Yokohama (JP); Akihiro Maruyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/143,052

(22) PCT Filed: Jan. 29, 2010

(86) PCT No.: PCT/JP2010/051657

§ 371 (c)(1),
(2), (4) Date: Jun. 30, 2011

(87) PCT Pub. No.: WO2010/087520

PCT Pub. Date: Aug. 5, 2010

(65) Prior Publication Data

US 2011/0268472 A1 Nov. 3, 2011

(30) Foreign Application Priority Data

Jan. 30, 2009 (JP) ..... 2009-019744
Jan. 29, 2010 (JP) ..... 2010-017706

(51) Int. Cl.
*G03G 5/05* (2006.01)

(52) U.S. Cl.
USPC ..... 430/59.6; 430/56; 430/64; 430/96; 399/159

(58) Field of Classification Search
USPC ..... 430/56, 96, 59.6, 64; 399/159
See application file for complete search history.

(56) References Cited

U.S. PATENT DOCUMENTS 4,442,193 A 4/1984 Chen et al.
4,562,132 A 12/1985 Ong et al.
4,882,257 A 11/1989 Maruyama et al.
4,892,800 A 1/1990 Sugata et al.
4,992,349 A 2/1991 Chen et al.

(Continued)

FOREIGN PATENT DOCUMENTS

CA 2514508 C * 5/2008
CN 1655075 A 8/2005

(Continued)

OTHER PUBLICATIONS

English language machine translation of JP 2006-251487 (Sep. 2006).*

(Continued)

*Primary Examiner* — Christopher Rodee
(74) *Attorney, Agent, or Firm* — Fitzpatrick, Cella, Harper & Scinto

(57) ABSTRACT

To provide an electrophotographic photosensitive member that can reproduce good images with less positive ghost and also has a good photosensitivity, the electrophotographic photosensitive member is incorporated in its photosensitive layer with a copolymer having a repeating structural unit represented by the formula (1) and a repeating structural unit represented by the formula (2), or a copolymer having a repeating structural unit represented by the formula (1) and a repeating structural unit represented by the formula (3).

$$-(Z_1\text{-}A\text{-}Z_2\text{-}E_1)- \quad (1)$$

$$-(Z_3\text{-}A\text{-}Z_4\text{—}W_2\text{—}B_2\text{—}W_2)- \quad (2)$$

$$-(Z_5\text{—}B_3\text{—}Z_6\text{-}E_4)- \quad (3)$$

11 Claims, 2 Drawing Sheets

U.S. PATENT DOCUMENTS

| | | | | |
|---|---|---|---|---|
| 5,176,976 | A | 1/1993 | Kikuchi et al. | |
| 5,352,552 | A | 10/1994 | Maruyama et al. | |
| 5,385,797 | A | 1/1995 | Nagahara et al. | |
| 5,391,446 | A | 2/1995 | Ohtani et al. | |
| 5,391,449 | A | 2/1995 | Maruyama et al. | |
| 5,422,210 | A | 6/1995 | Maruyama et al. | |
| 5,455,135 | A | 10/1995 | Maruyama et al. | |
| 5,468,583 | A | 11/1995 | Gruenbaum et al. | |
| 5,484,673 | A | 1/1996 | Kikuchi et al. | |
| 5,521,044 | A | 5/1996 | Muto et al. | |
| 5,604,061 | A | 2/1997 | Sekido et al. | |
| 5,667,926 | A | 9/1997 | Maruyama et al. | |
| 5,677,095 | A | 10/1997 | Kikuchi et al. | |
| 5,693,443 | A | 12/1997 | Nakamura et al. | |
| 5,729,801 | A | 3/1998 | Maruyama et al. | |
| 5,890,037 | A | 3/1999 | Kukimoto et al. | |
| 5,923,925 | A | 7/1999 | Nakamura et al. | |
| 6,016,414 | A | 1/2000 | Anayama et al. | |
| 6,110,628 | A | 8/2000 | Sekiya et al. | |
| 6,180,303 | B1 | 1/2001 | Uematsu et al. | |
| 6,225,017 | B1 | 5/2001 | Sato et al. | |
| 6,228,546 | B1 | 5/2001 | Kashizaki et al. | |
| 6,248,490 | B1 | 6/2001 | Suzuki et al. | |
| 6,335,133 | B1 | 1/2002 | Nagasaka | |
| 6,372,397 | B1 | 4/2002 | Maruyama et al. | |
| 6,416,915 | B1 | 7/2002 | Kikuchi et al. | |
| 6,432,603 | B1 | 8/2002 | Kimura et al. | |
| 6,436,597 | B2 | 8/2002 | Maruyama et al. | |
| 6,664,014 | B1 | 12/2003 | Kikuchi et al. | |
| 6,946,226 | B2 | 9/2005 | Wu et al. | |
| 6,953,647 | B2 | 10/2005 | Kimura et al. | |
| 7,141,341 | B2 | 11/2006 | Sekido et al. | |
| 7,186,489 | B2 | 3/2007 | Uematsu et al. | |
| 7,226,711 | B2 | 6/2007 | Amamiya et al. | |
| 7,378,205 | B2 | 5/2008 | Sekiya et al. | |
| 7,534,534 | B2 | 5/2009 | Nakata et al. | |
| 7,541,124 | B2 * | 6/2009 | Molaire et al. | 430/64 |
| 7,551,878 | B2 | 6/2009 | Ogaki et al. | |
| 7,556,901 | B2 | 7/2009 | Anezaki et al. | |
| 7,563,553 | B2 | 7/2009 | Kikuchi et al. | |
| 7,622,238 | B2 | 11/2009 | Uematsu et al. | |
| 7,718,331 | B2 | 5/2010 | Uematsu et al. | |
| 7,732,113 | B2 | 6/2010 | Nakamura et al. | |
| 7,749,667 | B2 | 7/2010 | Kawahara et al. | |
| 7,964,328 | B2 * | 6/2011 | Ferrar et al. | 430/64 |
| 8,007,972 | B2 | 8/2011 | Kurimoto et al. | |
| 2005/0031977 | A1 * | 2/2005 | Kim et al. | 430/60 |
| 2005/0136245 | A1 | 6/2005 | Arita et al. | |
| 2006/0292469 | A1 | 12/2006 | Nagasaka et al. | |
| 2007/0042282 | A1 | 2/2007 | Molaire et al. | |
| 2007/0059618 | A1 * | 3/2007 | Kurimoto et al. | 430/58.5 |
| 2009/0035677 | A1 | 2/2009 | Ferrar et al. | |
| 2011/0104597 | A1 | 5/2011 | Nagasaka et al. | |
| 2011/0104601 | A1 | 5/2011 | Takagi et al. | |
| 2011/0143273 | A1 | 6/2011 | Sekido et al. | |

FOREIGN PATENT DOCUMENTS

| | | | |
|---|---|---|---|
| CN | 101004561 | A | 7/2007 |
| EP | 0 740 216 | A2 | 10/1996 |
| FR | 2867777 | A1 * | 9/2005 |
| JP | 1-206349 | A | 8/1989 |
| JP | 1-230053 | A | 9/1989 |
| JP | 5-279582 | A | 10/1993 |
| JP | 7-70038 | A | 3/1995 |
| JP | 8-30007 | A | 2/1996 |
| JP | 11-184127 | A | 7/1999 |
| JP | 2001-83726 | A | 3/2001 |
| JP | 2003-330209 | A | 11/2003 |
| JP | 2003330209 | A * | 11/2003 |
| JP | 2003-345044 | A | 12/2003 |
| JP | 2005-70786 | A | 3/2005 |
| JP | 2006251487 | A * | 9/2006 |
| JP | 2007148293 | A * | 6/2007 |

OTHER PUBLICATIONS

European Search Report dated Feb. 1, 2012 in European Application No. 10735973.9.

PCT International Search Report and Written Opinion of the International Searching Authority, International Application No. PCT/JP2010/051657, Mailing Date Mar. 23, 2010.

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.

Jones, et al., "Tuning Orbital Energetics in Arylene Diimide Semiconductors. Materials Design for Ambient Stability of n-Type Charge Transport", J. Am. Chem. Soc., vol. 129, 2007, pp. 15259-15278.

Yamada, et al., "Synthesis and Properties of Diamino-Substituted Dipyrido [3,2-a: 2',3'-c]phenazine", Bulletin of the Chemical Society of Japan, vol. 65, No. 4, 1992, pp. 1006-1011.

Callahan, et al., "Syntheses of Phencyclone Analogues. Applications for NMR Studies of Hindered Rotations and Magnetic Anisotropy in Crowded Diels-Alder Adducts", Chem. Educator, vol. 6, 2001, pp. 227-234.

Kato, et al., "Nitration of Phenanthrenequinone", Journal of Synthetic Organic Chemistry, Japan, vol. 15, 1957, pp. 29-32.

Kato, et al., "Syntheses of Amino-phenanthrenequinones by the Reduction of Nitro Compounds", Journal of Synthetic Organic Chemistry, Japan, vol. 15, 1957, pp. 32-34.

Qian, et al., "4-Amino-1, 8-dicyanonaphthalene derivatives as novel fluorophore and fluorescence switches: efficient synthesis and fluorescence enhancement induced by transition metal ions and protons", Tetrahedron Letters, vol. 43, 2002, pp. 2991-2994.

Xiao, et al., "Novel highly efficient fluoroionophores with a peri-effect and strong electron-donating receptors: TICT-promoted PET and signaling response to transition metal cations with low background emission", Tetrahedron Letters, vol. 44, 2003, pp. 2087-2091.

Bolitt, et al., "A Convenient Synthesis of Pyrido[3,4-g]isoquinoline via ortho-Directed Metallation/Dimerization", Synthesis, vol. 5, 1988, pp. 388-389.

Okada, et al., "Synthesis and Properties of a Novel Electron Transporting Compound, 3, 3'-dialky1-4,4'-bisnaphthylquinone (DBNQ)", PPCI/Japan Hardcopy '98 Papers, 1998, pp. 207-210.

Nicolaou, et al., "Palladium-Catalyzed Cross-Coupling Reactions in Total Synthesis", Angewandte Chemie Int. Ed. 2005, vol. 44, pp. 4442-4489.

Maruyama, et al., U.S. Appl. No. 13/182,192, filed Jul. 13, 2011.

"The Foundation and Application of Polyurethane", CMC Publishing Co., Ltd., 1986, p. 3 (with partial translation).

"The Synthesis and Reaction of High Polymers (2)", Kyoritu Shuppan Co., Ltd., 1991, p. 326 (with partial translation).

"The Dictionary of High Polymers", Maruzen Co., Ltd., 1994, p. 1001 (with partial translation).

Chinese Office Action dated Mar. 28, 2013 in Chinese Application No. 201080006168.3.

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

This invention relates to an electrophotographic photosensitive member, and a process cartridge and an electrophotographic apparatus which have the electrophotographic photosensitive member.

BACKGROUND ART

Photosensitive layers of electrophotographic photosensitive members used in electrophotographic apparatus are known to include a single-layer type photosensitive layer and a multi-layer type photosensitive layer. The electrophotographic photosensitive members are also roughly grouped into a positive-chargeable electrophotographic photosensitive member and a negative-chargeable electrophotographic photosensitive member, depending on the polarity of electric charges produced when their surfaces are electrostatically charged. Of these, a negative-chargeable electrophotographic photosensitive member having a multi-layer type photosensitive layer is commonly used.

The negative-chargeable electrophotographic photosensitive member having a multi-layer type photosensitive layer commonly has on a support a charge generation layer containing a charge-generating material such as an azo pigment or a phthalocyanine pigment and a hole transport layer containing a hole-transporting material such as a hydrazone compound, a triarylamine compound or a stilbene compound which are in this order from the support side.

However, where the photosensitive layer (in particular, the charge generation layer in the case of the multi-layer type photosensitive layer) is directly provided on the support, it may often come about that the photosensitive layer (charge generation layer) comes to peel or that any defects (shape-related defects such as scratches or material-related defects such as impurities) of the surface of the support are directly reflected on images to cause problems such as black dot-like image defects and blank areas.

To resolve these problems, most electrophotographic photosensitive members are provided with a layer called an intermediate layer (also called a subbing layer) between the photosensitive layer and the support.

However, such electrophotographic photosensitive members are seen in some cases to become poor in electrophotographic performance as being presumably due to the intermediate layer. Accordingly, it has conventionally been attempted to improve properties of the intermediate layer by using various means, e.g., by incorporating the intermediate layer of the negative-chargeable electrophotographic photosensitive member with an electron-transporting material to make the intermediate layer into an electron-transport layer (Japanese Patent Applications Laid-open No. 2001-83726 and No. 2003-345044).

DISCLOSURE OF THE INVENTION

In recent years, there is a steady increase in a demand for the quality of electrophotographic images. For example, the tolerance limit for positive ghost has become remarkably severer. The positive ghost is a phenomenon that, where areas exposed to light appear as halftone images on the next-time round of an electrophotographic photosensitive member in the course of formation of images on a sheet, only the areas exposed to light come high in image density.

In this regard, it has not been the case that the above background art has attained a satisfactory level about how to lessen the positive ghost.

Accordingly, an object of the present invention is to provide an electrophotographic photosensitive member that can reproduce good images with less positive ghost, and a process cartridge and an electrophotographic apparatus which have such an electrophotographic photosensitive member.

The present inventors have made extensive studies in order to provide an electrophotographic photosensitive member that can succeed at a high level in lessening the positive ghost. As the result, they have discovered that a copolymer having a specific structure may be incorporated in the photosensitive layer of the electrophotographic photosensitive member and this enables the electrophotographic photosensitive member to succeed at a high level in lessening the positive ghost.

More specifically, the present invention is an electrophotographic photosensitive member having a support and a photosensitive layer formed on the support, wherein the photosensitive layer contains a copolymer having a repeating structural unit represented by the following formula (1) and a repeating structural unit represented by the following formula (2), or a copolymer having a repeating structural unit represented by the following formula (1) and a repeating structural unit represented by the following formula (3):

$$-(Z_1\text{-}A\text{-}Z_2\text{-}E_1)- \quad (1)$$

$$-(Z_3\text{-}A\text{-}Z_4\text{—}W_2\text{—}B_2\text{—}W_2)- \quad (2)$$

$$-(Z_5\text{—}B_3\text{—}Z_6\text{-}E_4)- \quad (3)$$

where, in the formulas (1), (2) and (3);

$Z_1$ to $Z_6$ each independently represent a single bond, an alkylene group, an arylene group, or an arylene group substituted with an alkyl group;

$E_1$ represents a divalent group represented by —$W_1$—$B_1$—$W_1$—, or a divalent group represented by the following formula (E11):

(E11)

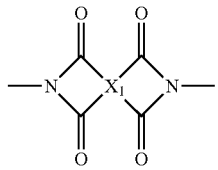

wherein $X_1$ represents a tetravalent group formed by removing four hydrogen atoms from a cyclic hydrocarbon;

$E_4$ represents a divalent group represented by —$W_3$—$B_4$—$W_3$—, or a divalent group represented by the following formula (E41):

(E41)

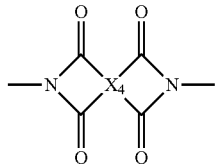

wherein $X_4$ represents a tetravalent group formed by removing four hydrogen atoms from a cyclic hydrocarbon;

$W_1$ to $W_3$ each independently represent a single bond, a urethane linkage, a urea linkage or an imide linkage;

A represents a divalent group represented by any of the following formulas (A-1) to (A-8):

A-1

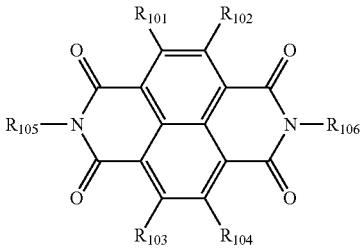

A-2

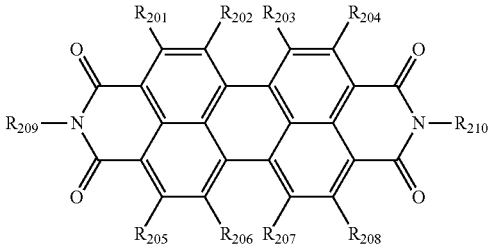

A-3

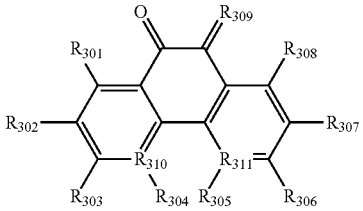

A-4

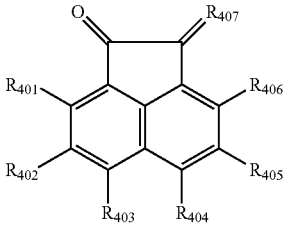

A-5

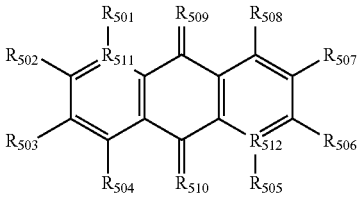

A-6

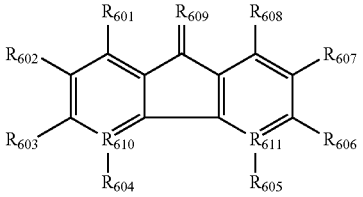

-continued

A-7

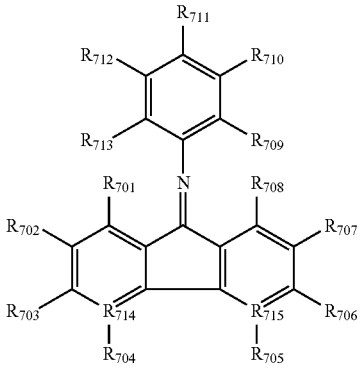

A-8

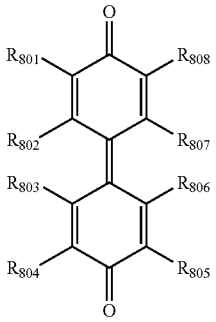

where, in the formulas (A-1) to (A-8);

$R_{101}$ to $R_{104}$ each independently represent a hydrogen atom, an aryl group, an aryl group substituted with a halogen atom, nitro group, cyano group, alkyl group or alkyl halide group, an alkyl group, or a cyano group, or represent a bonding or linking site; and $R_{105}$ and $R_{106}$ each independently represent a hydrogen atom, an aryl group, an aryl group substituted with an alkyl group or halogen atom, or an alkyl group, or represent a bonding site; provided that any two of $R_{101}$ to $R_{106}$ are bonding sites;

$R_{201}$ to $R_{208}$ each independently represent a hydrogen atom, an aryl group, an aryl group substituted with a halogen atom, nitro group, cyano group, alkyl group or alkyl halide group, an alkyl group, or a cyano group, or represent a bonding site; and $R_{209}$ and $R_{210}$ each independently represent a hydrogen atom, an aryl group, an aryl group substituted with an alkyl group or halogen atom, or an alkyl group, or represent a bonding site; provided that any two of $R_{201}$ to $R_{210}$ are bonding sites;

$R_{301}$ to $R_{308}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{309}$ represents an oxygen atom or a dicyanomethylene group; and $R_{310}$ and $R_{311}$ each independently represent a carbon atom or a nitrogen atom, and, in the case of the nitrogen atom, $R_{304}$ and $R_{305}$ are not present; provided that any two of $R_{301}$ to $R_{308}$ are bonding sites;

$R_{401}$ to $R_{406}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; and $R_{407}$ represents an oxygen atom or a dicyanomethylene group; provided that any two of $R_{401}$ to $R_{406}$ are bonding sites;

$R_{501}$ to $R_{508}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{509}$ and $R_{510}$ each independently represent an oxygen atom or a dicyanomethylene group; and $R_{511}$ and $R_{512}$ each independently represent a carbon atom or a nitrogen atom, and, in the case of the nitrogen atom, $R_{501}$ and $R_{505}$ are not present; provided that any two of $R_{501}$ to $R_{508}$ are bonding sites;

$R_{601}$ to $R_{608}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{610}$ and $R_{611}$ each independently represent a carbon atom or a nitrogen atom, and, in the case of the nitrogen atom, $R_{604}$ and $R_{605}$ are not present; and $R_{609}$ represents a dicyanomethylene group; provided that any two of $R_{601}$ to $R_{608}$ are bonding sites;

$R_{701}$ to $R_{713}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{714}$ and $R_{715}$ each independently represent a carbon atom or a nitrogen atom, and, in the case of the nitrogen atom, $R_{704}$ and $R_{705}$ are not present; provided that any two of $R_{701}$ to $R_{713}$ are bonding sites; and $R_{801}$ to $R_{808}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; provided that any two of $R_{801}$ to $R_{808}$ are bonding sites;

$B_1$ and $B_4$ each independently represent an arylene group, an alkylene group, an alkarylene group, an arylene group substituted with an alkyl group, halogen atom, cyano group or nitro group, an alkylene group substituted with a halogen atom, cyano group or nitro group, an alkarylene group substituted with an alkyl group, halogen atom, cyano group or nitro group, an arylene group interrupted by an ether or sulfonyl, or an alkylene group interrupted by an ether; and $B_2$ and $B_3$ each independently represent an arylene group substituted with a carboxyl group only, an arylene group substituted with a carboxyl group and an alkyl group only, or an alkylene group substituted with a carboxyl group only.

The present invention is also a process cartridge which integrally supports the above electrophotographic photosensitive member and at least one device selected from the group consisting of a charging device, a developing device, a transfer device and a cleaning device, and is detachably mountable to the main body of an electrophotographic apparatus.

The present invention is still also an electrophotographic apparatus comprising the above electrophotographic photosensitive member, a charging device, an exposure device, a developing device and a transfer device.

EFFECT OF THE INVENTION

According to the present invention, it can provide an electrophotographic photosensitive member that can succeed at a high level in lessening the positive ghost, and a process cartridge and an electrophotographic apparatus which have such an electrophotographic photosensitive member.

The reason why the electrophotographic photosensitive member having the photosensitive layer containing the above copolymer (copolymer resin) is superior in the effect of lessening positive ghost is unclear, and the present inventors presume it as stated below.

That is, the copolymer used in the present invention is a copolymer with a structure wherein structures having electron transport behavior and structures other than those are alternately present, and is a copolymer containing carboxyl groups. What the present inventors presume is that, in such a copolymer, the structures having electron transport behavior are present without being unevenly distributed and also the carboxyl groups mutually act with one another whereby probably the structures having electron transport behavior in the copolymer can take proper arrangement in a layer formed of such a copolymer and hence a superior effect of lessening positive ghost can be obtained.

Further features of the present invention will become apparent from the following description of exemplary embodiments with reference to the attached drawings.

BEST MODE FOR PRACTICING THE INVENTION

Figure 1:
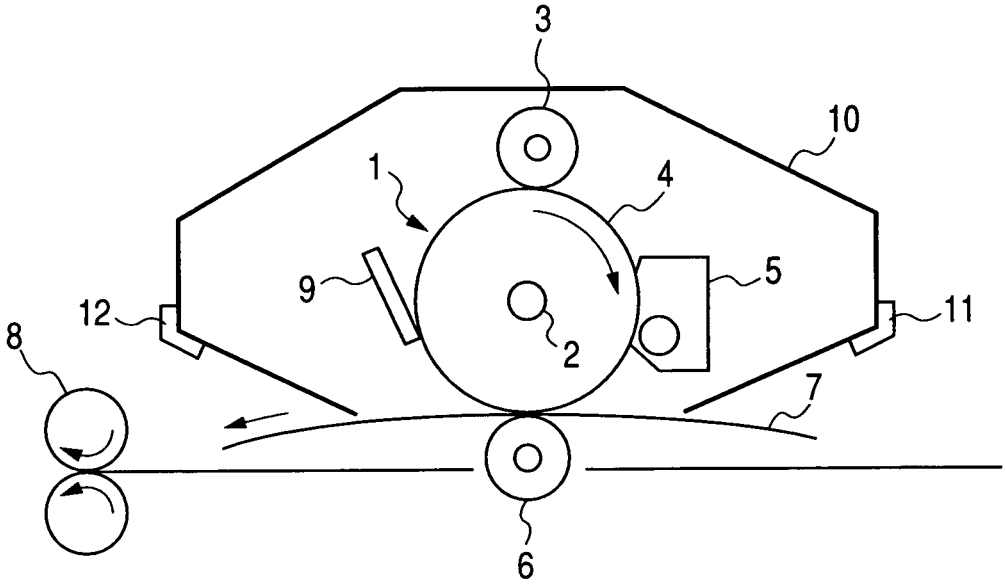
FIG. 1 is a view showing schematically the construction of an electrophotographic apparatus having a process cartridge provided with the electrophotographic photosensitive member of the present invention.

The present invention is described below in detail.

In general, the electrophotographic photosensitive member has a support and a photosensitive layer formed on the support.

As the support, any support may be used as long as it has conductivity (a conductive support). It may include, e.g., a support made of a metal such as aluminum, nickel, copper, gold or iron, or an alloy of any of these; and an insulating support made of polyester, polyimide or glass and on which a thin film of a metal such as aluminum, silver or gold or of a conductive material such as indium oxide or tin oxide has been formed.

The support may have a surface having been treated by electrochemical treatment such as anodizing or by wet honing, blasting or cutting, in order to improve its electrical properties and prevent any interference fringes questioned when irradiated with coherent light such as semiconductor laser light.

A multi-layer type photosensitive layer has a charge generation layer containing a charge-generating material and a charge transport layer containing a charge-transporting material. The charge-transporting material includes a hole-transporting material and an electron-transporting material, where a charge transport layer containing the hole-transporting material is called a hole transport layer and a charge transport layer containing the electron-transporting material is called an electron transport layer. The multi-layer type photosensitive layer may be made to have a plurality of charge transport layers.

A single-layer type photosensitive layer is a layer incorporated with the charge-generating material and the charge-transporting material in the same layer.

It is preferable for the copolymer used in the present invention to be incorporated in the electron transport layer of a multi-layer type photosensitive layer having on the support the electron transport layer, the charge generation layer and the hole transport layer which are layered in this order from the support side.

The photosensitive layer is described below taking the case of the multi-layer type photosensitive layer of a negative-chargeable electrophotographic photosensitive member.

The charge generation layer contains a charge-generating material, and optionally contains a binder resin and other component(s).

The charge-generating material may include, e.g., azo pigments such as monoazo pigments, bisazo pigments and trisazo pigments; perylene pigments such as perylene acid anhydrides and perylene acid imides; anthraquinone or polycyclic quinone pigments such as anthraquinone derivatives, anthanthrone derivatives, dibenzpyrenequinone derivatives, pyranthrone derivatives, violanthrone derivatives and isoviolanthrone derivatives; indigo pigments such as indigo derivatives and thioindigo derivatives; phthalocyanine pigments such as metal phthalocyanines and metal-free phthalocyanine; and perynone pigments such as bisbenzimidazole derivatives. Of these, azo pigments and phthalocyanine pigments are preferred. In particular, oxytitanium phthalocyanine, chlorogallium phthalocyanine and hydroxygallium phthalocyanine are preferred.

As the oxytitanium phthalocyanine, preferred are oxytitanium phthalocyanine crystals with a crystal form having strong peaks at Bragg angles (2θ±0.2°) of 9.0°, 14.2°, 23.9° and 27.1°, and oxytitanium phthalocyanine crystals with a crystal form having strong peaks at Bragg angles (2θ±0.2°) of 9.5°, 9.7°, 11.7°, 15.0°, 23.5°, 24.1° and 27.3°, all in CuKα characteristic X-ray diffraction.

As the chlorogallium phthalocyanine, preferred are chlorogallium phthalocyanine crystals with a crystal form having strong peaks at Bragg angles (2θ±0.2°) of 7.4°, 16.6°, 25.5° and 28.2°, chlorogallium phthalocyanine crystals with a crystal form having strong peaks at Bragg angles (2θ±0.2°) of 6.8°, 17.3°, 23.6° and 26.9°, and chlorogallium phthalocyanine crystals with a crystal form having strong peaks at Bragg angles (2θ±0.2°) of 8.7°, 9.2°, 17.6°, 24.0°, 27.4° and 28.8°, all in CuKα characteristic X-ray diffraction.

As the hydroxygallium phthalocyanine, preferred are hydroxygallium phthalocyanine crystals with a crystal form having strong peaks at Bragg angles (2θ±0.2°) of 7.3°, 24.9° and 28.1°, and hydroxygallium phthalocyanine crystals with a crystal form having strong peaks at Bragg angles (2θ±0.2°) of 7.5°, 9.9°, 12.5°, 16.3°, 18.6°, 25.1° and 28.3°, all in CuKα characteristic X-ray diffraction.

In the present invention, the Bragg angles in CuKα characteristic X-ray diffraction of the crystal form of the phthalocyanine crystals are measured under the following conditions.

Measuring instrument: Full-automatic X-ray diffractometer (trade name: MXP18; manufactured by Mach Science Co.
X-ray tube: Cu; Tube voltage: 50 kV; Tube current: 300 mA;
Scanning method: 2θ/θ scan; Scanning speed: 2°/min.;
Sampling interval: 0.020°; Start angle (2θ): 5°; Stop angle (2θ): 40°; Divergent slit: 0.5°; Scattering slit: 0.5°; and
Receiving slit: 0.3 mm. A concave monochromator is used.

The binder resin used in the charge generation layer may include, e.g., polymers, and copolymers, of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins. Of these, polyester, polycarbonate and polyvinyl acetal are preferred. In particular, polyvinyl acetal is much preferred.

The hole-transporting material may include, e.g., polycyclic aromatic compounds, heterocyclic compounds, hydrazone compounds, styryl compounds, benzidine compounds, triarylamine compounds and triphenylamine compounds, or polymers having in the backbone chain or side chain a group derived from any of these compounds.

The binder resin used in the hole transport layer may include, e.g., polyester, polycarbonate, polymethacrylate, polyarylate, polysulfone and polystyrene. Of these, polycarbonate and polyarylate are particularly preferred. Any of these may also preferably have as molecular weight a weight average molecular weight (Mw) ranging from 10,000 to 300,000.

In the hole transport layer, the hole-transporting material and the binder resin may preferably be in a proportion (hole-transporting material/binder resin) of from 10/5 to 5/10, and much preferably from 10/8 to 6/10.

In the case of the negative-chargeable electrophotographic photosensitive member, a surface protective layer may further be formed on the hole transport layer. The surface protective layer contains conductive particles or a charge-transporting material and a binder resin. The surface protective layer may further contain an additive such as a lubricant. The binder resin itself of the surface protective layer may have conductivity and/or charge transport properties. In such a case, the surface protective layer need not contain the conductive particles and/or the charge-transporting material. The binder resin of the surface protective layer may be either of a curable resin capable of curing by heat, light, radiations or the like and a non-curable thermoplastic resin.

An electron transport layer is formed between the charge generation layer and the support. The electron generation layer is constituted of a single layer or a plurality of layers. In the case when the electron generation layer is in plurality, at least one layer of the layers contains the above copolymer. Also, an adhesive layer for improving adherence or a layer for improving electrical properties, which is other than the electron generation layer containing the copolymer, such as a conductive layer formed of a resin with a metal oxide or conductive particles such as carbon black dispersed therein may be formed between the charge generation layer and the support.

The copolymer for the photosensitive layer, used in the present invention, is a copolymer having a repeating structural unit represented by the following formula (1) and a repeating structural unit represented by the following formula (2), or a copolymer having a repeating structural unit represented by the following formula (1) and a repeating structural unit represented by the following formula (3):

$$-(Z_1\text{-}A\text{-}Z_2\text{-}E_1)- \quad (1)$$

$$-(Z_3\text{-}A\text{-}Z_4\text{—}W_2\text{—}B_2\text{—}W_2)- \quad (2)$$

$$-(Z_5\text{—}B_3\text{—}Z_6\text{-}E_4)- \quad (3)$$

where, in the formulas (1), (2) and (3);

$Z_1$ to $Z_6$ each independently represent a single bond, an alkylene group, an arylene group, or an arylene group substituted with an alkyl group;

$E_1$ represents a divalent group represented by —$W_1$—$B_1$—$W_1$—, or a divalent group represented by the following formula (E11):

(E11)

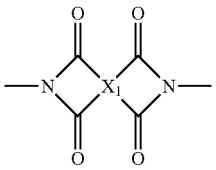

wherein $X_1$ represents a tetravalent group formed by removing four hydrogen atoms from a cyclic hydrocarbon;

$E_4$ represents a divalent group represented by —$W_3$—$B_4$—$W_3$—, or a divalent group represented by the following formula (E41):

(E41)

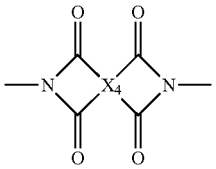

wherein $X_4$ represents a tetravalent group formed by removing four hydrogen atoms from a cyclic hydrocarbon;

$W_1$ to $W_3$ each independently represent a single bond, a urethane linkage, a urea linkage or an imide linkage;

A represents a divalent group represented by any of the following formulas (A-1) to (A-8):

A-1

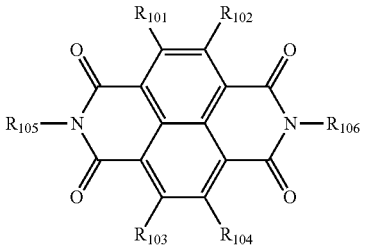

A-2

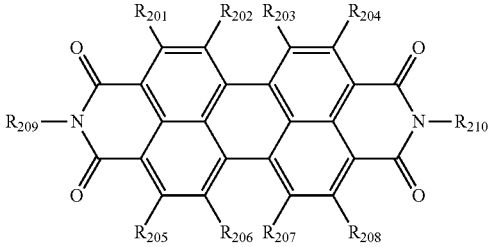

A-3

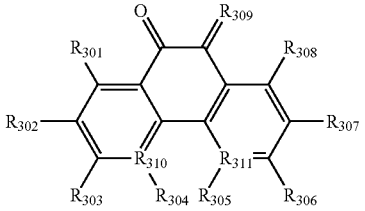

-continued

A-4

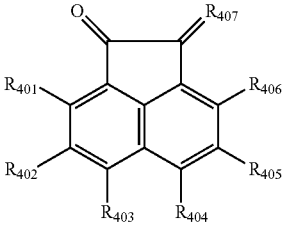

A-5

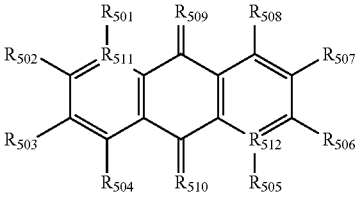

A-6

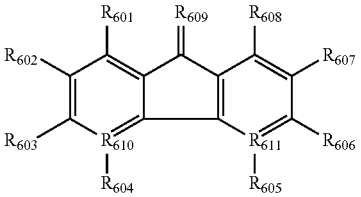

A-7

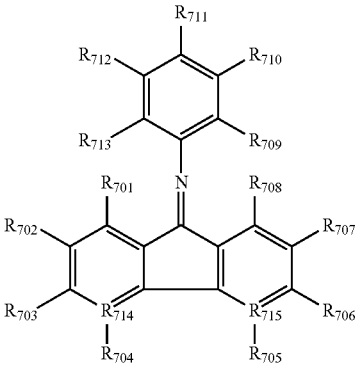

A-8

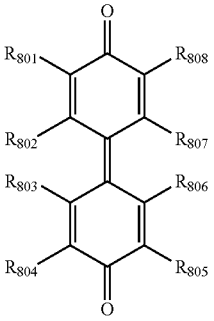

where, in the formulas (A-1) to (A-8);

$R_{101}$ to $R_{104}$ each independently represent a hydrogen atom, an aryl group, an aryl group substituted with a halogen atom, nitro group, cyano group, alkyl group or alkyl halide group, an alkyl group, or a cyano group, or represent a bonding site; and $R_{105}$ and $R_{106}$ each independently represent a hydrogen atom, an aryl group, an aryl group substituted with an alkyl group or halogen atom, or an alkyl group, or represent a bonding site; provided that any two of $R_{101}$ to $R_{106}$ are bonding sites;

$R_{201}$ to $R_{208}$ each independently represent a hydrogen atom, an aryl group, an aryl group substituted with a halogen atom, nitro group, cyano group, alkyl group or alkyl halide group, an alkyl group, or a cyano group, or represent a bonding site; and $R_{209}$ and $R_{210}$ each independently represent a hydrogen atom, an aryl group, an aryl group substituted with an alkyl group or halogen atom, or an alkyl group, or represent a bonding site; provided that any two of $R_{201}$ to $R_{210}$ are bonding sites;

$R_{301}$ to $R_{308}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{309}$ represents an oxygen atom or a dicyanomethylene group; and $R_{310}$ and $R_{311}$ each independently represent a carbon atom or a nitrogen atom, and, in the case of the nitrogen atom, $R_{304}$ and $R_{305}$ are not present; provided that any two of $R_{301}$ to $R_{308}$ are bonding sites;

$R_{401}$ to $R_{406}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; and $R_{407}$ represents an oxygen atom or a dicyanomethylene group; provided that any two of $R_{401}$ to $R_{406}$ are bonding sites;

$R_{501}$ to $R_{508}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{509}$ and $R_{510}$ each independently represent an oxygen atom or a dicyanomethylene group; and $R_{511}$ and $R_{512}$ each independently represent a carbon atom or a nitrogen atom, and, in the case of the nitrogen atom, $R_{501}$ and $R_{505}$ are not present; provided that any two of $R_{501}$ to $R_{508}$ are bonding sites;

$R_{601}$ to $R_{608}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{610}$ and $R_{611}$ each independently represent a carbon atom or a nitrogen atom, and, in the case of the nitrogen atom, $R_{604}$ and $R_{605}$ are not present; and $R_{609}$ represents a dicyanomethylene group; provided that any two of $R_{601}$ to $R_{608}$ are bonding sites;

$R_{701}$ to $R_{713}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{714}$ and $R_{715}$ each independently represent a carbon atom or a nitrogen atom, and, in the case of the nitrogen atom, $R_{704}$ and $R_{705}$ are not present; provided that any two of $R_{701}$ to $R_{713}$ are bonding sites; and $R_{801}$ to $R_{808}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; provided that any two of $R_{801}$ to $R_{808}$ are bonding sites;

in the formulas (1), (2) and (3);

$B_1$ and $B_4$ each independently represent an arylene group, an alkylene group, an alkarylene group (i.e., a divalent group having both an arylene moiety and an alkylene moiety), an arylene group substituted with an alkyl group, halogen atom, cyano group or nitro group, an alkylene group substituted with a halogen atom, cyano group or nitro group, an alkarylene group substituted with an alkyl group, halogen atom, cyano group or nitro group, an arylene group interrupted by an ether or sulfonyl, or an alkylene group interrupted by an ether; and $B_2$ and $B_3$ each independently represent an arylene group substituted with a carboxyl group only, an arylene group substituted with a carboxyl group and an alkyl group only, or an alkylene group substituted with a carboxyl group only. In other words, $B_2$ and $B_3$ each independently represent a substituted arylene group whose substituent(s) is/are a carboxyl group, a substituted arylene group whose substituents are a carboxyl group and an alkyl group, or a substituted alkylene group whose substituent(s) is/are a carboxyl group.

The electron transport layer may preferably contain the above copolymer in an amount of from 80% by mass to 100% by mass based on the total mass of the electron transport layer.

The electron transport layer may contain, besides the copolymer, a resin of various types, a cross-linking agent, organic particles, inorganic particles, a leveling agent and so forth in order to optimize film forming properties and electrical properties. These, however, may preferably be in a content of less than 50% by mass, and much preferably less than 20% by mass, based on the total mass of the electron transport layer.

In the above copolymer, the respective repeating structural units may be in any proportion selected as desired. The repeating structural unit represented by the formula (1) may preferably be in a proportion of from 50 mol % to 99 mol %, and much preferably from 70 mol % to 99 mol %, based on all the repeating structural units in the copolymer.

In the case when the copolymer is a copolymer having the repeating structural unit represented by the formula (1) and the repeating structural unit represented by the formula (2), the repeating structural unit represented by the formula (2) may preferably be in a proportion of from 1 mol % to 30 mol % based on all the repeating structural units in the copolymer. The repeating structural unit represented by the formula (1) and the repeating structural unit represented by the formula (2) in total may preferably be in a proportion of from 70 mol % to 100 mol % based on all the repeating structural units in the copolymer.

In the case when the copolymer is a copolymer having the repeating structural unit represented by the formula (1) and the repeating structural unit represented by the formula (3), too, the repeating structural unit represented by the formula (3) may preferably be in a proportion of from 1 mol % to 30 mol % based on all the repeating structural units in the copolymer. The repeating structural unit represented by the formula (1) and the repeating structural unit represented by the formula (3) in total may also preferably be in a proportion of from 70 mol % to 100 mol % based on all the repeating structural units in the copolymer.

Specific examples of the copolymer used in the present invention are shown below, by which, however, the present invention is by no means limited.

In the following Tables 1 to 16C, bonding sites are shown by dotted lines. Where the linkage is a single bond, it is shown as "sing.".

The formulas (1), (2) and (3) are the same as the groups (structures) given in Tables 1 to 16C in terms of the right-to-left direction. As to the Exemplary Compounds 125-127, 209-211, 308-310, 322-357, 407, 408, 414-444, 509, 510, 513-549, 607-609, 612-646, 707-709, 712-745, 807-809 and 812-844, the groups of —NHCOO— as $W_1$ and $W_3$ are arranged in the direction such that the N's are bound to the $B_1$ and $B_4$, respectively.

Table 1 (given later) shows specific examples (Exemplary Compounds) of the copolymer having the repeating structural unit represented by the formula (1) and the repeating structural unit represented by the formula (2).

Tables 2A and 2B (given later) show specific examples (Exemplary Compounds) of the copolymer having the repeating structural unit represented by the formula (1) and the repeating structural unit represented by the formula (3). Table 2C (given later) shows specific examples (Exemplary Compounds) of the copolymer having the repeating structural unit represented by the formula (1) and the repeating structural unit represented by the formula (2).

Table 3 (given later) shows specific examples (Exemplary Compounds) of the copolymer having the repeating structural unit represented by the formula (1) and the repeating structural unit represented by the formula (2).

Tables 4A and 4B (given later) show specific examples (Exemplary Compounds) of the copolymer having the repeating structural unit represented by the formula (1) and the repeating structural unit represented by the formula (3). Table 4C (given later) shows specific examples (Exemplary Compounds) of the copolymer having the repeating structural unit represented by the formula (1) and the repeating structural unit represented by the formula (2).

Table 5 (given later) shows specific examples (Exemplary Compounds) of the copolymer having the repeating structural unit represented by the formula (1) and the repeating structural unit represented by the formula (2).

Tables 6A, 6B, 6C and 6D (given later) show specific examples (Exemplary Compounds) of the copolymer having the repeating structural unit represented by the formula (1) and the repeating structural unit represented by the formula (3).

Table 7 (given later) shows specific examples (Exemplary Compounds) of the copolymer having the repeating structural unit represented by the formula (1) and the repeating structural unit represented by the formula (2).

Tables 8A, 8B, 8C and 8D (given later) show specific examples (Exemplary Compounds) of the copolymer having the repeating structural unit represented by the formula (1) and the repeating structural unit represented by the formula (3).

Table 9 (given later) shows specific examples (Exemplary Compounds) of the copolymer having the repeating structural unit represented by the formula (1) and the repeating structural unit represented by the formula (2).

Tables 10A, 10B and 10C (given later) show specific examples (Exemplary Compounds) of the copolymer having the repeating structural unit represented by the formula (1) and the repeating structural unit represented by the formula (3).

Table 11 (given later) shows specific examples (Exemplary Compounds) of the copolymer having the repeating structural unit represented by the formula (1) and the repeating structural unit represented by the formula (2).

Tables 12A, 12B and 12C (given later) show specific examples (Exemplary Compounds) of the copolymer having the repeating structural unit represented by the formula (1) and the repeating structural unit represented by the formula (3).

Table 13 (given later) shows specific examples (Exemplary Compounds) of the copolymer having the repeating structural unit represented by the formula (1) and the repeating structural unit represented by the formula (2).

Tables 14A, 14B and 14C (given later) show specific examples (Exemplary Compounds) of the copolymer having the repeating structural unit represented by the formula (1) and the repeating structural unit represented by the formula (3).

Table 15 (given later) shows specific examples (Exemplary Compounds) of the copolymer having the repeating structural unit represented by the formula (1) and the repeating structural unit represented by the formula (2).

Tables 16A, 16B and 16C (given below) show specific examples (Exemplary Compounds) of the copolymer having the repeating structural unit represented by the formula (1) and the repeating structural unit represented by the formula (3).

TABLE 1

| | A | $B_1$ | $B_2$ |
|---|---|---|---|
| 101 | 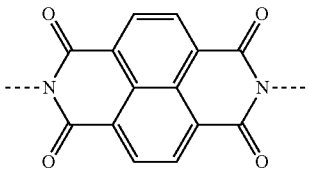 | 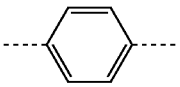 | 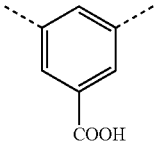 |
| 102 | 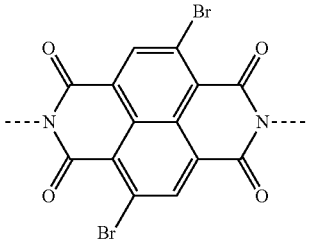 | 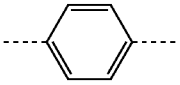 | 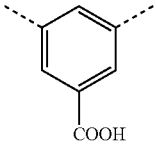 |

TABLE 1-continued
| | | | |
|---|---|---|---|
| 103 | 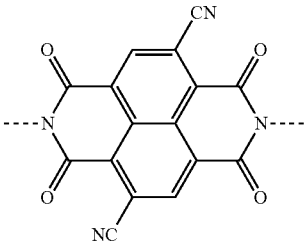 | 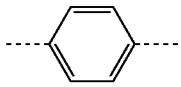 | 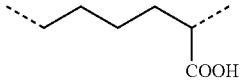 |
| 104 | 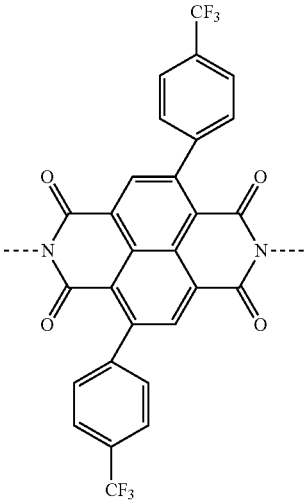 | 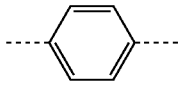 | 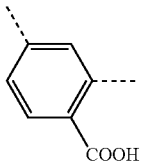 |
| 105 | 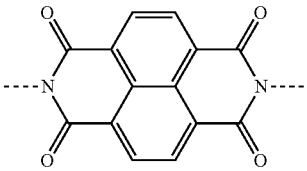 | 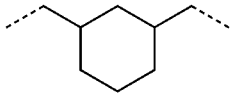 | 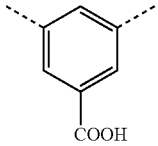 |
| 106 | 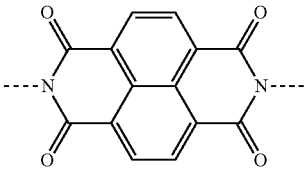 | $(CH_2)_6$ | 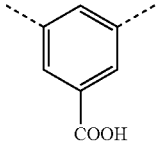 |
| 107 | 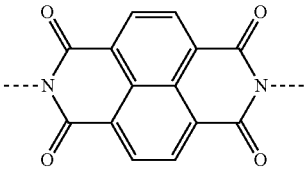 | 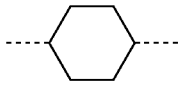 | 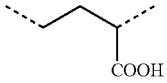 |
| 108 | 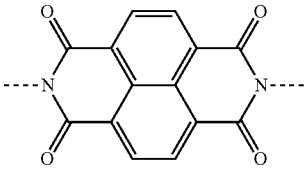 | 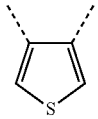 | 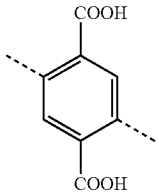 |

TABLE 1-continued
| | | | |
|---|---|---|---|
| 109 | 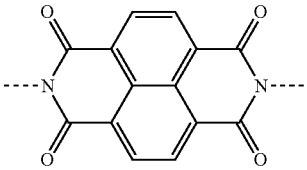 | 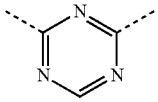 | 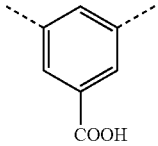 |
| 110 | 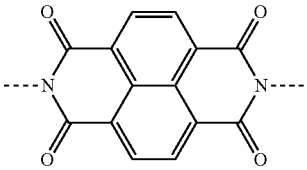 | 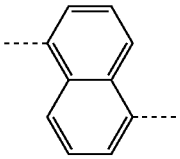 | 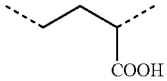 |
| 111 | 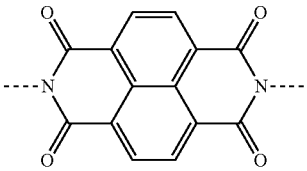 | 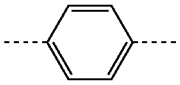 | 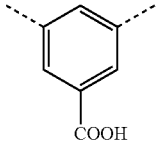 |
| 112 | 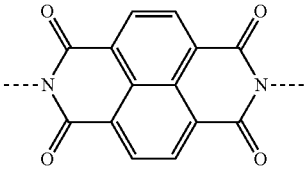 | 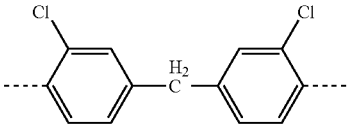 | 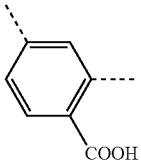 |
| 113 | 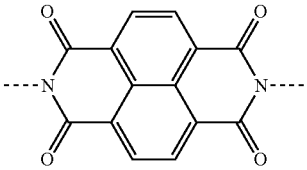 | 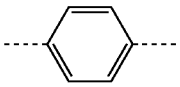 | 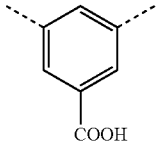 |
| 114 | 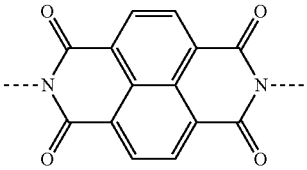 | 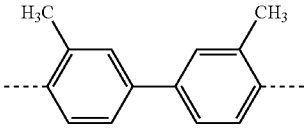 | 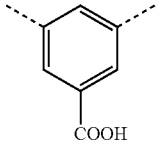 |
| 115 | 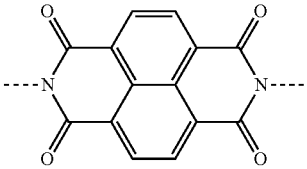 | 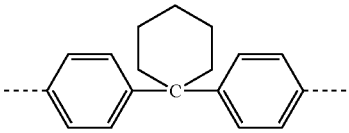 | 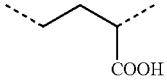 |
| 116 | 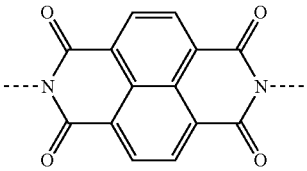 | 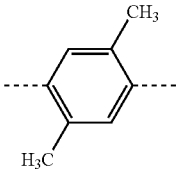 | 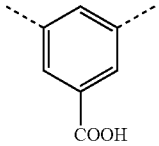 |
| 117 | 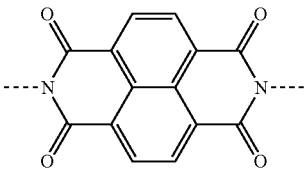 | 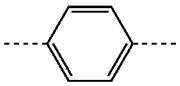 | 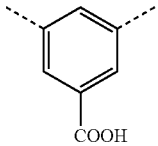 |

TABLE 1-continued

| | | | |
|---|---|---|---|
| 118 | 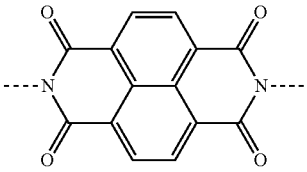 | 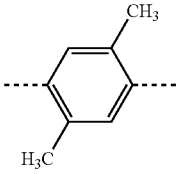 | 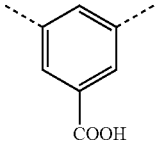 |
| 119 | 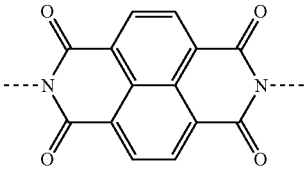 | 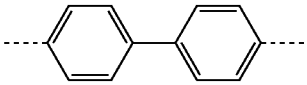 | 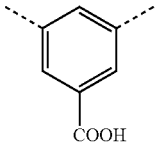 |
| 120 | 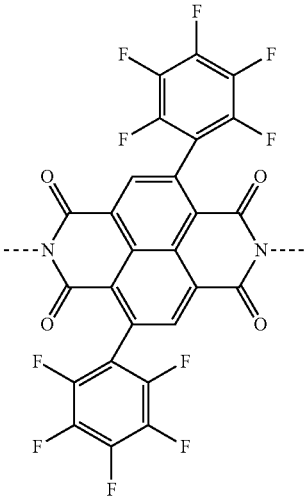 | 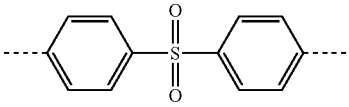 | 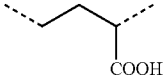 |

| | $W_1$ | $W_2$ | $Z_1$ | $Z_2$ | $Z_3$ | $Z_4$ |
|---|---|---|---|---|---|---|
| 101 | sing. | sing. | sing. | sing. | sing. | sing. |
| 102 | sing. | sing. | sing. | sing. | sing. | sing. |
| 103 | sing. | sing. | sing. | sing. | sing. | sing. |
| 104 | sing. | sing. | sing. | sing. | sing. | sing. |
| 105 | sing. | sing. | sing. | sing. | sing. | sing. |
| 106 | sing. | sing. | sing. | sing. | sing. | sing. |
| 107 | sing. | sing. | sing. | sing. | sing. | sing. |
| 108 | sing. | sing. | sing. | sing. | sing. | sing. |
| 109 | sing. | sing. | sing. | sing. | sing. | sing. |
| 110 | sing. | sing. | sing. | sing. | sing. | sing. |
| 111 | sing. | sing. | sing. | sing. | sing. | sing. |
| 112 | sing. | sing. | sing. | sing. | sing. | sing. |
| 113 | sing. | sing. | sing. | sing. | sing. | sing. |
| 114 | sing. | sing. | sing. | sing. | sing. | sing. |
| 115 | sing. | sing. | sing. | sing. | sing. | sing. |
| 116 | sing. | sing. | sing. | sing. | sing. | sing. |
| 117 | sing. | sing. | 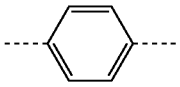 | 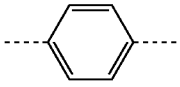 | 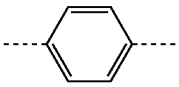 | 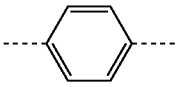 |
| 118 | sing. | sing. | $-(CH_2)_6-$ | 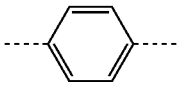 | $-(CH_2)_6-$ | 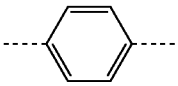 |
| 119 | sing. | sing. | sing. | sing. | sing. | sing. |
| 120 | sing. | sing. | sing. | sing. | sing. | sing. |

TABLE 2A
| | A | $E_1$ | $B_3$ | $E_4$ |
|---|---|---|---|---|
| 121 | 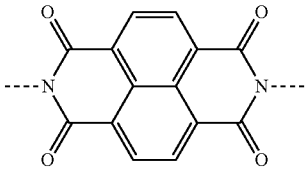 | 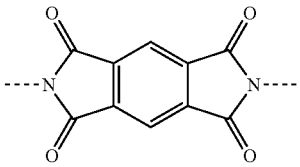 | 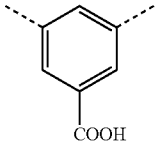 | 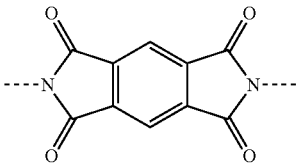 |
| 122 | 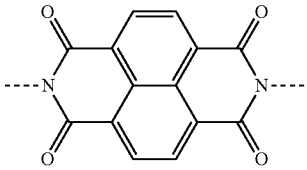 | 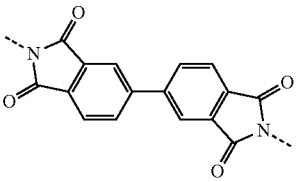 | 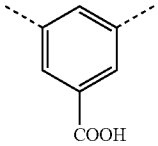 | 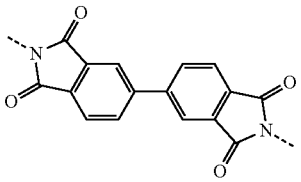 |
| 123 | 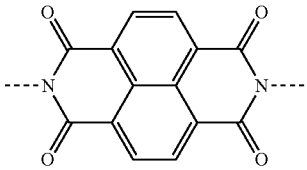 | 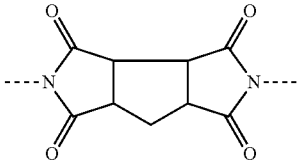 | 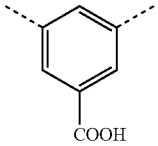 | 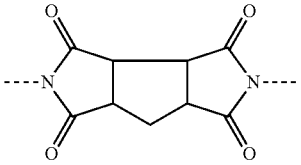 |
| 124 | 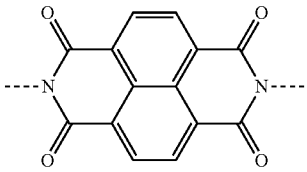 | 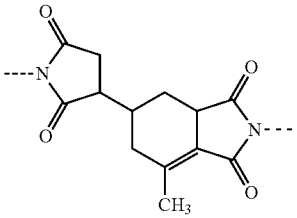 | 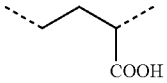 | 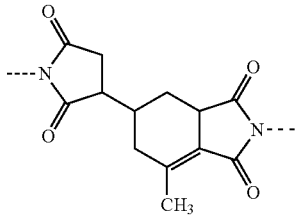 |
| | $Z_1$ | $Z_2$ | $Z_5$ | $Z_6$ |
|---|---|---|---|---|
| 121 | 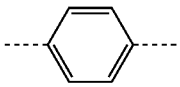 | 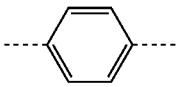 | 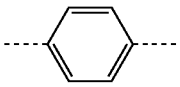 | 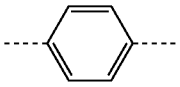 |
| 122 | 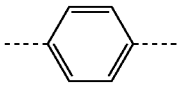 | 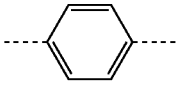 | sing. | sing. |
| 123 | 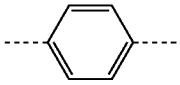 | 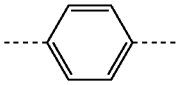 | sing. | sing. |
| 124 | 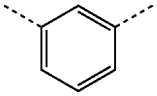 | 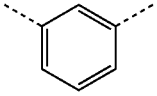 | sing. | sing. |
TABLE 2B
| | A | $B_1$ | $B_3$ | $B_4$ |
|---|---|---|---|---|
| 125 | 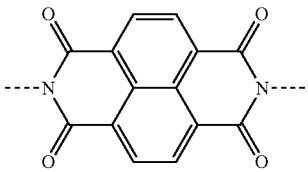 | 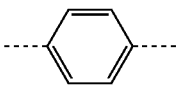 | 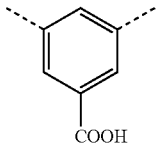 | 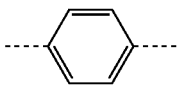 |

TABLE 2B-continued
| | | | | |
|---|---|---|---|---|
| 126 | 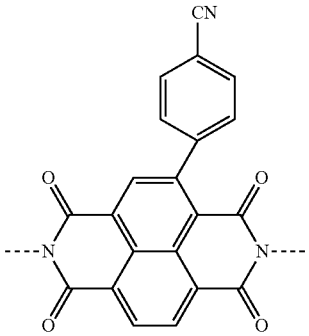 | 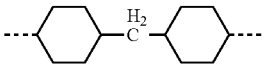 | 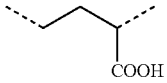 | 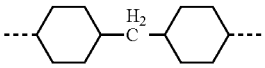 |
| 127 | 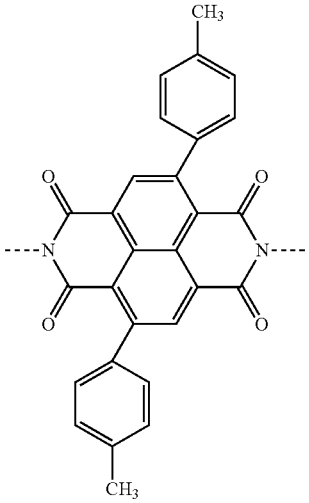 | 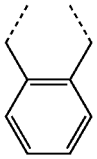 | 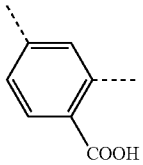 | 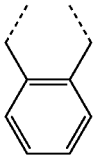 |
| 128 | 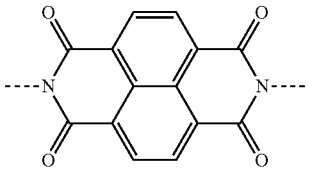 | 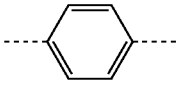 | 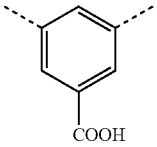 | 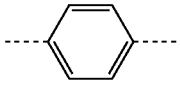 |
| 129 | 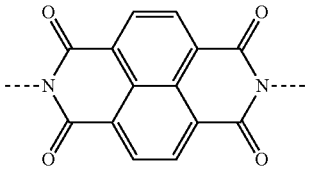 | 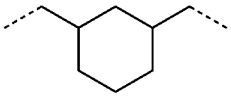 | 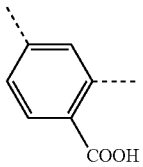 | 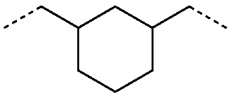 |
| 130 | 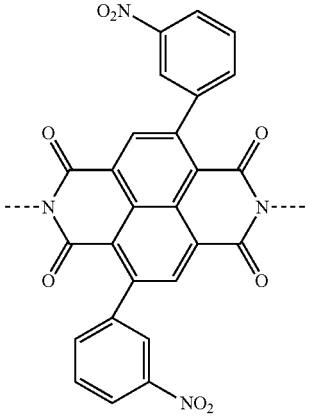 | $(CH_2)_6$ | 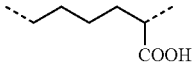 | $(CH_2)_6$ |

TABLE 2B-continued
| | $W_1$ | $W_3$ | $Z_1$ | $Z_2$ | $Z_5$ | $Z_6$ |
|---|---|---|---|---|---|---|
| 125 | 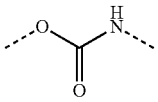 | 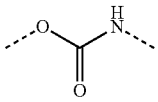 | 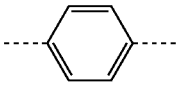 | 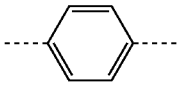 | sing. | sing. |
| 126 | 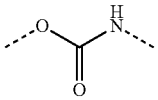 | 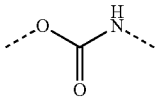 | 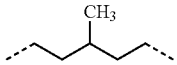 | 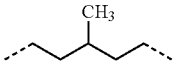 | sing. | sing. |
| 127 | 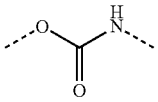 | 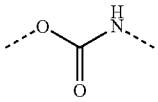 | 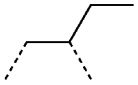 | 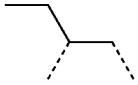 | sing. | sing. |
| 128 | 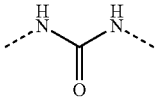 | 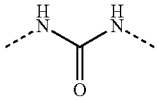 | 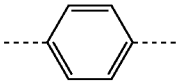 | 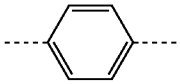 | sing. | sing. |
| 129 | 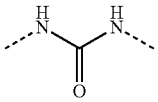 | 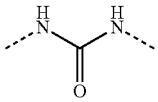 | 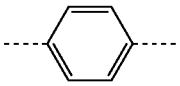 | 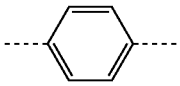 | sing. | sing. |
| 130 | 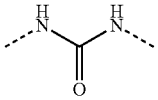 | 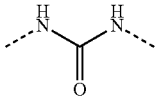 | $-(CH_2)_6-$ | 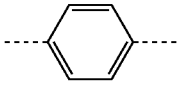 | $-(CH_2)_6-$ | 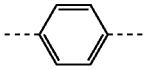 |
TABLE 2C
| | A | $B_1$ |
|---|---|---|
| 131 | 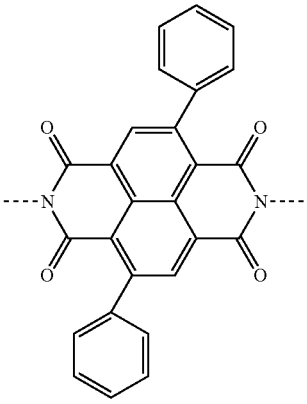 | 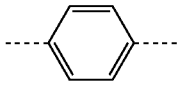 |
| 132 | 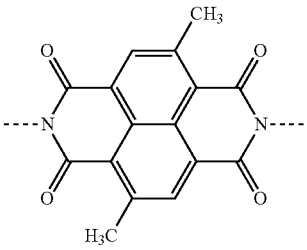 | 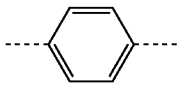 |

TABLE 2C-continued
| | | |
|---|---|---|
| 133 | 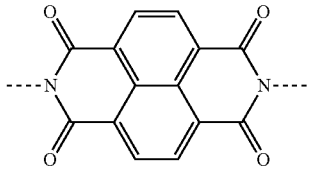 | 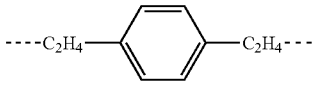 |
| 134 | 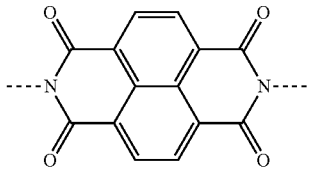 | 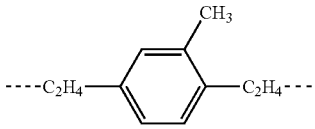 |
| 135 | 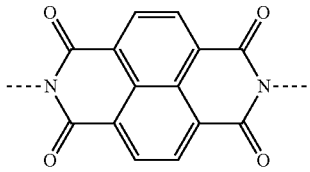 | 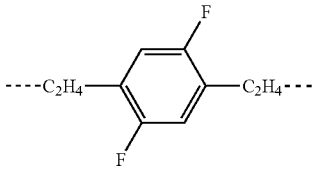 |
| 136 | 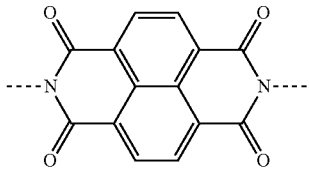 | 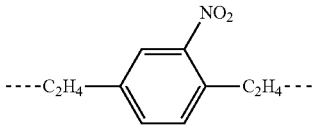 |
| 137 | 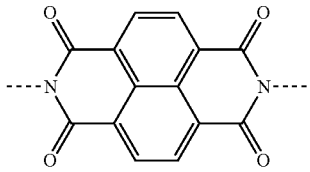 | 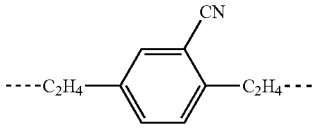 |
| 138 | 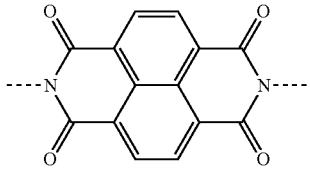 | 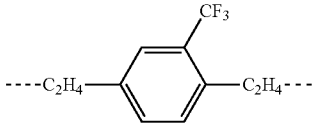 |
| 139 | 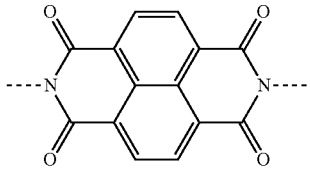 | 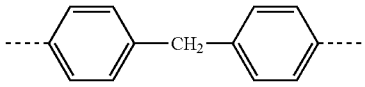 |
| 140 | 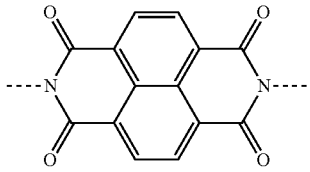 | 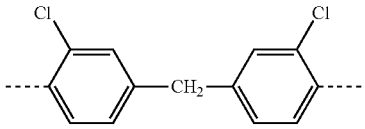 |
| 141 | 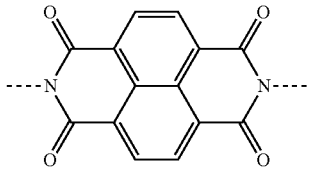 | 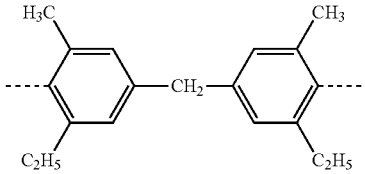 |

TABLE 2C-continued
| | | |
|---|---|---|
| 142 | 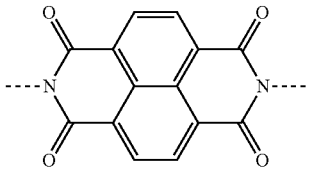 | 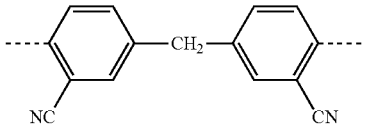 |
| 143 | 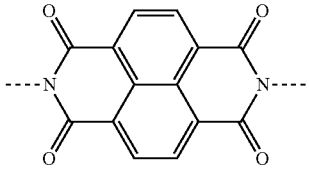 | 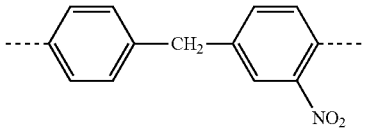 |
| 144 | 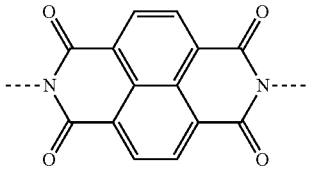 | 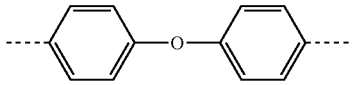 |
| 145 | 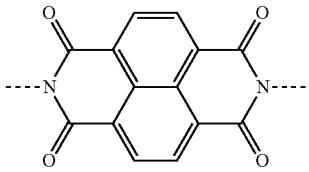 | 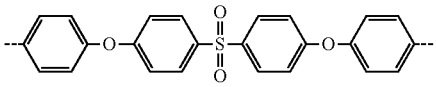 |
| 146 | 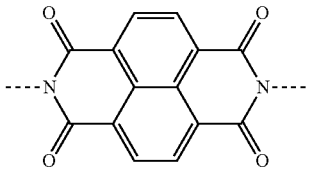 | 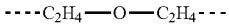 |
| 147 | 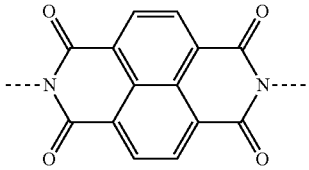 | 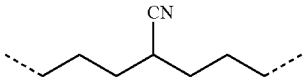 |
| 148 | 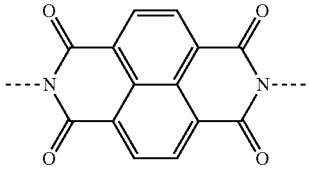 | 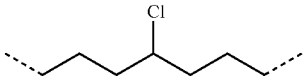 |
| 149 | 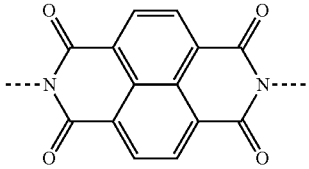 | 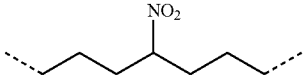 |

TABLE 2C-continued
| | | |
|---|---|---|
| 150 | 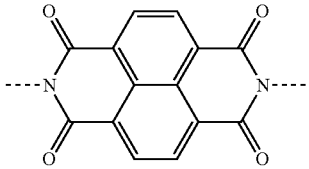 | 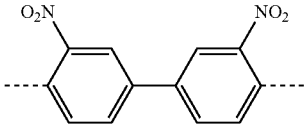 |
| 151 | 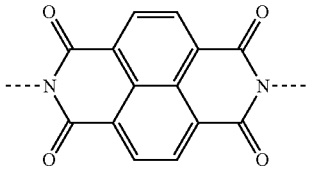 | 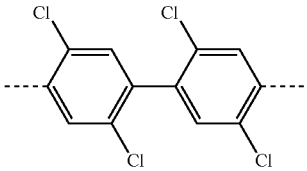 |
| 152 | 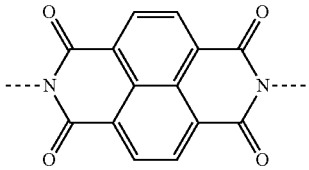 | 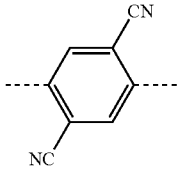 |
| 153 | 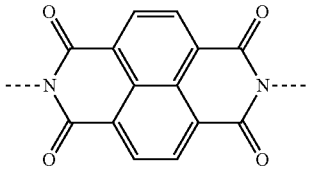 | 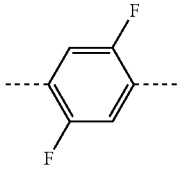 |
| 154 | 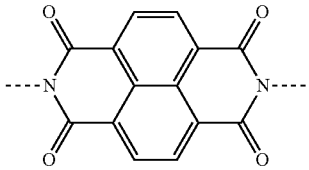 | 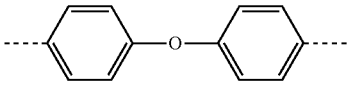 |
| 155 | 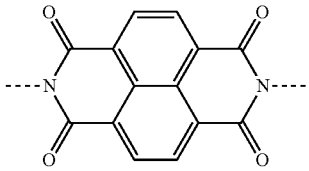 | 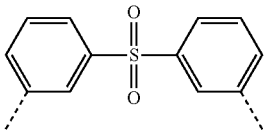 |
| 156 | 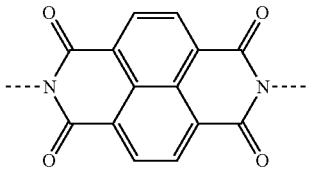 | 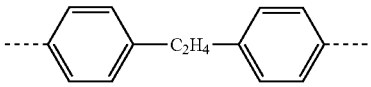 |
| 157 | 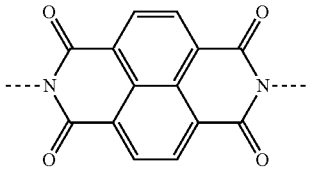 | -----$(CH_2)_2$----- |
| 158 | 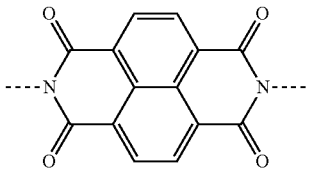 | -----$(CH_2)_{16}$--- |

TABLE 2C-continued
| | | |
|---|---|---|
| 159 | 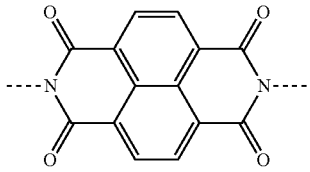 | 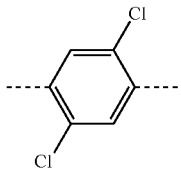 |
| 160 | 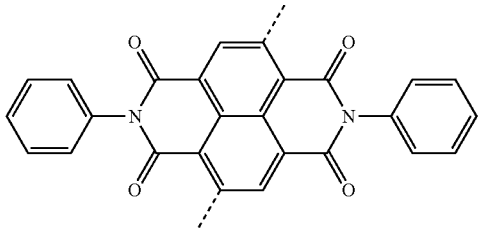 | 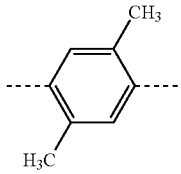 |
| 161 | 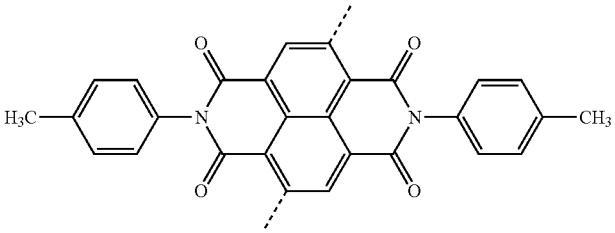 | 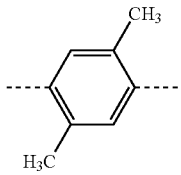 |
| 162 | 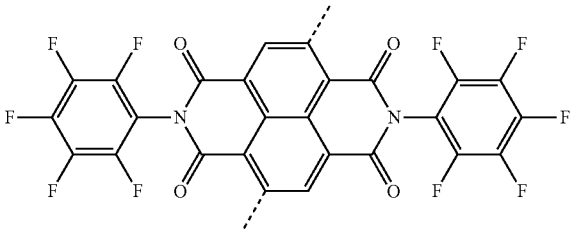 | 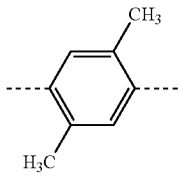 |
| 163 | 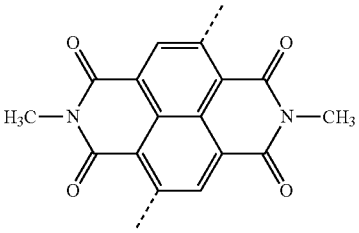 | 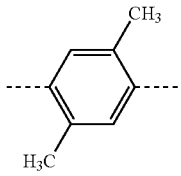 |
| 164 | 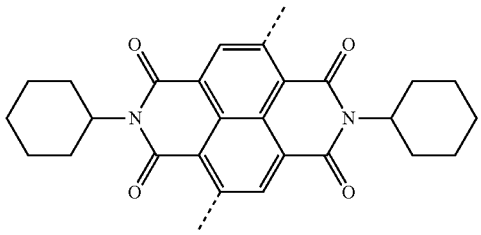 | 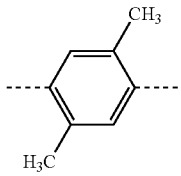 |
| | $B_2$ | $W_1$ | $W_2$ | $Z_1$ | $Z_2$ | $Z_3$ | $Z_4$ |
|---|---|---|---|---|---|---|---|
| 131 | 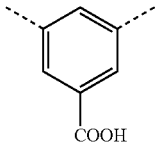 | sing. | sing. | sing. | sing. | sing. | sing. |

TABLE 2C-continued
| | | | | | | | |
|---|---|---|---|---|---|---|---|
| 132 | 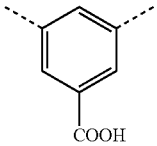 | sing. | sing. | sing. | sing. | sing. | sing. |
| 133 | 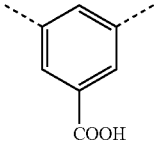 | sing. | sing. | sing. | sing. | sing. | sing. |
| 134 | 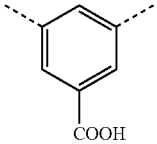 | sing. | sing. | sing. | sing. | sing. | sing. |
| 135 | 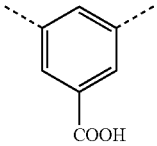 | sing. | sing. | sing. | sing. | sing. | sing. |
| 136 | 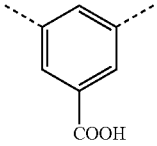 | sing. | sing. | sing. | sing. | sing. | sing. |
| 137 | 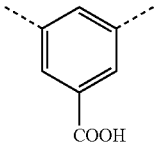 | sing. | sing. | sing. | sing. | sing. | sing. |
| 138 | 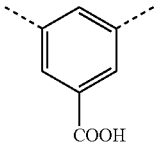 | sing. | sing. | sing. | sing. | sing. | sing. |
| 139 | 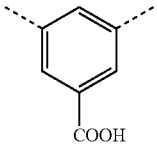 | sing. | sing. | sing. | sing. | sing. | sing. |
| 140 | 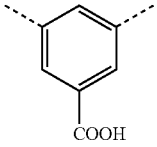 | sing. | sing. | sing. | sing. | sing. | sing. |
| 141 | 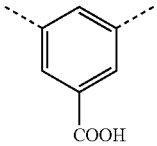 | sing. | sing. | sing. | sing. | sing. | sing. |

TABLE 2C-continued
| | | | | | | | |
|---|---|---|---|---|---|---|---|
| 142 | 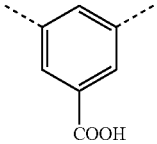 | sing. | sing. | sing. | sing. | sing. | sing. |
| 143 | 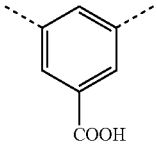 | sing. | sing. | sing. | sing. | sing. | sing. |
| 144 | 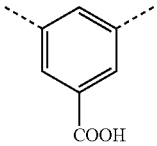 | sing. | sing. | sing. | sing. | sing. | sing. |
| 145 | 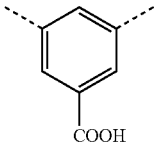 | sing. | sing. | sing. | sing. | sing. | sing. |
| 146 | 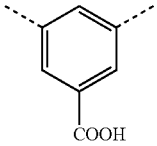 | sing. | sing. | sing. | sing. | sing. | sing. |
| 147 | 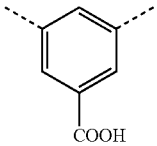 | sing. | sing. | sing. | sing. | sing. | sing. |
| 148 | 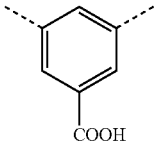 | sing. | sing. | sing. | sing. | sing. | sing. |
| 149 | 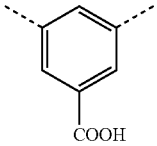 | sing. | sing. | sing. | sing. | sing. | sing. |
| 150 | 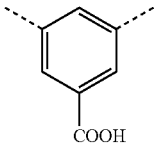 | sing. | sing. | sing. | sing. | sing. | sing. |
| 151 | 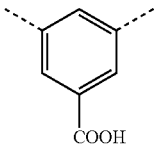 | sing. | sing. | sing. | sing. | sing. | sing. |

TABLE 2C-continued
| | | | | | | | |
|---|---|---|---|---|---|---|---|
| 152 | 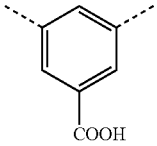 | sing. | sing. | sing. | sing. | sing. | sing. |
| 153 | 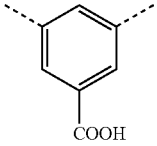 | sing. | sing. | sing. | sing. | sing. | sing. |
| 154 | 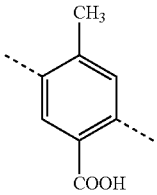 | sing. | sing. | sing. | sing. | sing. | sing. |
| 155 | 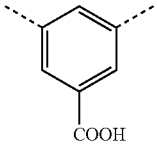 | sing. | sing. | sing. | sing. | sing. | sing. |
| 156 | 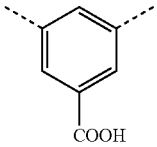 | sing. | sing. | sing. | sing. | sing. | sing. |
| 157 | 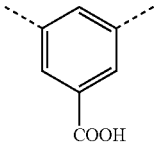 | sing. | sing. | sing. | sing. | sing. | sing. |
| 158 | 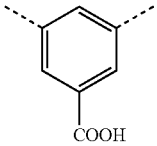 | sing. | sing. | sing. | sing. | sing. | sing. |
| 159 | 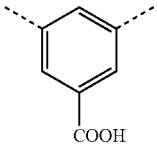 | sing. | sing. | sing. | sing. | sing. | sing. |
| 160 | 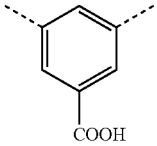 | sing. | sing. | sing. | sing. | sing. | sing. |
| 161 | 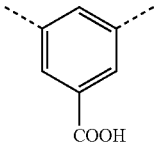 | sing. | sing. | sing. | sing. | sing. | sing. |

TABLE 2C-continued
| | | | | | | | |
|---|---|---|---|---|---|---|---|
| 162 | 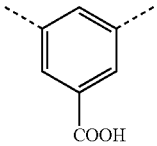 | sing. | sing. | sing. | sing. | sing. | sing. |
| 163 | 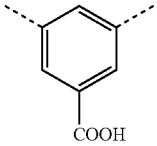 | sing. | sing. | sing. | sing. | sing. | sing. |
| 164 | 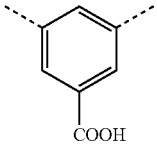 | sing. | sing. | sing. | sing. | sing. | sing. |
TABLE 3
| | A | $B_1$ | $B_2$ | $W_1$ | $W_2$ |
|---|---|---|---|---|---|
| 201 | 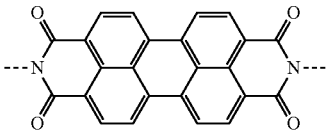 | 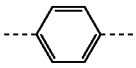 | 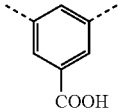 | sing. | sing. |
| 202 | 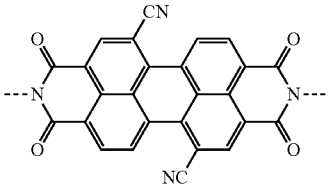 | 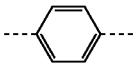 | 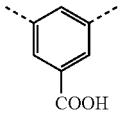 | sing. | sing. |
| 203 | 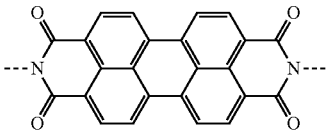 | 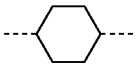 | 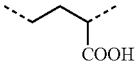 | sing. | sing. |
| 204 | 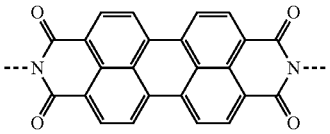 | 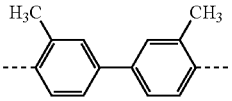 | 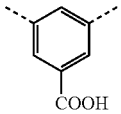 | sing. | sing. |
| 205 | 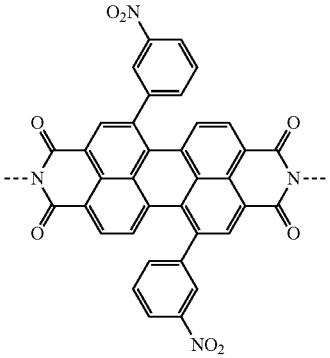 | 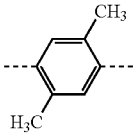 | 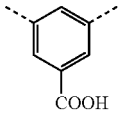 | sing. | sing. |

TABLE 3-continued
| | $Z_1$ | $Z_2$ | $Z_3$ | $Z_4$ |
|---|---|---|---|---|
| 201 | sing. | sing. | sing. | sing. |
| 202 | sing. | sing. | sing. | sing. |
| 203 | sing. | sing. | sing. | sing. |
| 204 | sing. | sing. | sing. | sing. |
| 205 | $-(CH_2)_6-$ | 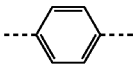 | $-(CH_2)_6-$ | 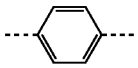 |
TABLE 4A
| | A | $E_1$ | $B_3$ | $E_4$ |
|---|---|---|---|---|
| 206 | 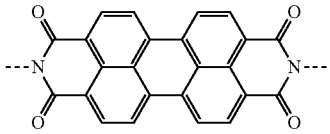 | 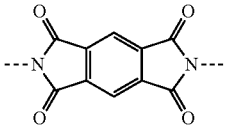 | 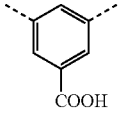 | 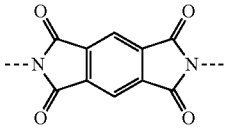 |
| 207 | 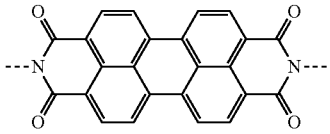 | 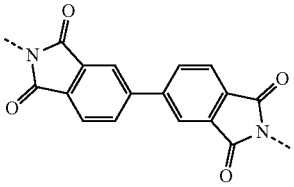 | 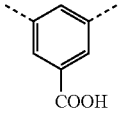 | 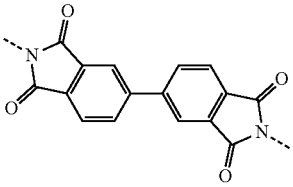 |
| 208 | 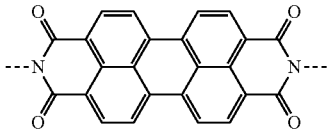 | 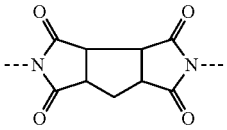 | 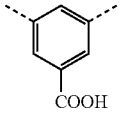 | 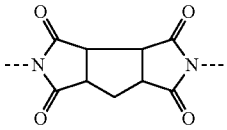 |
| | $Z_1$ | $Z_2$ | $Z_5$ | $Z_6$ |
|---|---|---|---|---|
| 206 | 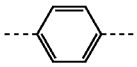 | 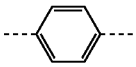 | 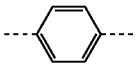 | 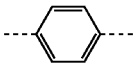 |
| 207 | 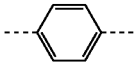 | 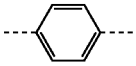 | sing. | sing. |
| 208 | 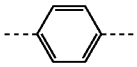 | 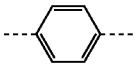 | sing. | sing. |

TABLE 4B
| | A | $B_1$ | $B_3$ | $B_4$ |
|---|---|---|---|---|
| 209 | 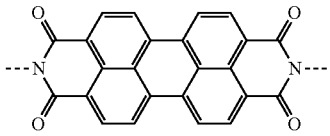 | 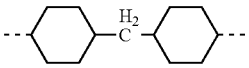 | 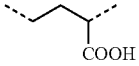 | 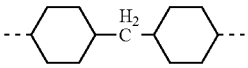 |
| 210 | 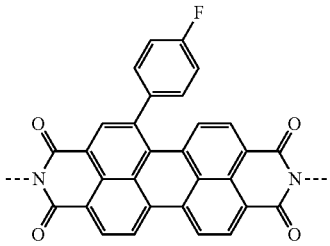 | 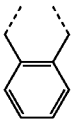 | 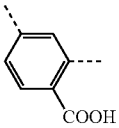 | 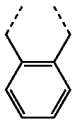 |
| 211 | 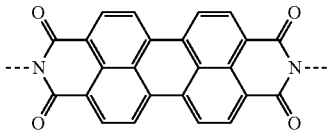 | 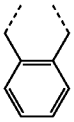 | 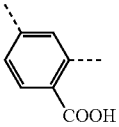 | 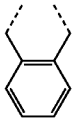 |
| | $W_1$ | $W_3$ | $Z_1$ | $Z_2$ | $Z_5$ | $Z_6$ |
|---|---|---|---|---|---|---|
| 209 | 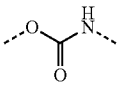 | 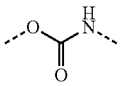 | 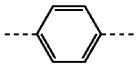 | 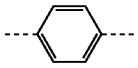 | sing. | sing. |
| 210 | 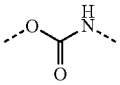 | 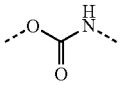 | 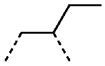 | 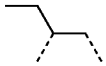 | sing. | sing. |
| 211 | 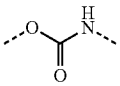 | 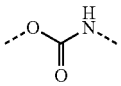 | 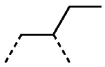 | 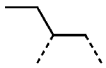 | sing. | sing. |

TABLE 4C
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 212 | 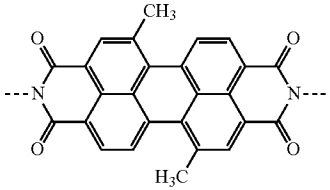 | 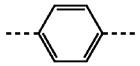 | 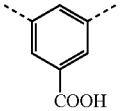 | sing. | sing. | sing. | sing. | sing. | sing. |
| 213 | 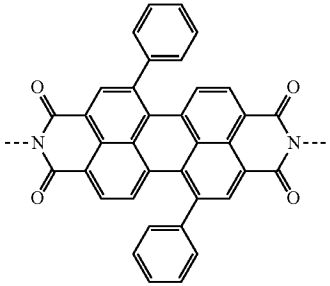 | 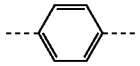 | 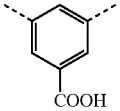 | sing. | sing. | sing. | sing. | sing. | sing. |
| 214 | 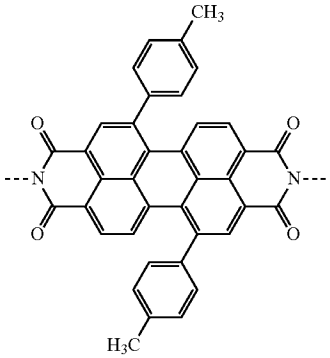 | 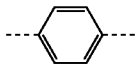 | 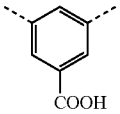 | sing. | sing. | sing. | sing. | sing. | sing. |

TABLE 4C-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 215 | 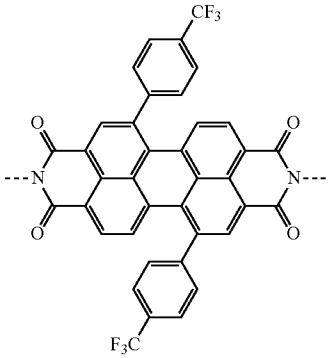 | 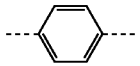 | 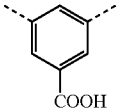 | sing. | sing. | sing. | sing. | sing. | sing. |
| 216 | 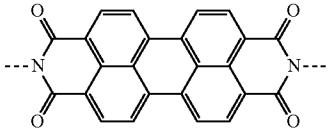 | 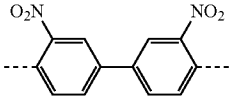 | 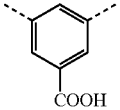 | sing. | sing. | sing. | sing. | sing. | sing. |
| 217 | 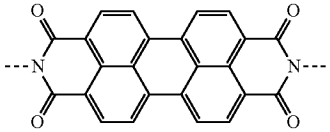 | 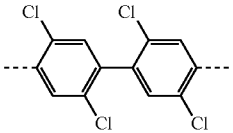 | 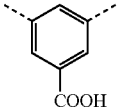 | sing. | sing. | sing. | sing. | sing. | sing. |
| 218 | 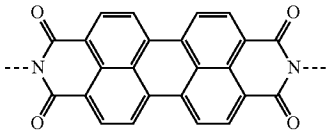 | 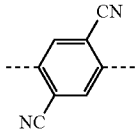 | 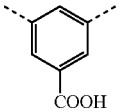 | sing. | sing. | sing. | sing. | sing. | sing. |
| 219 | 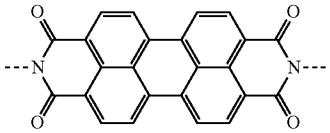 | 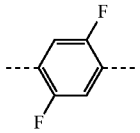 | 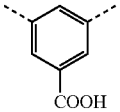 | sing. | sing. | sing. | sing. | sing. | sing. |

TABLE 4C-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 220 | 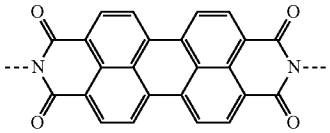 | 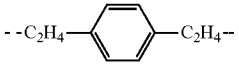 | 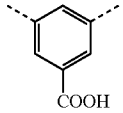 | sing. | sing. | sing. | sing. | sing. | sing. |
| 221 | 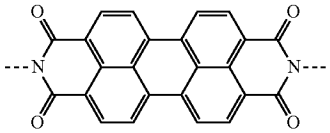 | 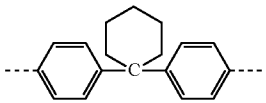 | 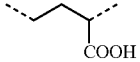 | sing. | sing. | sing. | sing. | sing. | sing. |
| 222 | 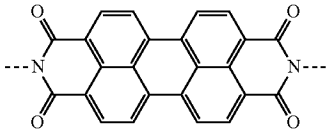 | 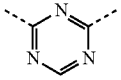 | 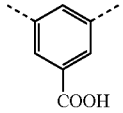 | sing. | sing. | sing. | sing. | sing. | sing. |
| 223 | 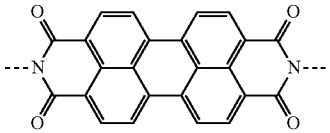 | 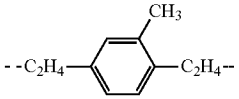 | 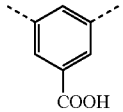 | sing. | sing. | sing. | sing. | sing. | sing. |
| 224 | 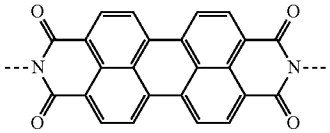 | 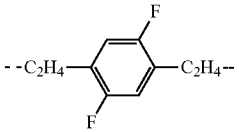 | 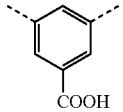 | sing. | sing. | sing. | sing. | sing. | sing. |
| 225 | 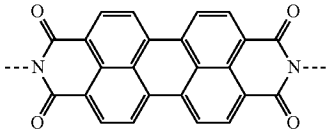 | 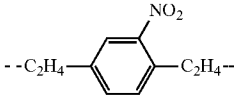 | 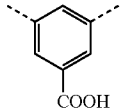 | sing. | sing. | sing. | sing. | sing. | sing. |
| 226 | 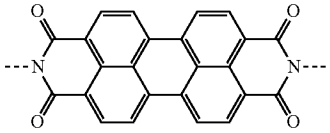 | 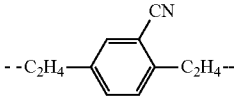 | 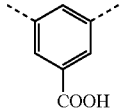 | sing. | sing. | sing. | sing. | sing. | sing. |

TABLE 4C-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 227 | 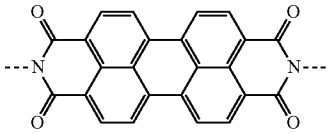 | 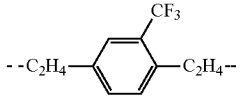 | 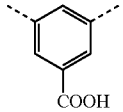 | sing. | sing. | sing. | sing. | sing. | sing. |
| 228 | 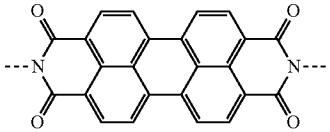 | 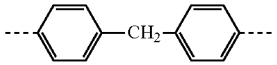 | 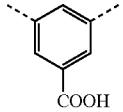 | sing. | sing. | sing. | sing. | sing. | sing. |
| 229 | 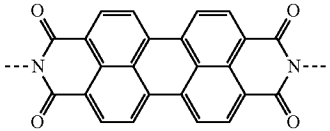 | 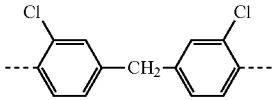 | 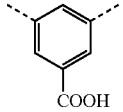 | sing. | sing. | sing. | sing. | sing. | sing. |
| 230 | 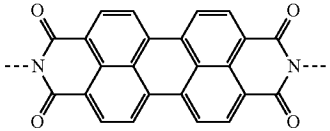 | 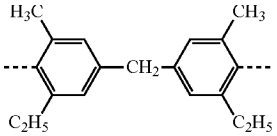 | 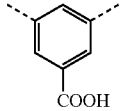 | sing. | sing. | sing. | sing. | sing. | sing. |
| 231 | 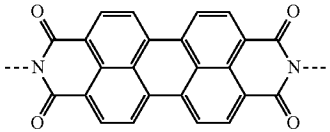 | 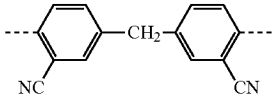 | 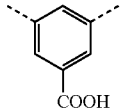 | sing. | sing. | sing. | sing. | sing. | sing. |
| 232 | 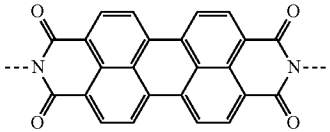 | 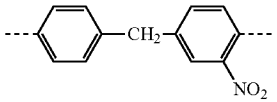 | 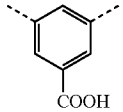 | sing. | sing. | sing. | sing. | sing. | sing. |
| 233 | 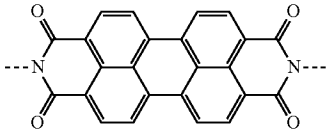 | 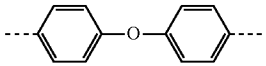 | 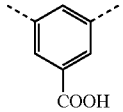 | sing. | sing. | sing. | sing. | sing. | sing. |

TABLE 4C-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 234 | 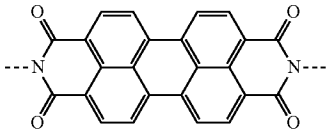 | ----$C_2H_4$—O—$C_2H_4$--- | 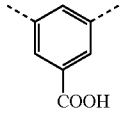 | sing. | sing. | sing. | sing. | sing. | sing. |
| 235 | 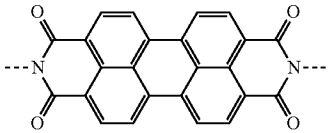 | 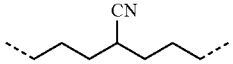 | 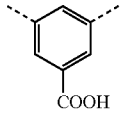 | sing. | sing. | sing. | sing. | sing. | sing. |
| 236 | 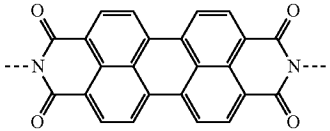 | 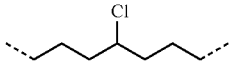 | 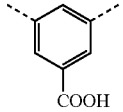 | sing. | sing. | sing. | sing. | sing. | sing. |
| 237 | 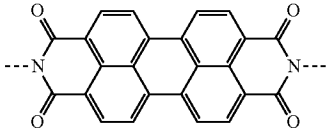 | 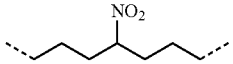 | 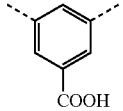 | sing. | sing. | sing. | sing. | sing. | sing. |
| 238 | 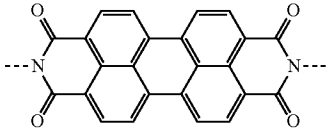 | 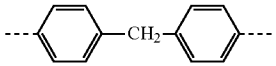 | 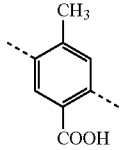 | sing. | sing. | sing. | sing. | sing. | sing. |
| 239 | 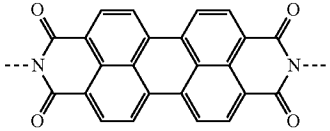 | 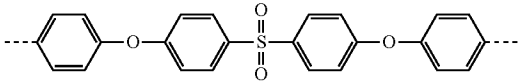 | 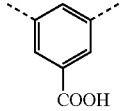 | sing. | sing. | sing. | sing. | sing. | sing. |
| 240 | 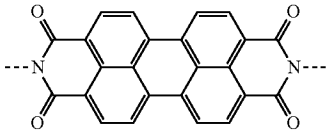 | 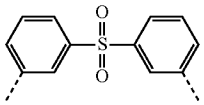 | 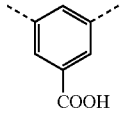 | sing. | sing. | sing. | sing. | sing. | sing. |

TABLE 4C-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 241 | 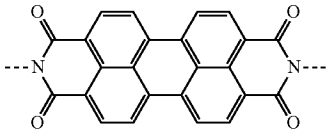 | 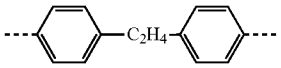 | 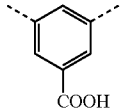 | sing. | sing. | sing. | sing. | sing. | sing. |
| 242 | 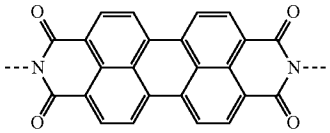 | -----$(CH_2)_2$---- | 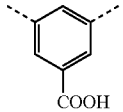 | sing. | sing. | sing. | sing. | sing. | sing. |
| 243 | 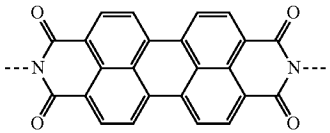 | -----$(CH_2)_{16}$--- | 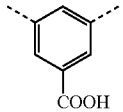 | sing. | sing. | sing. | sing. | sing. | sing. |
| 244 | 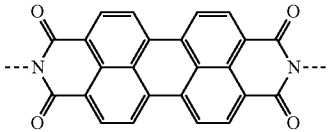 | 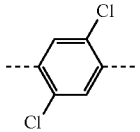 | 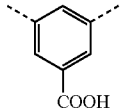 | sing. | sing. | sing. | sing. | sing. | sing. |
| 245 | 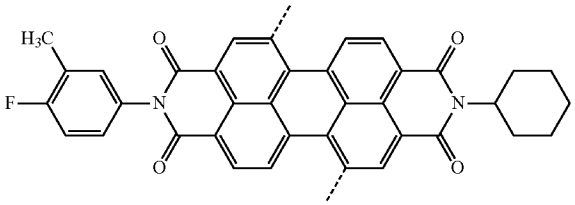 | 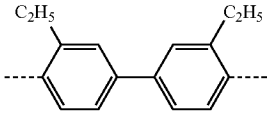 | 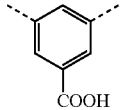 | sing. | sing. | sing. | sing. | sing. | sing. |

TABLE 5
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 301 | 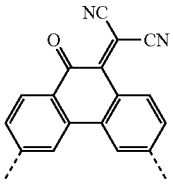 | 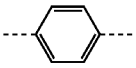 | 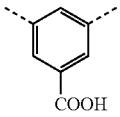 | sing. | sing. | sing. | sing. | sing. | sing. |
| 302 | 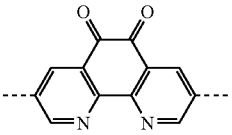 | 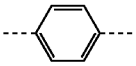 | 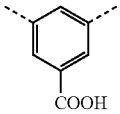 | sing. | sing. | sing. | sing. | sing. | sing. |
| 303 | 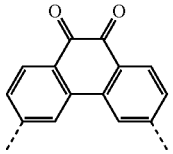 | 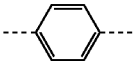 | 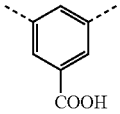 | sing. | sing. | sing. | sing. | sing. | sing. |
TABLE 6A
| | A | $E_1$ | $B_3$ |
|---|---|---|---|
| 304 | 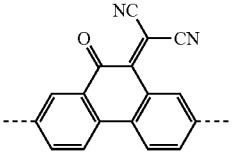 | 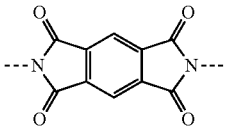 | 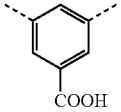 |
| 305 | 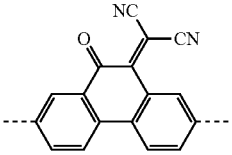 | 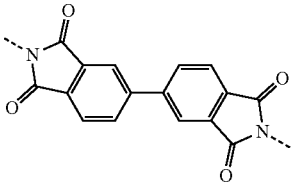 | 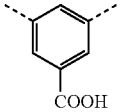 |
| 306 | 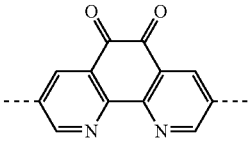 | 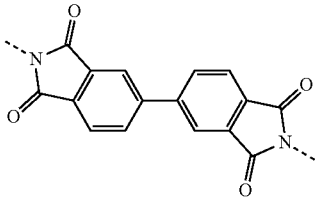 | 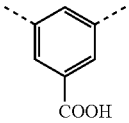 |
| | $E_4$ | $Z_1$ | $Z_2$ | $Z_5$ | $Z_6$ |
|---|---|---|---|---|---|
| 304 | 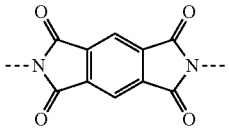 | sing. | sing. | sing. | sing. |
| 305 | 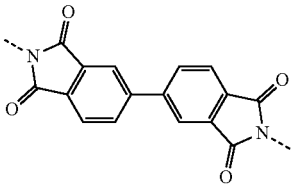 | sing. | sing. | sing. | sing. |

TABLE 6A-continued
| | | | | | |
|---|---|---|---|---|---|
| 306 | 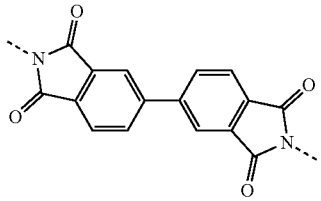 | 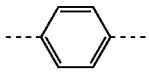 | 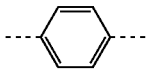 | sing. | sing. |
TABLE 6B
| | A | $B_1$ | $B_3$ | $B_4$ | $W_1$ |
|---|---|---|---|---|---|
| 307 | 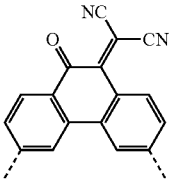 | 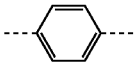 | 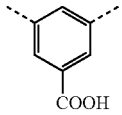 | 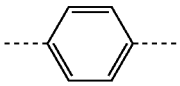 | sing. |
| 308 | 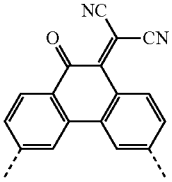 | 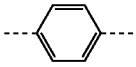 | 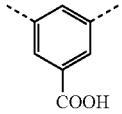 | 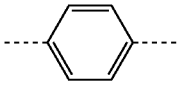 | 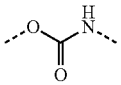 |
| 309 | 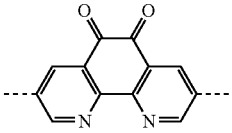 | 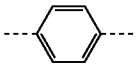 | 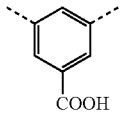 | 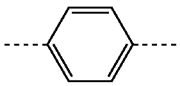 | 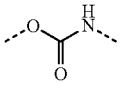 |
| 310 | 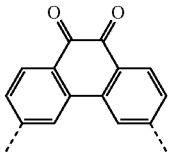 | 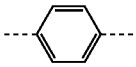 | 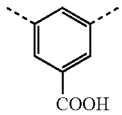 | 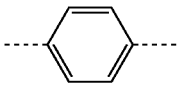 | 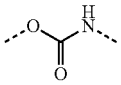 |
| 311 | 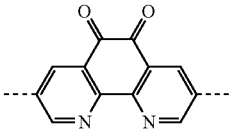 | 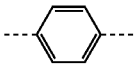 | 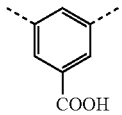 | 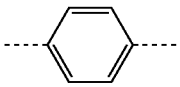 | 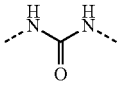 |
| 312 | 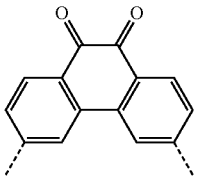 | 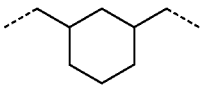 | 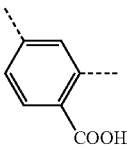 | 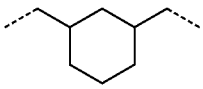 | 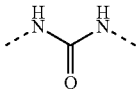 |
| 313 | 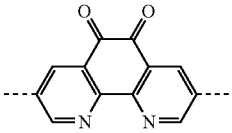 | $(CH_2)_6$ | 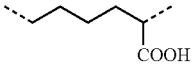 | $(CH_2)_6$ | 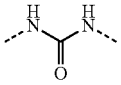 |

TABLE 6B-continued
| | $W_3$ | $Z_1$ | $Z_2$ | $Z_5$ | $Z_6$ |
|---|---|---|---|---|---|
| 307 | sing. | 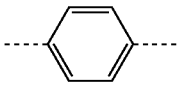 | 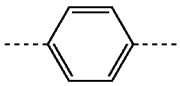 | sing. | sing. |
| 308 | 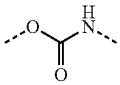 | 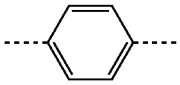 | 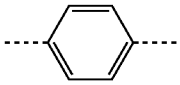 | sing. | sing. |
| 309 | 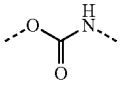 | 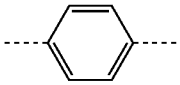 | 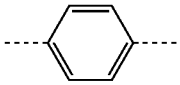 | sing. | sing. |
| 310 | 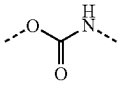 | 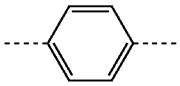 | 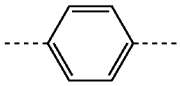 | sing. | sing. |
| 311 | 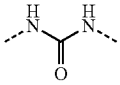 | 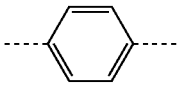 | 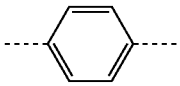 | sing. | sing. |
| 312 | 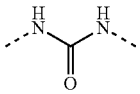 | 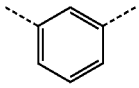 | 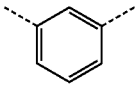 | sing. | sing. |
| 313 | 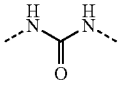 | $(CH_2)_6$ | 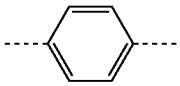 | $(CH_2)_6$ | 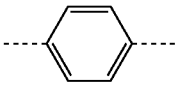 |
TABLE 6C
| | A | $E_1$ | $B_3$ |
|---|---|---|---|
| 314 | 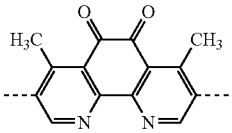 | 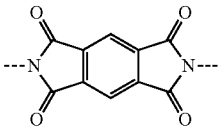 | 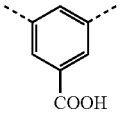 |
| 315 | 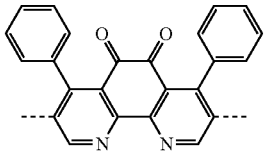 | 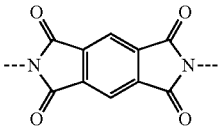 | 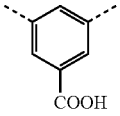 |
| 316 | 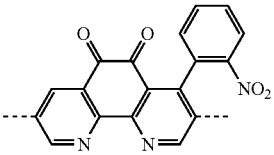 | 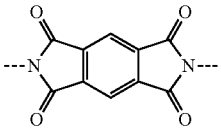 | 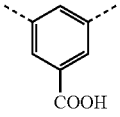 |
| 317 | 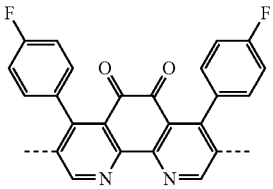 | 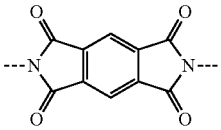 | 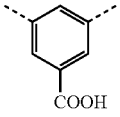 |

TABLE 6C-continued
| | | | |
|---|---|---|---|
| 318 | 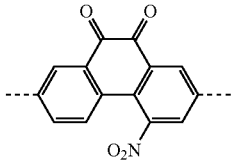 | 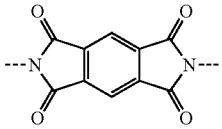 | 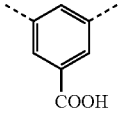 |
| 319 | 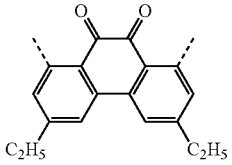 | 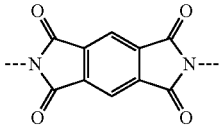 | 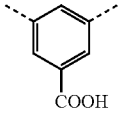 |
| 320 | 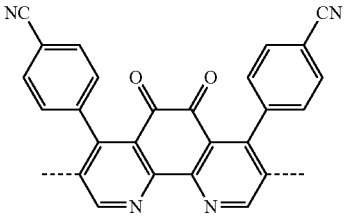 | 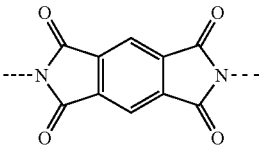 | 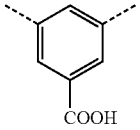 |
| 321 | 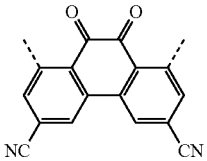 | 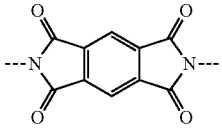 | 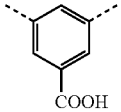 |
| | $E_4$ | $Z_1$ | $Z_2$ | $Z_5$ | $Z_6$ |
|---|---|---|---|---|---|
| 314 | 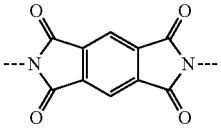 | sing. | sing. | sing. | sing. |
| 315 | 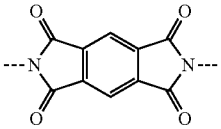 | sing. | sing. | sing. | sing. |

TABLE 6C-continued
| | | | | | |
|---|---|---|---|---|---|
| 316 | 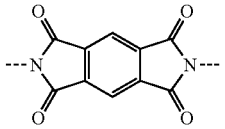 | sing. | sing. | sing. | sing. |
| 317 | 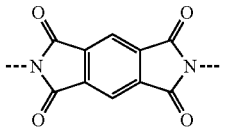 | sing. | sing. | sing. | sing. |
| 318 | 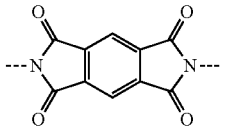 | sing. | sing. | sing. | sing. |
| 319 | 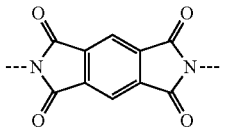 | sing. | sing. | sing. | sing. |
| 320 | 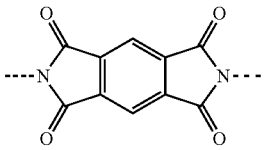 | sing. | sing. | sing. | sing. |
| 321 | 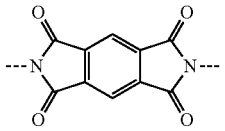 | sing. | sing. | sing. | sing. |

TABLE 6D
| | A | $B_1$ | $B_3$ | $B_4$ | $W_1$ | $W_3$ | $Z_1$ | $Z_2$ | $Z_5$ | $Z_6$ |
|---|---|---|---|---|---|---|---|---|---|---|
| 322 | 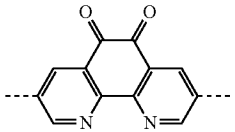 | 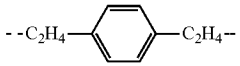 | 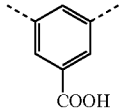 | 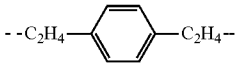 | 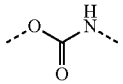 | 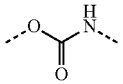 | 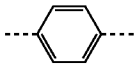 | 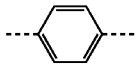 | sing. | sing. |
| 323 | 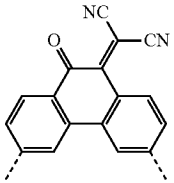 | 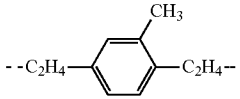 | 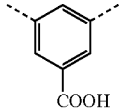 | 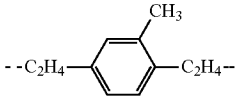 | 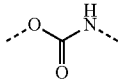 | 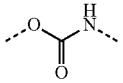 | 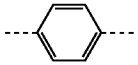 | 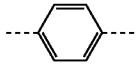 | sing. | sing. |
| 324 | 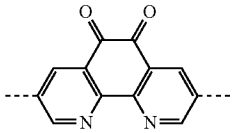 | 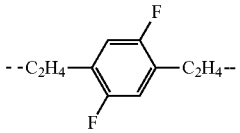 | 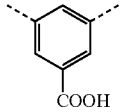 | 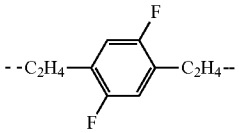 | 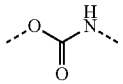 | 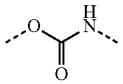 | 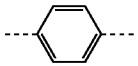 | 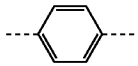 | sing. | sing. |
| 325 | 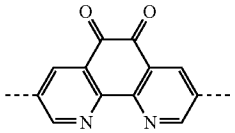 | 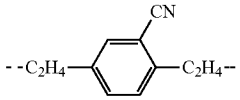 | 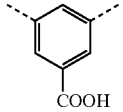 | 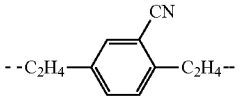 | 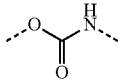 | 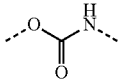 | 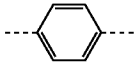 | 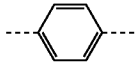 | sing. | sing. |
| 326 | 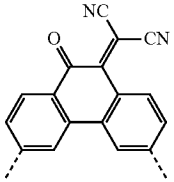 | 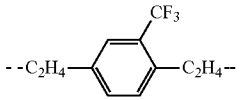 | 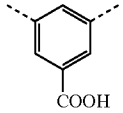 | 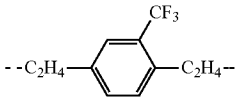 | 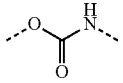 | 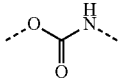 | 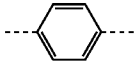 | 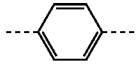 | sing. | sing. |
| 327 | 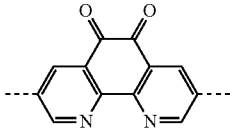 | 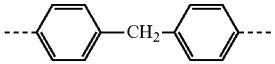 | 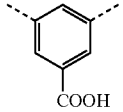 | 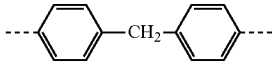 | 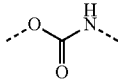 | 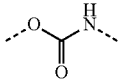 | 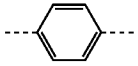 | 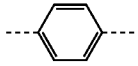 | sing. | sing. |

TABLE 6D-continued
| | A | $B_1$ | $B_3$ | $B_4$ | $W_1$ | $W_3$ | $Z_1$ | $Z_2$ | $Z_5$ | $Z_6$ |
|---|---|---|---|---|---|---|---|---|---|---|
| 328 | 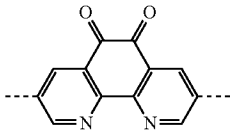 | 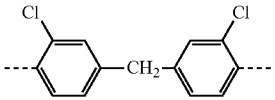 | 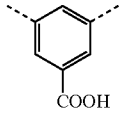 | 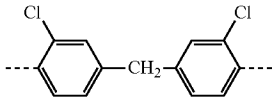 | 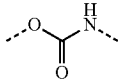 | 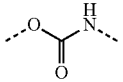 | 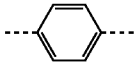 | 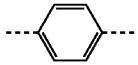 | sing. | sing. |
| 329 | 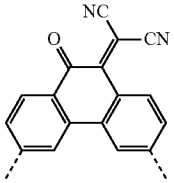 | 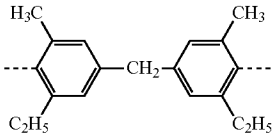 | 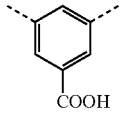 | 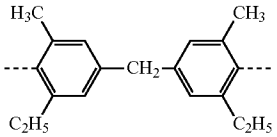 | 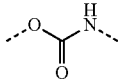 | 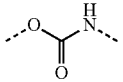 | 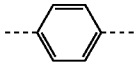 | 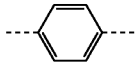 | sing. | sing. |
| 340 | 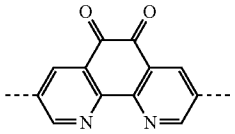 | 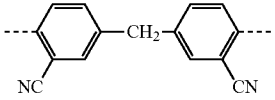 | 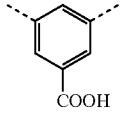 | 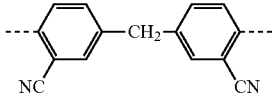 | 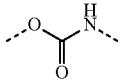 | 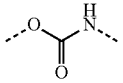 | 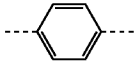 | 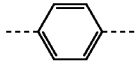 | sing. | sing. |
| 341 | 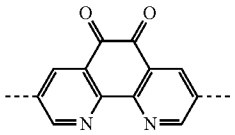 | 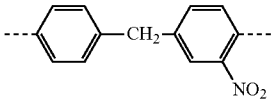 | 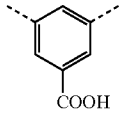 | 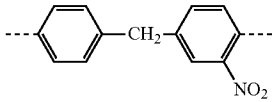 | 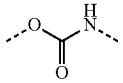 | 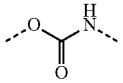 | 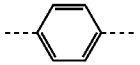 | 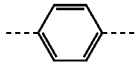 | sing. | sing. |
| 342 | 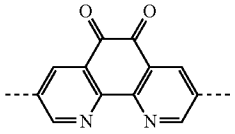 | 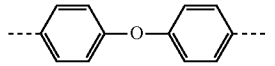 | 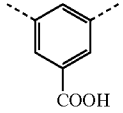 | 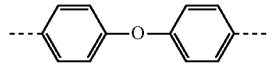 | 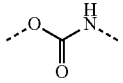 | 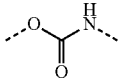 | 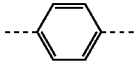 | 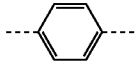 | sing. | sing. |
| 343 | 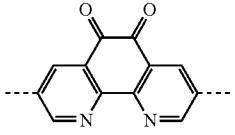 | 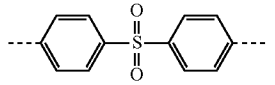 | 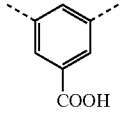 | 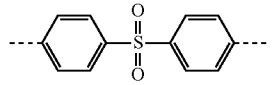 | 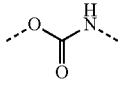 | 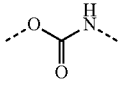 | 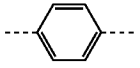 | 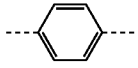 | sing. | sing. |

TABLE 6D-continued
| | A | $B_1$ | $B_3$ | $B_4$ | $W_1$ | $W_3$ | $Z_1$ | $Z_2$ | $Z_5$ | $Z_6$ |
|---|---|---|---|---|---|---|---|---|---|---|
| 345 | 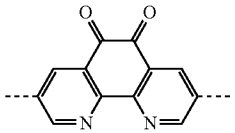 | 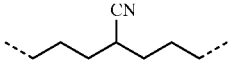 | 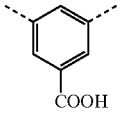 | 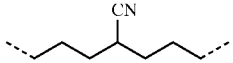 | 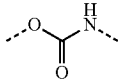 | 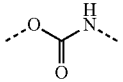 | 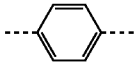 | 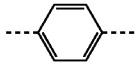 | sing. | sing. |
| 346 | 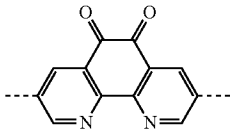 | 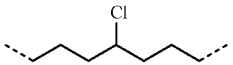 | 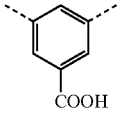 | 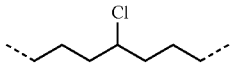 | 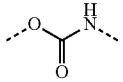 | 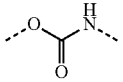 | 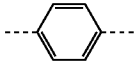 | 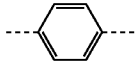 | sing. | sing. |
| 347 | 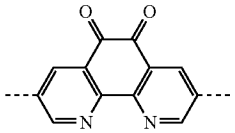 | 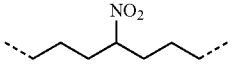 | 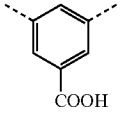 | 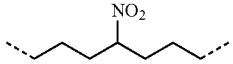 | 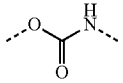 | 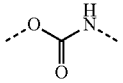 | 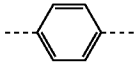 | 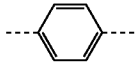 | sing. | sing. |
| 348 | 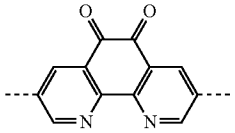 | 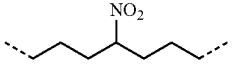 | 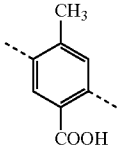 | 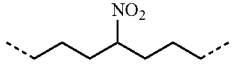 | 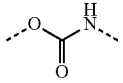 | 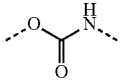 | 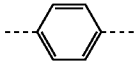 | 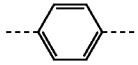 | sing. | sing. |
| 349 | 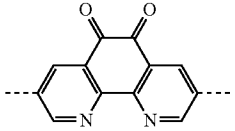 | 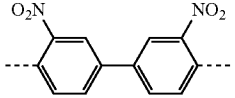 | 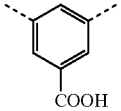 | 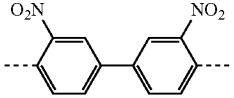 | 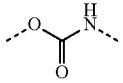 | 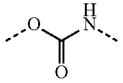 | 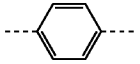 | 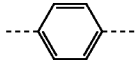 | sing. | sing. |
| 350 | 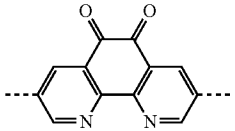 | 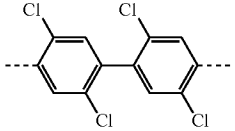 | 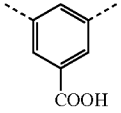 | 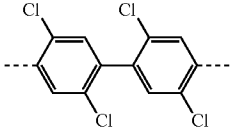 | 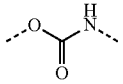 | 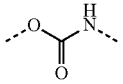 | 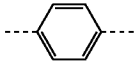 | 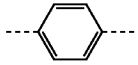 | sing. | sing. |
| 351 | 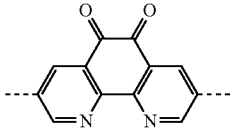 | 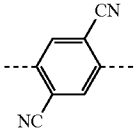 | 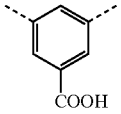 | 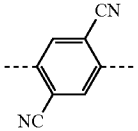 | 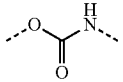 | 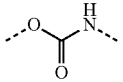 | 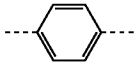 | 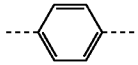 | sing. | sing. |

TABLE 6D-continued
| | A | $B_1$ | $B_3$ | $B_4$ | $W_1$ | $W_3$ | $Z_1$ | $Z_2$ | $Z_5$ | $Z_6$ |
|---|---|---|---|---|---|---|---|---|---|---|
| 352 | 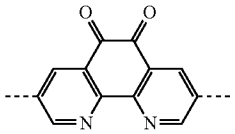 | 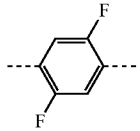 | 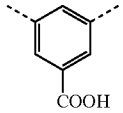 | 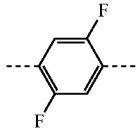 | 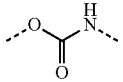 | 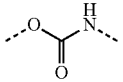 | 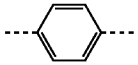 | 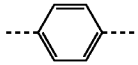 | sing. | sing. |
| 353 | 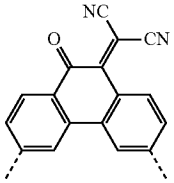 | 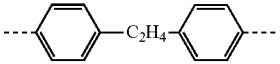 | 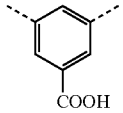 | 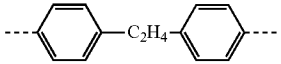 | 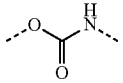 | 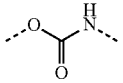 | 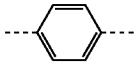 | 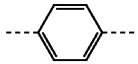 | sing. | sing. |
| 354 | 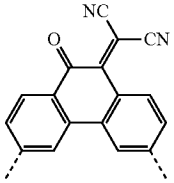 | 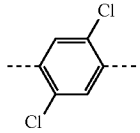 | 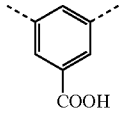 | 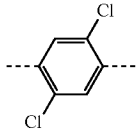 | 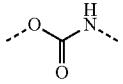 | 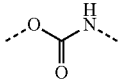 | 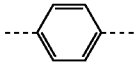 | 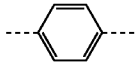 | sing. | sing. |
| 355 | 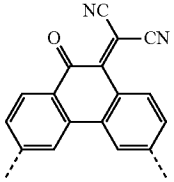 | -----$(CH_2)_2$---- | 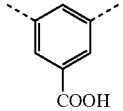 | -----$(CH_2)_2$---- | 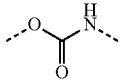 | 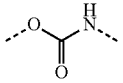 | 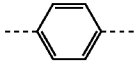 | 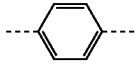 | sing. | sing. |

TABLE 6D-continued
| | A | $B_1$ | $B_3$ | $B_4$ | $W_1$ | $W_3$ | $Z_1$ | $Z_2$ | $Z_5$ | $Z_6$ |
|---|---|---|---|---|---|---|---|---|---|---|
| 356 | 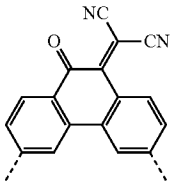 | -----$(CH_2)_{16}$--- | 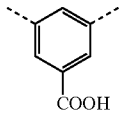 | -----$(CH_2)_{16}$--- | 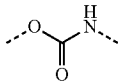 | 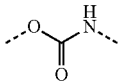 | 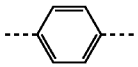 | 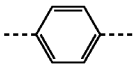 | sing. | sing. |
| 357 | 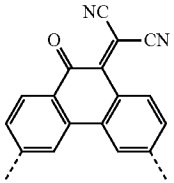 | 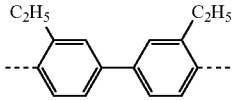 | 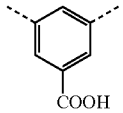 | 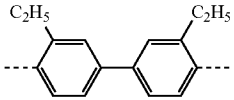 | 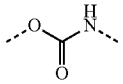 | 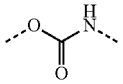 | 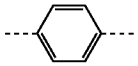 | 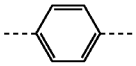 | sing. | sing. |

TABLE 7
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 401 | 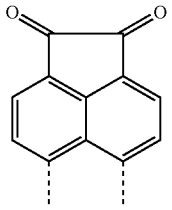 | 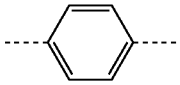 | 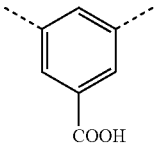 | sing. | sing. | sing. | sing. | sing. | sing. |
| 402 | 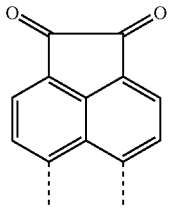 | 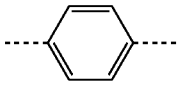 | 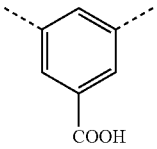 | sing. | sing. | sing. | sing. | sing. | sing. |
| 403 | 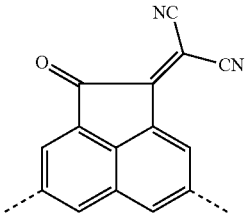 | 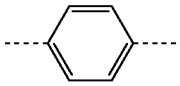 | 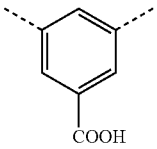 | sing. | sing. | sing. | sing. | sing. | sing. |
| 404 | 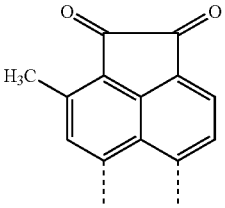 | 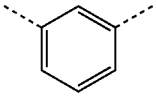 | 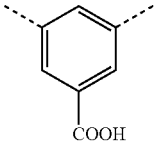 | sing. | sing. | sing. | sing. | sing. | sing. |
TABLE 8A
| | A | $E_1$ | $B_3$ | $E_4$ |
|---|---|---|---|---|
| 405 | 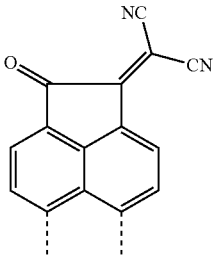 | 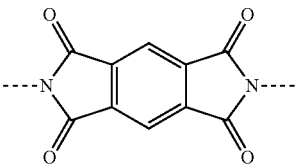 | 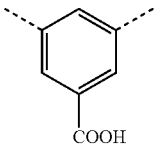 | 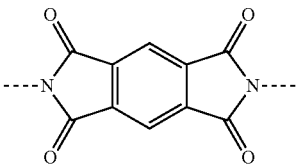 |
| | | $Z_1$ | $Z_2$ | $Z_5$ | $Z_6$ |
|---|---|---|---|---|---|
| | 405 | 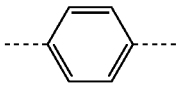 | 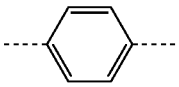 | sing. | sing. |

TABLE 8B
| | A | $B_1$ | $B_3$ | $B_4$ | $W_1$ |
|---|---|---|---|---|---|
| 406 | 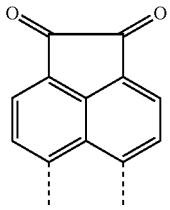 | 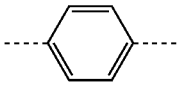 | 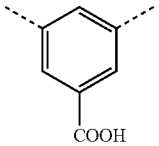 | 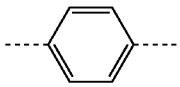 | sing. |
| 407 | 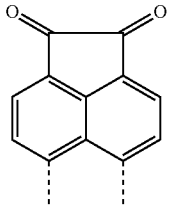 | 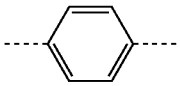 | 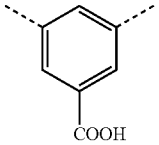 | 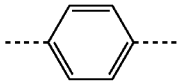 | 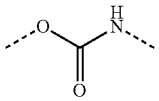 |
| 408 | 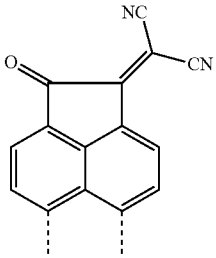 | 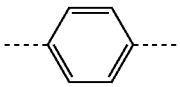 | 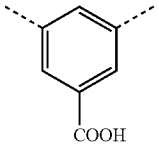 | 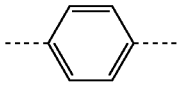 | 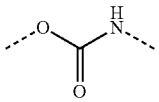 |
| 409 | 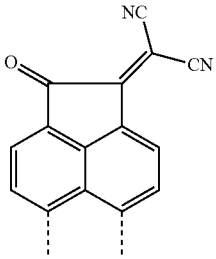 | 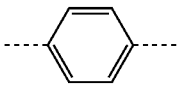 | 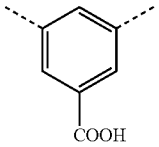 | 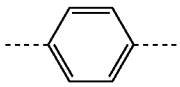 | 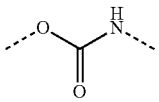 |
| 410 | 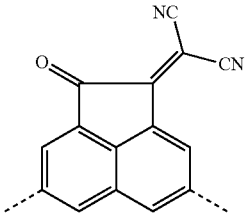 | 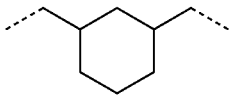 | 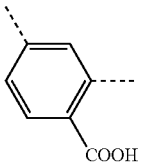 | 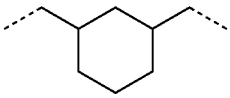 | 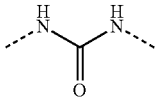 |
| | $W_3$ | $Z_1$ | $Z_2$ | $Z_5$ | $Z_6$ |
|---|---|---|---|---|---|
| 406 | sing. | 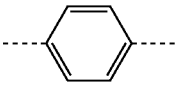 | 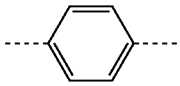 | sing. | sing. |
| 407 | 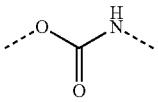 | 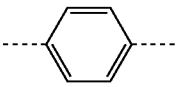 | 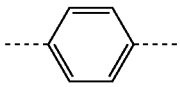 | sing. | sing. |
| 408 | 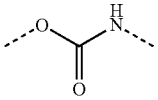 | 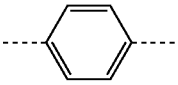 | 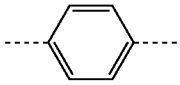 | sing. | sing. |

TABLE 8B-continued
| | | | | | |
|---|---|---|---|---|---|
| 409 | 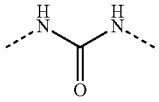 | 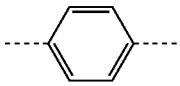 | 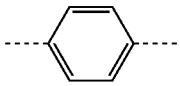 | sing. | sing. |
| 410 | 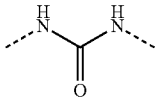 | 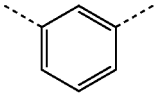 | 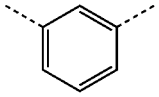 | sing. | sing. |
TABLE 8C
| | A | $E_1$ | $B_3$ | $E_4$ |
|---|---|---|---|---|
| 411 | 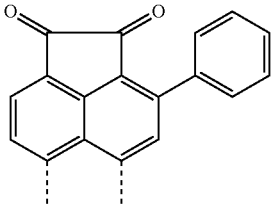 | 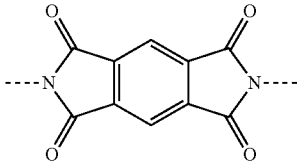 | 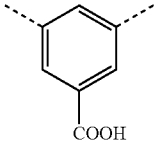 | 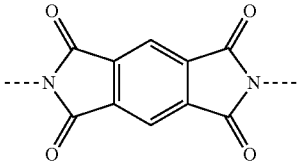 |
| 412 | 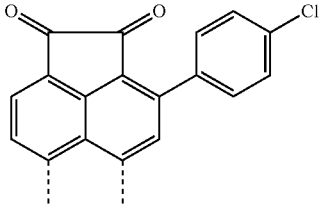 | 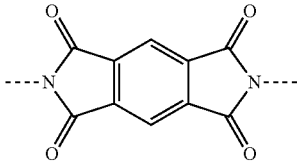 | 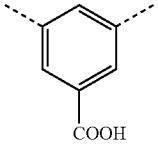 | 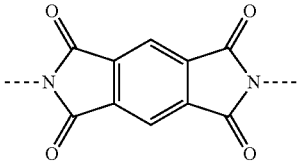 |
| 413 | 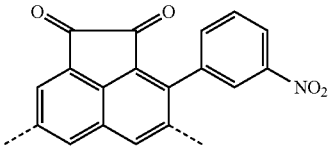 | 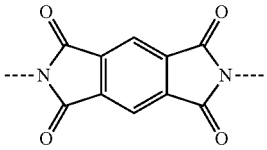 | 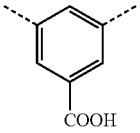 | 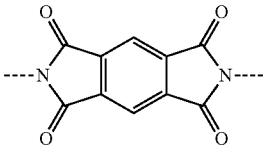 |
| | $Z_1$ | $Z_2$ | $Z_5$ | $Z_6$ |
|---|---|---|---|---|
| 411 | 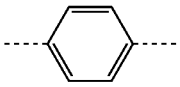 | 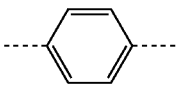 | sing. | sing. |
| 412 | 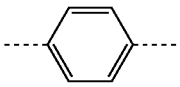 | 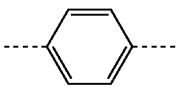 | sing. | sing. |
| 413 | 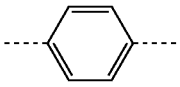 | 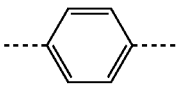 | sing. | sing. |

TABLE 8D
| | A | $B_1$ | $B_3$ | $B_4$ |
|---|---|---|---|---|
| 414 | 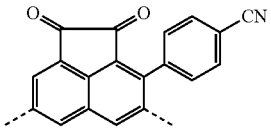 | 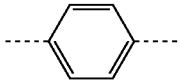 | 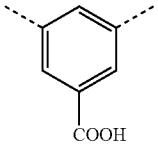 | 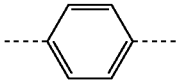 |
| 415 | 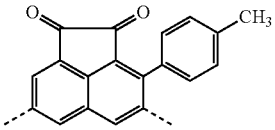 | 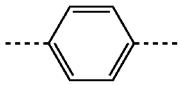 | 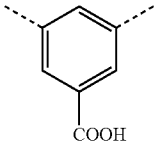 | 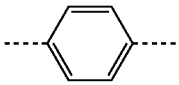 |
| 416 | 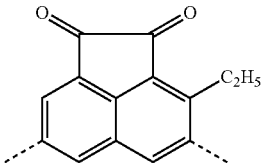 | 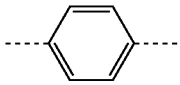 | 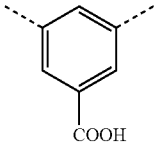 | 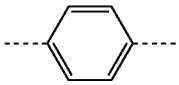 |
| 417 | 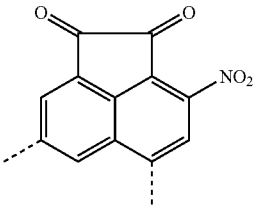 | 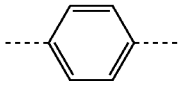 | 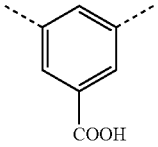 | 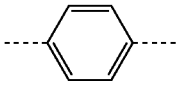 |
| 418 | 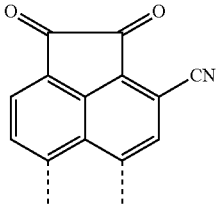 | 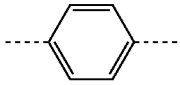 | 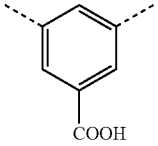 | 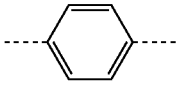 |
| 419 | 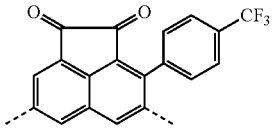 | 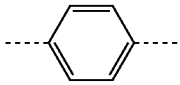 | 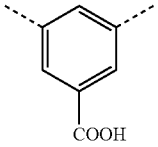 | 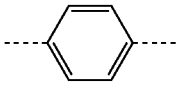 |
| 420 | 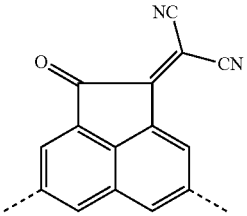 | 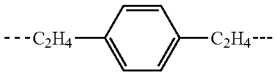 | 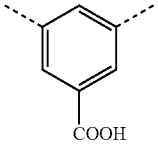 | 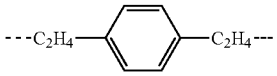 |
| 421 | 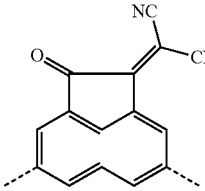 | 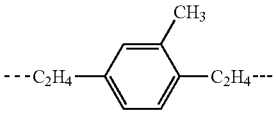 | 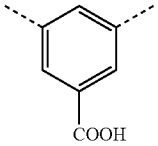 | 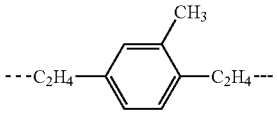 |

TABLE 8D-continued
| | | | | |
|---|---|---|---|---|
| 422 | 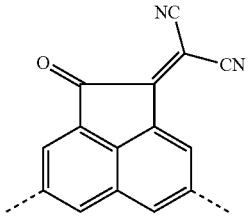 | 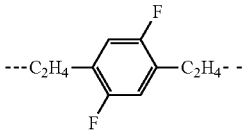 | 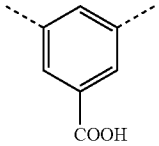 | 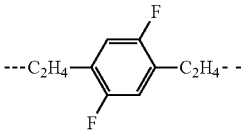 |
| 423 | 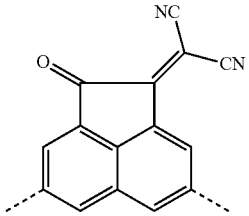 | 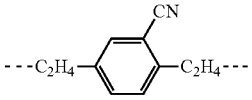 | 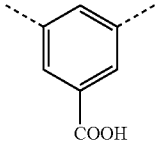 | 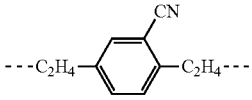 |
| 424 | 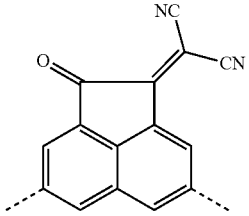 | 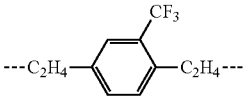 | 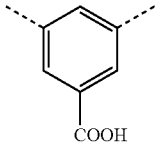 | 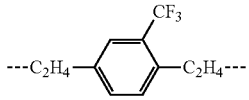 |
| 425 | 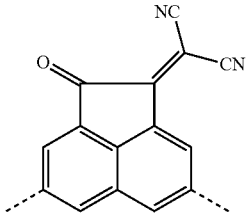 | 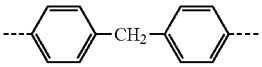 | 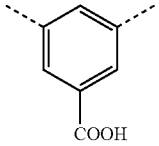 | 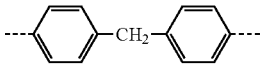 |
| 426 | 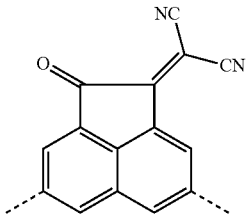 | 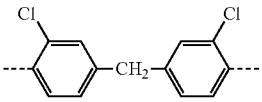 | 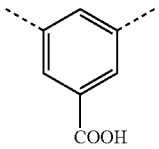 | 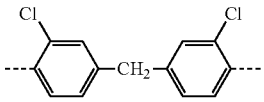 |
| 427 | 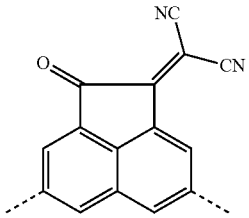 | 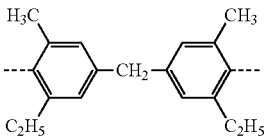 | 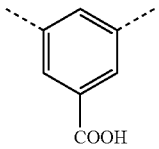 | 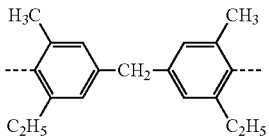 |
| 428 | 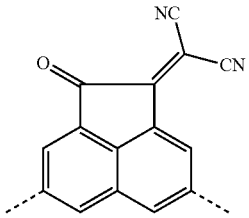 | 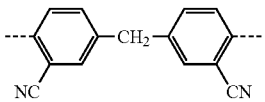 | 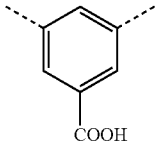 | 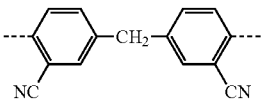 |

TABLE 8D-continued
| | | | | |
|---|---|---|---|---|
| 429 | 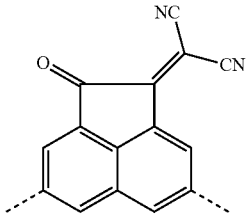 | 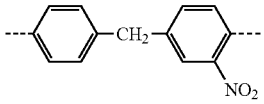 | 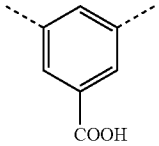 | 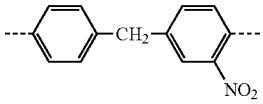 |
| 430 | 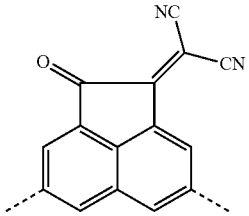 | 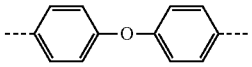 | 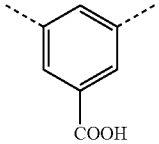 | 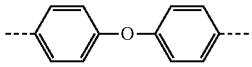 |
| 431 | 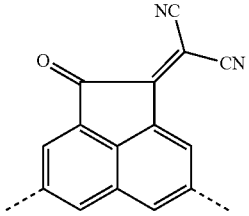 | 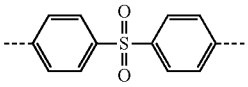 | 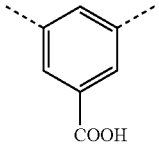 | 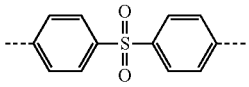 |
| 432 | 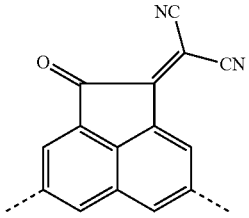 | ----$C_2H_4$—O—$C_2H_4$---- | 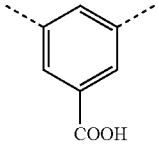 | ----$C_2H_4$—O—$C_2H_4$---- |
| 433 | 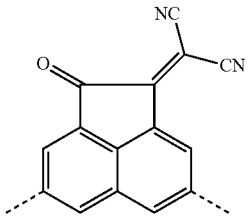 | 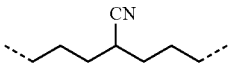 | 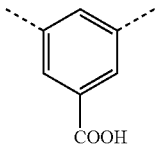 | 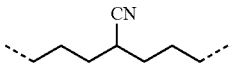 |
| 434 | 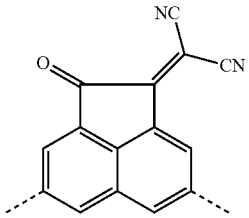 | 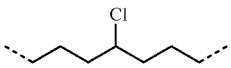 | 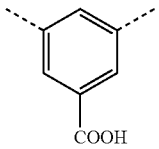 | 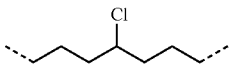 |
| 435 | 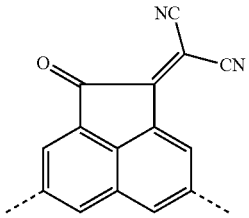 | 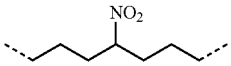 | 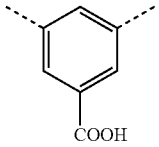 | 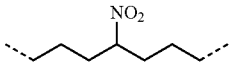 |

TABLE 8D-continued
| | | | | |
|---|---|---|---|---|
| 436 | 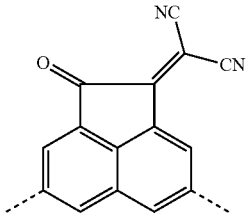 | 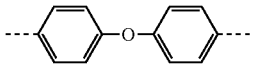 | 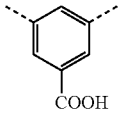 | 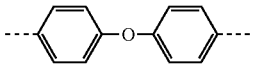 |
| 437 | 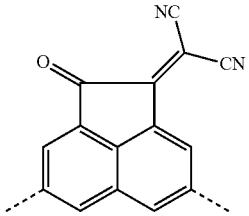 | 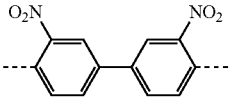 | 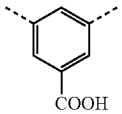 | 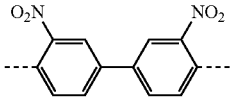 |
| 438 | 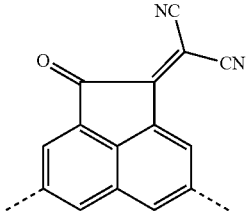 | 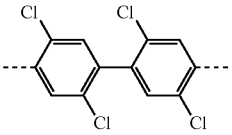 | 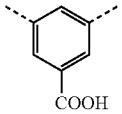 | 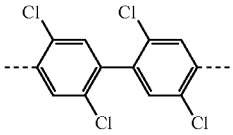 |
| 439 | 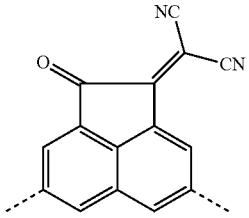 | 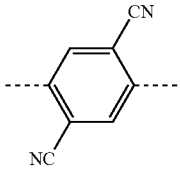 | 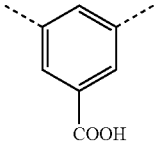 | 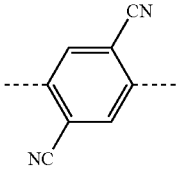 |
| 440 | 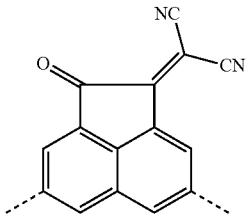 | 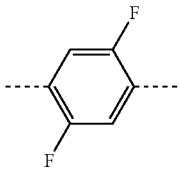 | 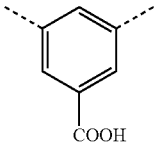 | 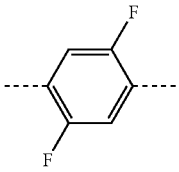 |
| 441 | 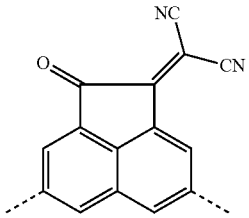 | 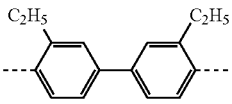 | 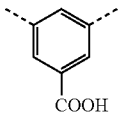 | 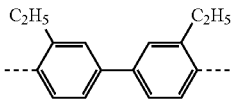 |
| 442 | 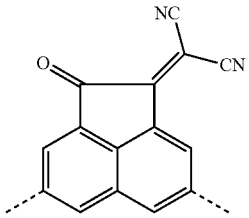 | ----$(CH_2)_{16}$---- | 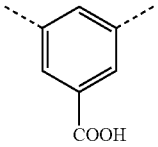 | ----$(CH_2)_{16}$---- |

TABLE 8D-continued
| | | | | | | |
|---|---|---|---|---|---|---|
| 443 | 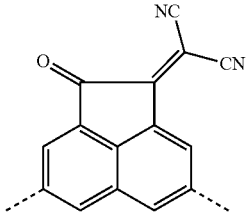 | ----$(CH_2)_2$---- | 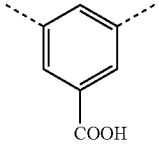 | ----$(CH_2)_2$---- | | |
| 444 | 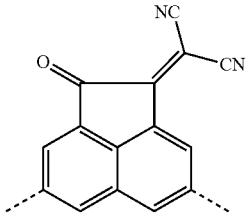 | 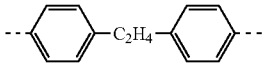 | 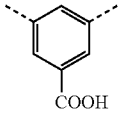 | 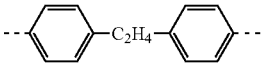 | | |
| | $W_1$ | $W_3$ | $Z_1$ | $Z_2$ | $Z_5$ | $Z_6$ |
| 414 | 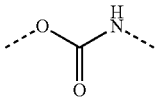 | 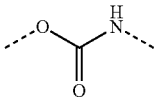 | 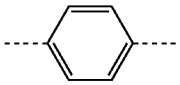 | 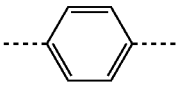 | sing. | sing. |
| 415 | 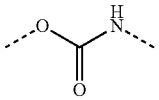 | 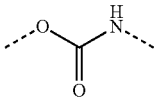 | 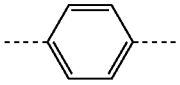 | 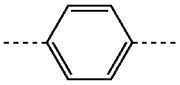 | sing. | sing. |
| 416 | 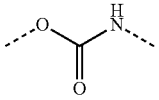 | 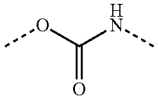 | 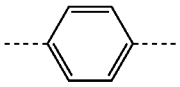 | 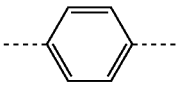 | sing. | sing. |
| 417 | 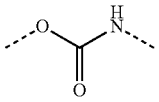 | 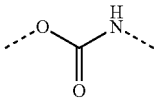 | 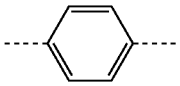 | 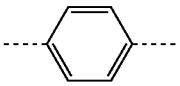 | sing. | sing. |
| 418 | 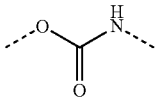 | 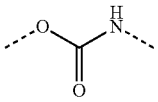 | 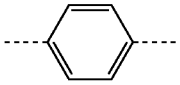 | 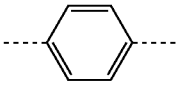 | sing. | sing. |
| 419 | 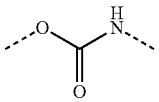 | 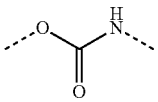 | 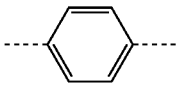 | 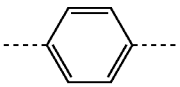 | sing. | sing. |
| 420 | 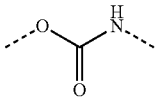 | 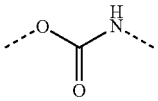 | 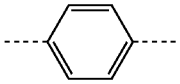 | 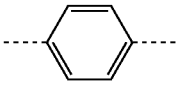 | sing. | sing. |
| 421 | 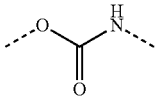 | 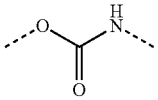 | 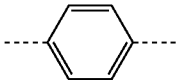 | 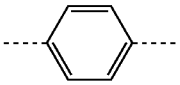 | sing. | sing. |
| 422 | 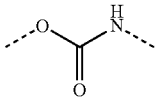 | 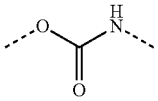 | 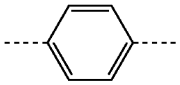 | 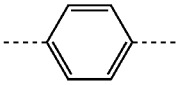 | sing. | sing. |
| 423 | 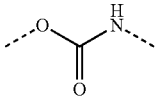 | 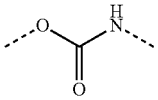 | 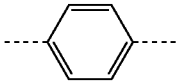 | 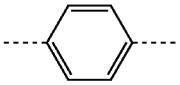 | sing. | sing. |

TABLE 8D-continued
| | | | | | | |
|---|---|---|---|---|---|---|
| 424 | 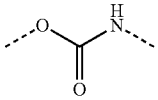 | 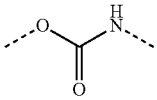 | 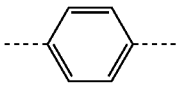 | 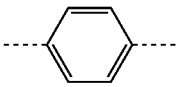 | sing. | sing. |
| 425 | 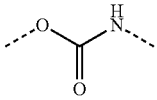 | 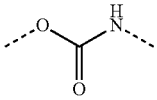 | 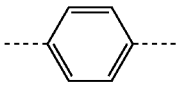 | 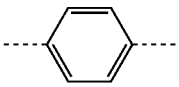 | sing. | sing. |
| 426 | 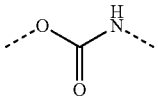 | 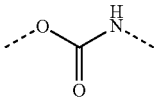 | 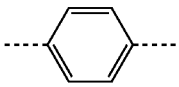 | 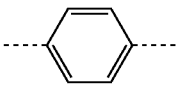 | sing. | sing. |
| 427 | 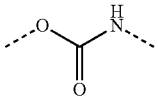 | 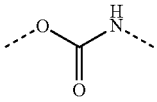 | 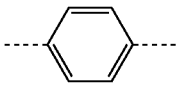 | 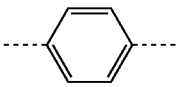 | sing. | sing. |
| 428 | 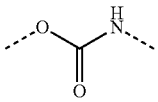 | 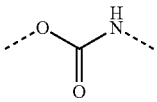 | 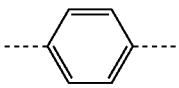 | 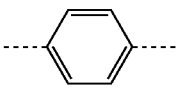 | sing. | sing. |
| 429 | 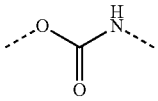 | 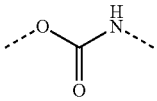 | 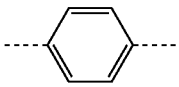 | 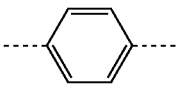 | sing. | sing. |
| 430 | 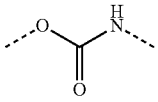 | 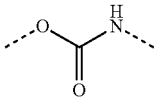 | 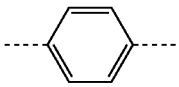 | 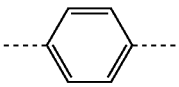 | sing. | sing. |
| 431 | 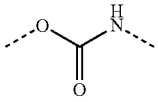 | 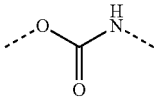 | 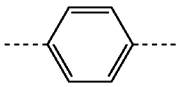 | 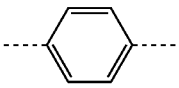 | sing. | sing. |
| 432 | 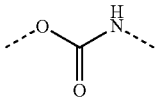 | 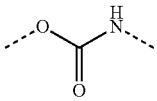 | 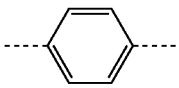 | 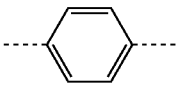 | sing. | sing. |
| 433 | 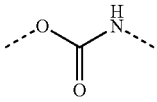 | 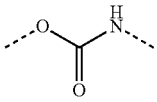 | 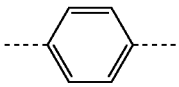 | 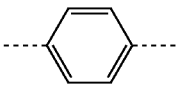 | sing. | sing. |
| 434 | 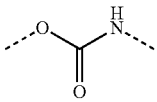 | 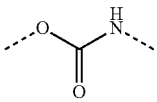 | 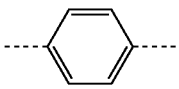 | 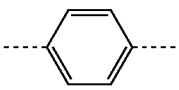 | sing. | sing. |
| 435 | 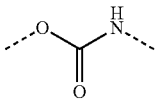 | 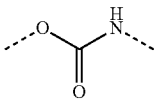 | 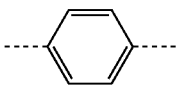 | 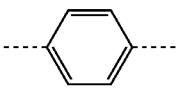 | sing. | sing. |
| 436 | 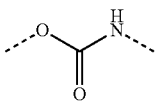 | 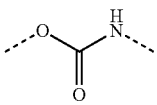 | 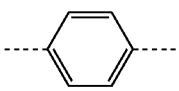 | 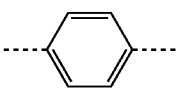 | sing. | sing. |
| 437 | 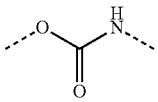 | 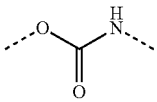 | 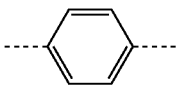 | 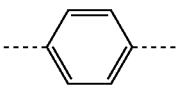 | sing. | sing. |

TABLE 8D-continued
| | | | | | | |
|---|---|---|---|---|---|---|
| 438 | 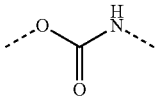 | 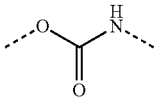 | 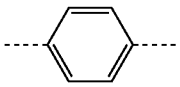 | 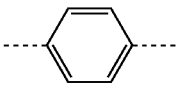 | sing. | sing. |
| 439 | 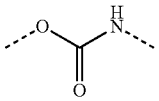 | 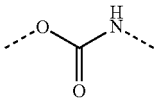 | 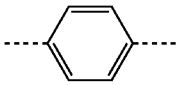 | 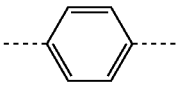 | sing. | sing. |
| 440 | 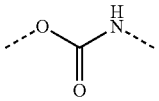 | 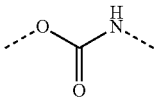 | 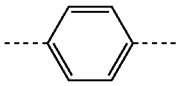 | 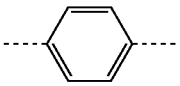 | sing. | sing. |
| 441 | 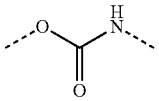 | 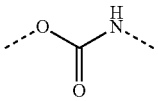 | 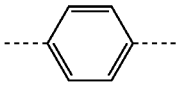 | 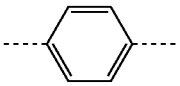 | sing. | sing. |
| 442 | 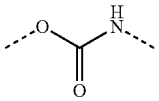 | 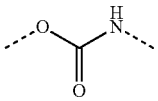 | 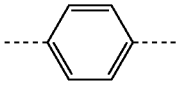 | 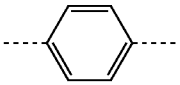 | sing. | sing. |
| 443 | 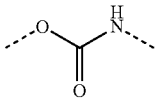 | 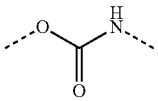 | 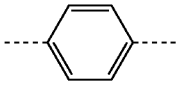 | 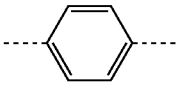 | sing. | sing. |
| 444 | 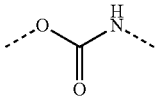 | 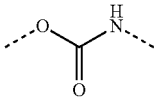 | 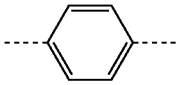 | 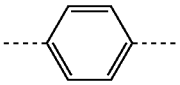 | sing. | sing. |
TABLE 9
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 501 | 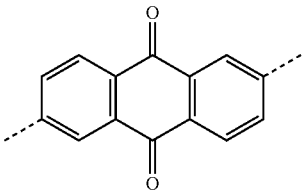 | 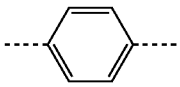 | 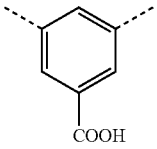 | sing. | sing. | sing. | sing. | sing. | sing. |
| 502 | 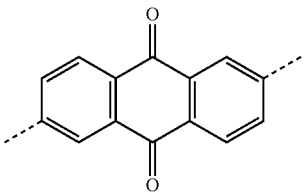 | 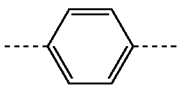 | 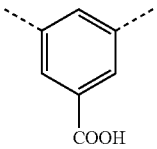 | sing. | sing. | sing. | sing. | sing. | sing. |
| 503 | 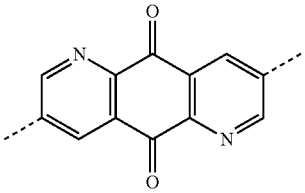 | 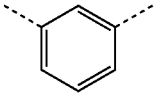 | 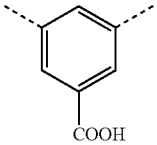 | sing. | sing. | sing. | sing. | sing. | sing. |

TABLE 9-continued
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 504 | 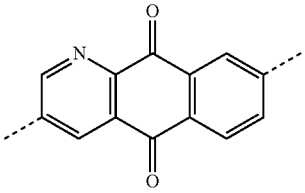 | 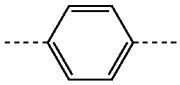 | 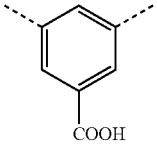 | sing. | sing. | sing. | sing. | sing. | sing. |
TABLE 10A
| | A | $E_1$ | $B_3$ | $E_4$ | $Z_1$ | $Z_2$ | $Z_5$ | $Z_6$ |
|---|---|---|---|---|---|---|---|---|
| 505 | 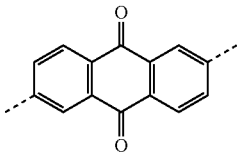 | 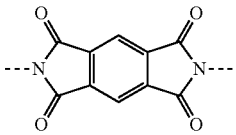 | 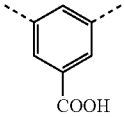 | 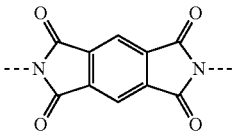 | sing. | sing. | sing. | sing. |
| 506 | 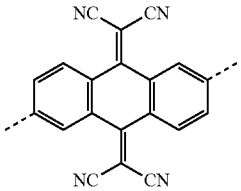 | 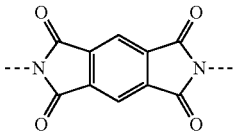 | 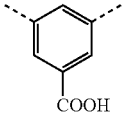 | 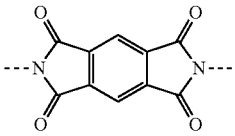 | sing. | sing. | sing. | sing. |
| 507 | 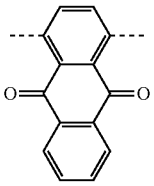 | 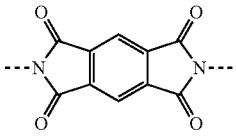 | 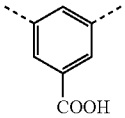 | 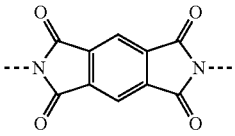 | sing. | sing. | sing. | sing. |
TABLE 10B
| | A | $B_1$ | $B_3$ | $B_4$ | $W_1$ |
|---|---|---|---|---|---|
| 508 | 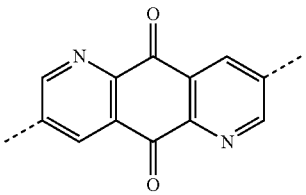 | 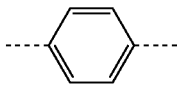 | 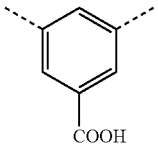 | 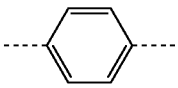 | sing. |
| 509 | 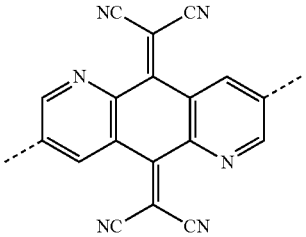 | 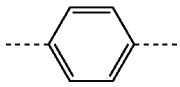 | 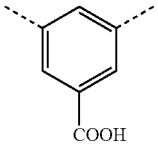 | 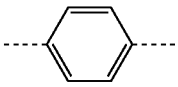 | 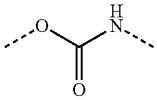 |

TABLE 10B-continued
| | | | | | |
|---|---|---|---|---|---|
| 510 | 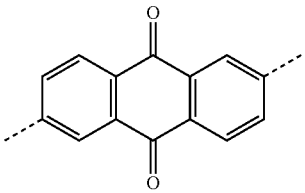 | 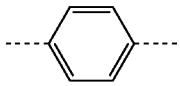 | 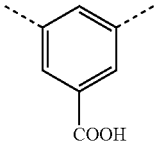 | 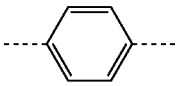 | 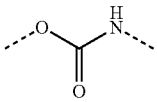 |
| 511 | 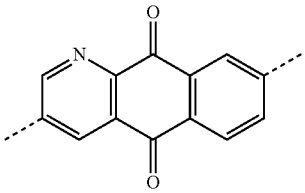 | 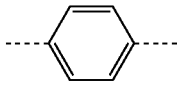 | 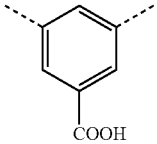 | 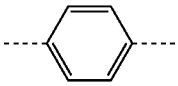 | 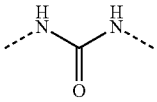 |
| 512 | 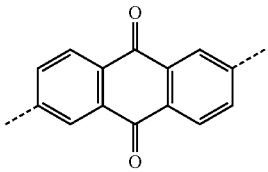 | 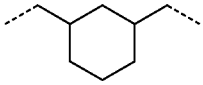 | 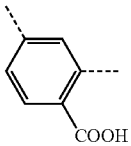 | 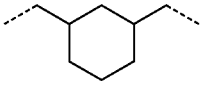 | 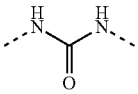 |
| | $W_3$ | $Z_1$ | $Z_2$ | $Z_5$ | $Z_6$ |
|---|---|---|---|---|---|
| 508 | sing. | 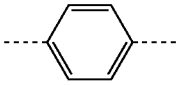 | 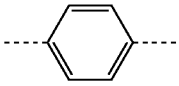 | sing. | sing. |
| 509 | 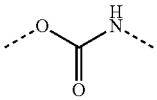 | 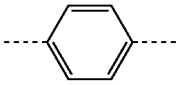 | 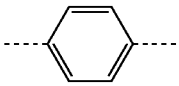 | sing. | sing. |
| 510 | 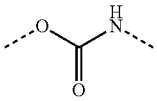 | 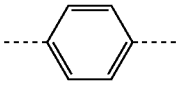 | 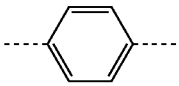 | sing. | sing. |
| 511 | 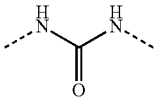 | 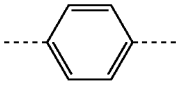 | 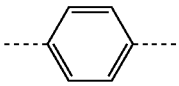 | sing. | sing. |
| 512 | 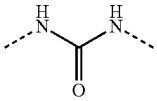 | 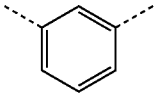 | 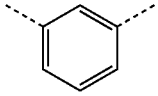 | sing. | sing. |
TABLE 10C
| | A | $B_1$ | $B_3$ |
|---|---|---|---|
| 513 | 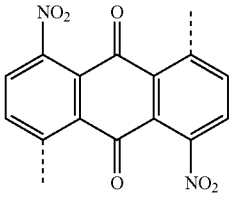 | 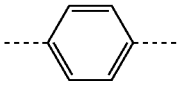 | 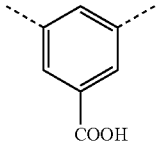 |

TABLE 10C-continued
| | | | |
|---|---|---|---|
| 514 | 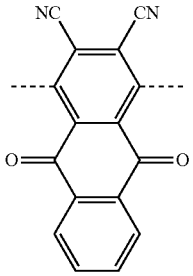 | 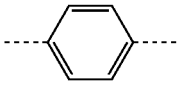 | 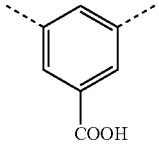 |
| 515 | 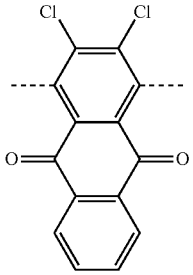 | 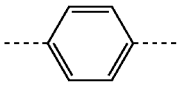 | 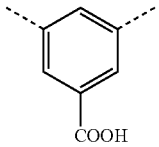 |
| 516 | 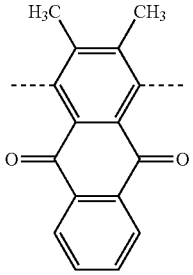 | 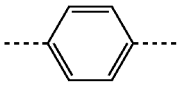 | 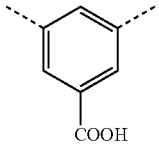 |
| 517 | 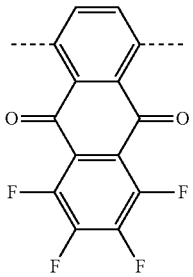 | 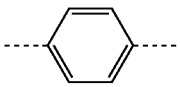 | 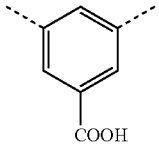 |
| 518 | 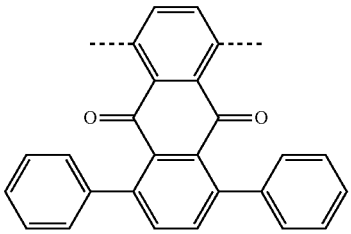 | 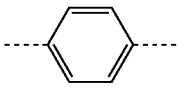 | 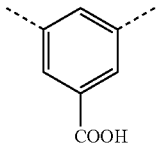 |
| 519 | 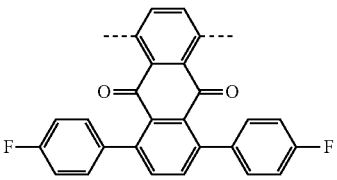 | 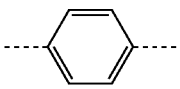 | 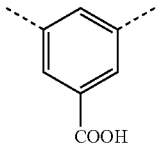 |

TABLE 10C-continued
| | | | |
|---|---|---|---|
| 520 | 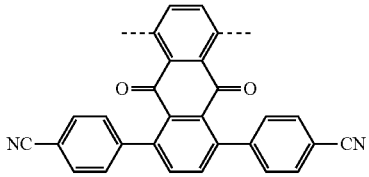 | 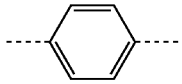 | 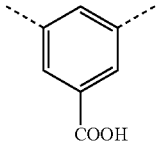 |
| 521 | 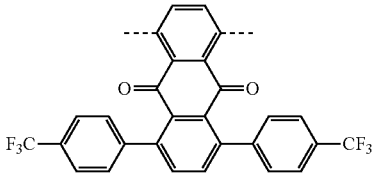 | 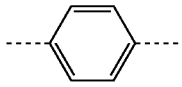 | 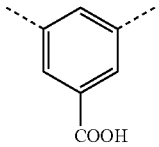 |
| 522 | 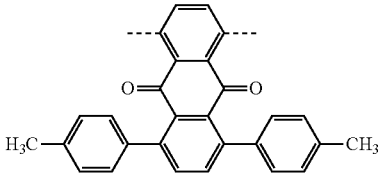 | 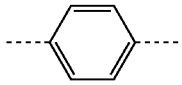 | 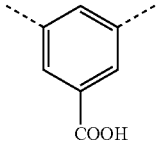 |
| 523 | 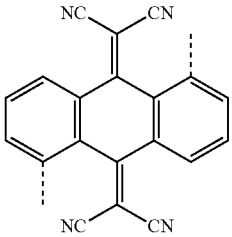 | 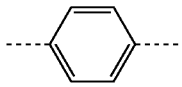 | 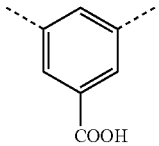 |
| 524 | 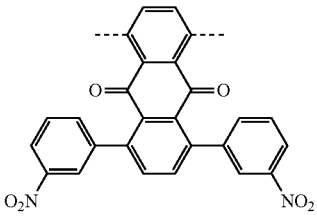 | 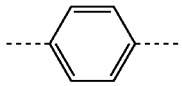 | 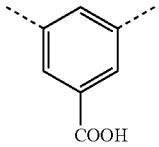 |
| 525 | 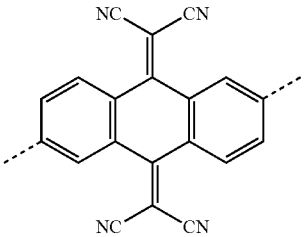 | 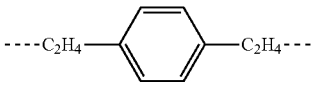 | 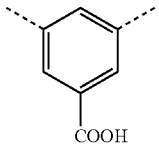 |
| 526 | 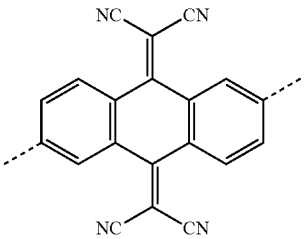 | 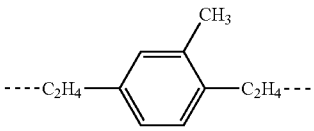 | 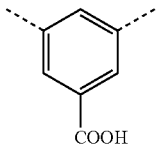 |

TABLE 10C-continued
| | | | |
|---|---|---|---|
| 527 | 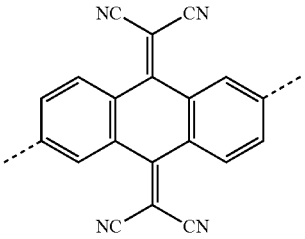 | 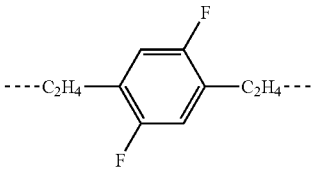 | 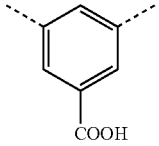 |
| 528 | 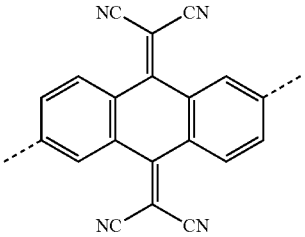 | 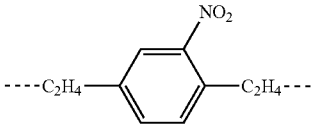 | 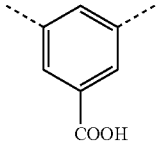 |
| 529 | 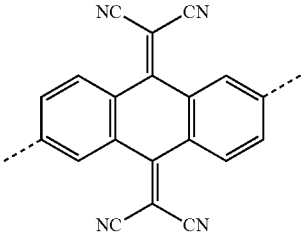 | 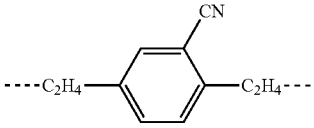 | 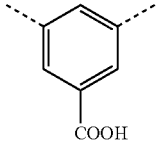 |
| 530 | 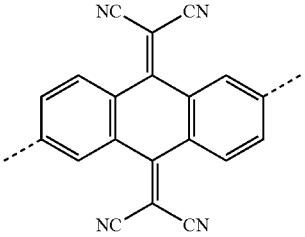 | 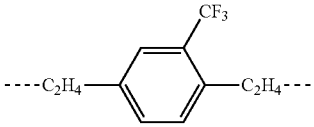 | 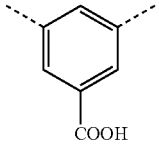 |
| 531 | 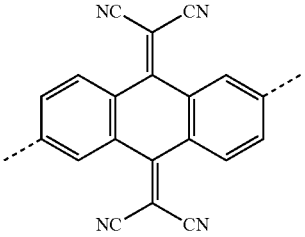 | 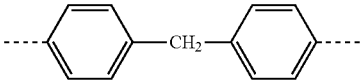 | 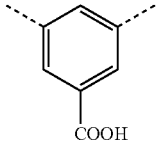 |
| 532 | 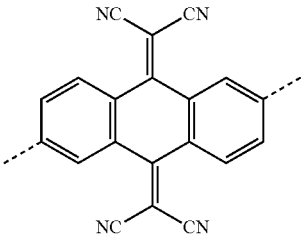 | 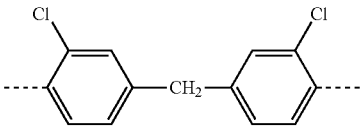 | 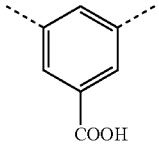 |

TABLE 10C-continued
| | | | |
|---|---|---|---|
| 533 | 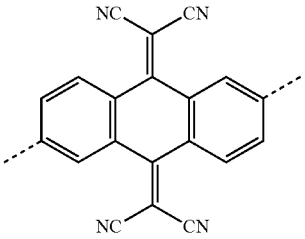 | 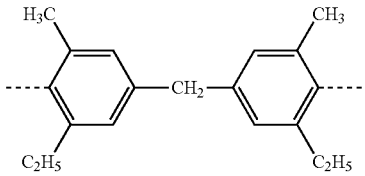 | 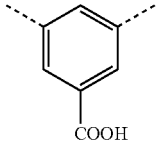 |
| 534 | 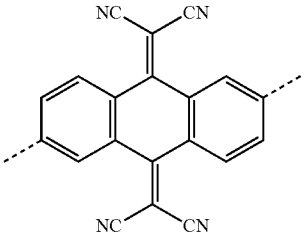 | 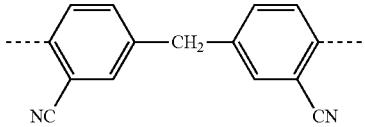 | 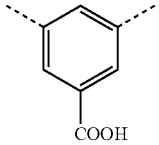 |
| 535 | 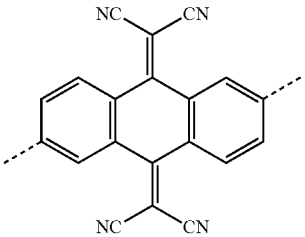 | 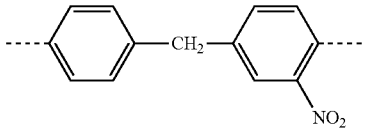 | 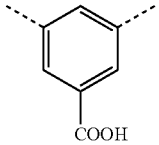 |
| 536 | 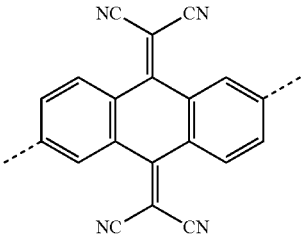 | 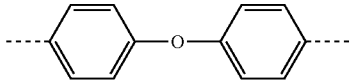 | 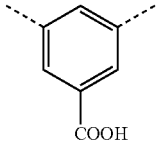 |
| 537 | 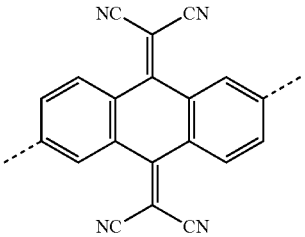 | 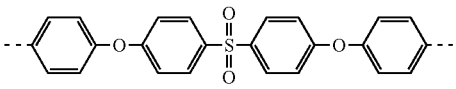 | 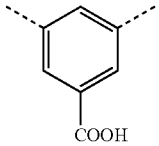 |
| 538 | 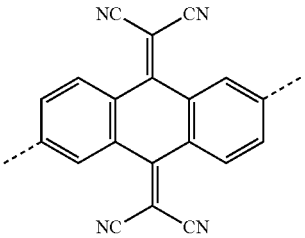 | ----$C_2H_4$—O—$C_2H_4$---- | 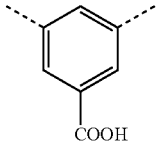 |

TABLE 10C-continued
| | | | |
|---|---|---|---|
| 539 | 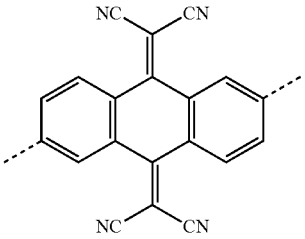 | 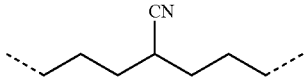 | 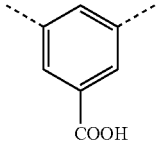 |
| 540 | 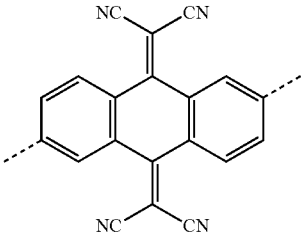 | 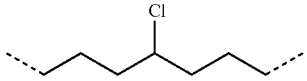 | 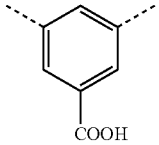 |
| 541 | 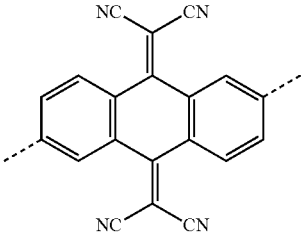 | 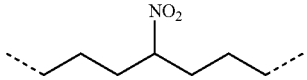 | 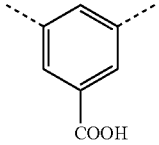 |
| 542 | 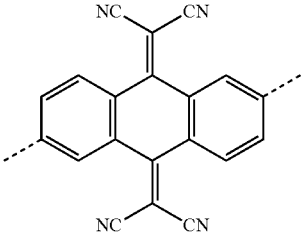 | 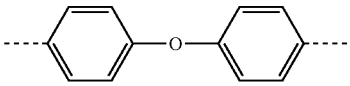 | 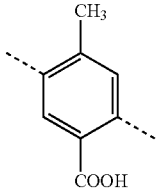 |
| 543 | 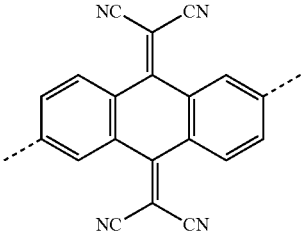 | 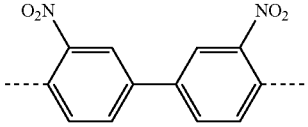 | 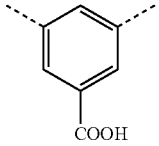 |
| 544 | 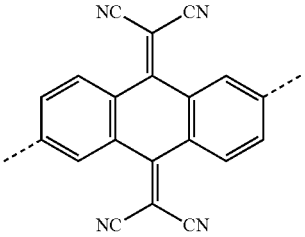 | 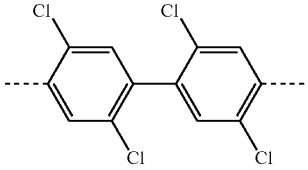 | 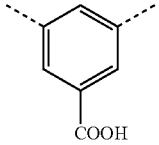 |

TABLE 10C-continued
| | | | |
|---|---|---|---|
| 545 | 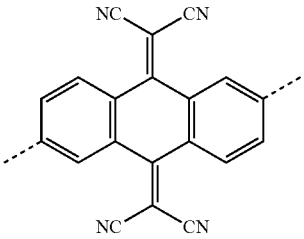 | 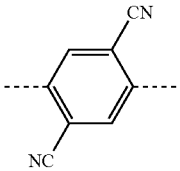 | 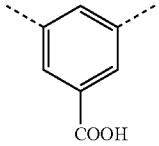 |
| 546 | 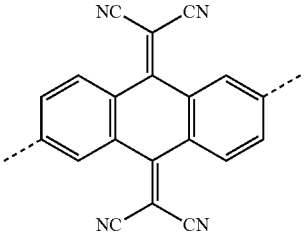 | ----$(CH_2)_2$---- | 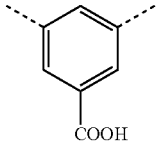 |
| 547 | 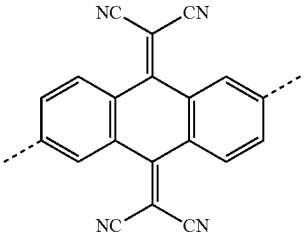 | ----$(CH_2)_{16}$---- | 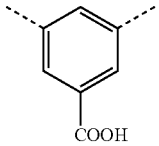 |
| 548 | 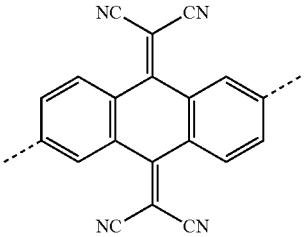 | 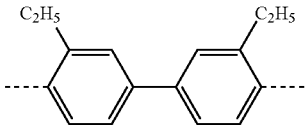 | 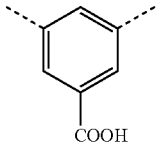 |
| 549 | 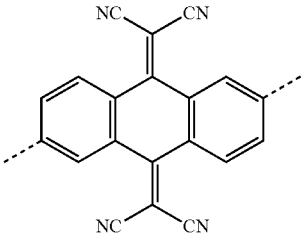 | 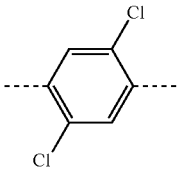 | 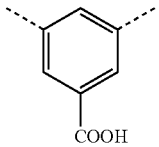 |
| | $B_4$ | $W_1$ | $W_3$ | $Z_1$ | $Z_2$ | $Z_5$ | $Z_6$ |
|---|---|---|---|---|---|---|---|
| 513 | 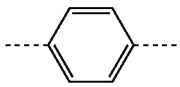 | 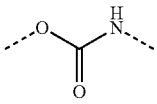 | 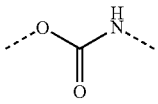 | sing. | sing. | sing. | sing. |
| 514 | 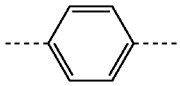 | 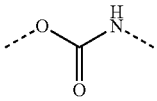 | 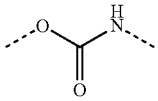 | sing. | sing. | sing. | sing. |
| 515 | 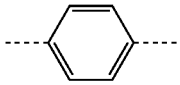 | 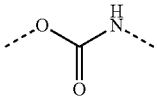 | 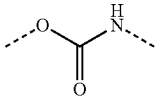 | sing. | sing. | sing. | sing. |

TABLE 10C-continued
| | | | | | | | |
|---|---|---|---|---|---|---|---|
| 516 | 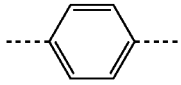 | 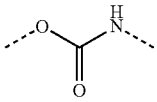 | 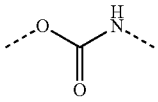 | sing. | sing. | sing. | sing. |
| 517 | 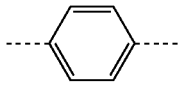 | 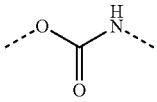 | 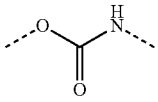 | sing. | sing. | sing. | sing. |
| 518 | 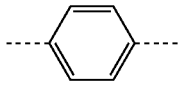 | 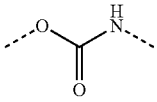 | 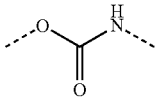 | sing. | sing. | sing. | sing. |
| 519 | 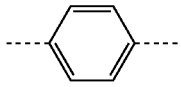 | 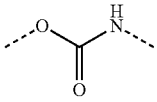 | 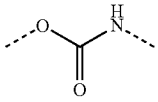 | sing. | sing. | sing. | sing. |
| 520 | 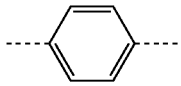 | 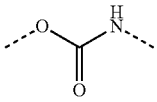 | 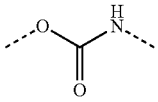 | sing. | sing. | sing. | sing. |
| 521 | 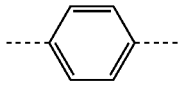 | 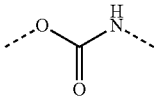 | 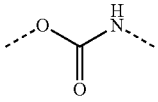 | sing. | sing. | sing. | sing. |
| 522 | 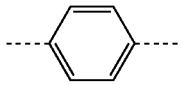 | 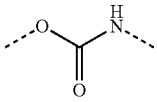 | 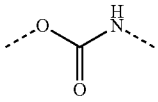 | sing. | sing. | sing. | sing. |
| 523 | 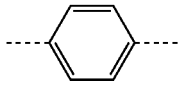 | 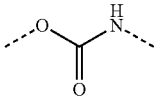 | 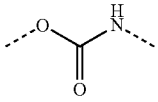 | sing. | sing. | sing. | sing. |
| 524 | 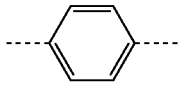 | 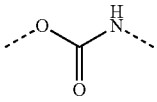 | 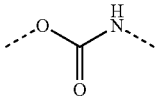 | sing. | sing. | sing. | sing. |
| 525 | 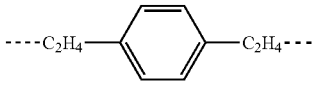 | 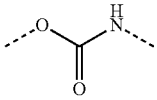 | 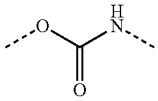 | sing. | sing. | sing. | sing. |
| 526 | 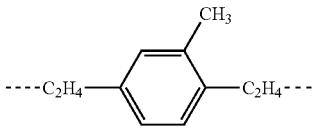 | 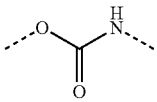 | 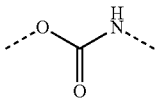 | sing. | sing. | sing. | sing. |
| 527 | 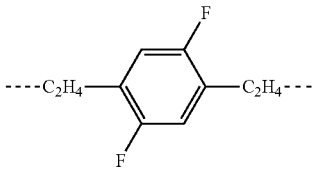 | 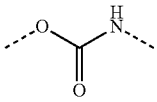 | 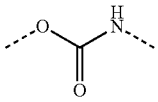 | sing. | sing. | sing. | sing. |
| 528 | 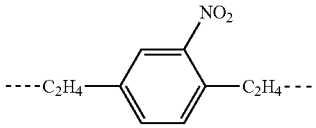 | 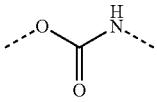 | 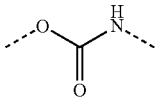 | sing. | sing. | sing. | sing. |

TABLE 10C-continued
| | | | | | | | |
|---|---|---|---|---|---|---|---|
| 529 | 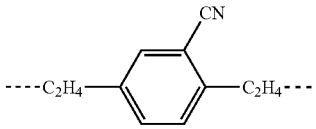 | 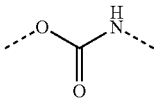 | 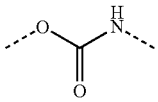 | sing. | sing. | sing. | sing. |
| 530 | 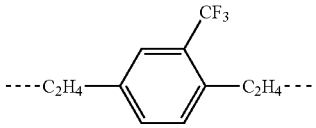 | 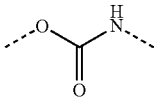 | 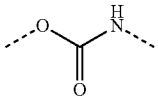 | sing. | sing. | sing. | sing. |
| 531 | 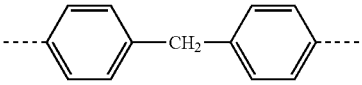 | 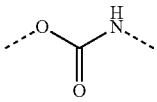 | 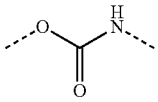 | sing. | sing. | sing. | sing. |
| 532 | 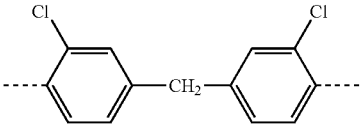 | 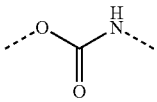 | 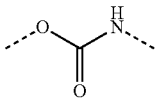 | sing. | sing. | sing. | sing. |
| 533 | 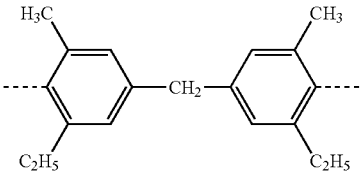 | 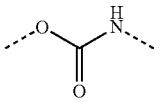 | 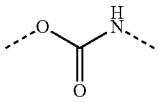 | sing. | sing. | sing. | sing. |
| 534 | 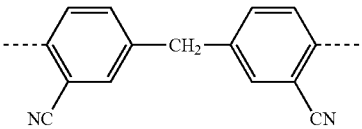 | 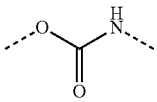 | 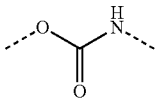 | sing. | sing. | sing. | sing. |
| 535 | 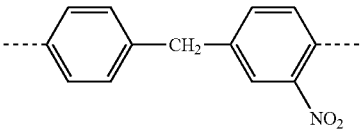 | 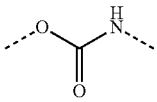 | 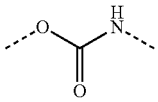 | sing. | sing. | sing. | sing. |
| 536 | 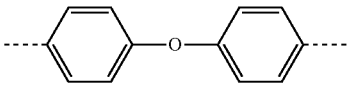 | 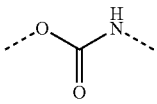 | 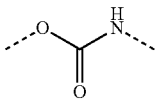 | sing. | sing. | sing. | sing. |
| 537 | 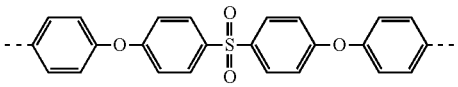 | 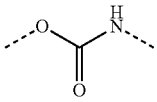 | 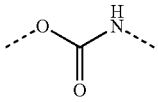 | sing. | sing. | sing. | sing. |
| 538 | ----$C_2H_4$—O—$C_2H_4$---- | 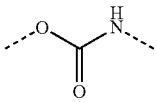 | 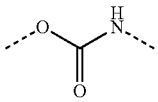 | sing. | sing. | sing. | sing. |
| 539 | 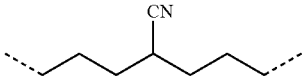 | 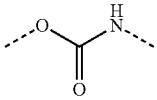 | 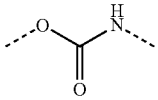 | sing. | sing. | sing. | sing. |
| 540 | 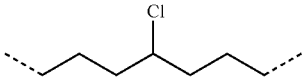 | 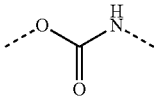 | 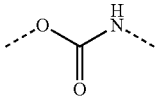 | sing. | sing. | sing. | sing. |

TABLE 10C-continued
| | | | | | | | |
|---|---|---|---|---|---|---|---|
| 541 | 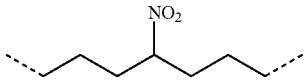 | 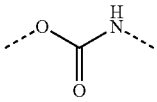 | 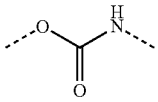 | sing. | sing. | sing. | sing. |
| 542 | 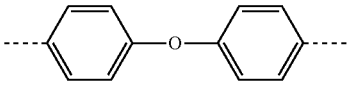 | 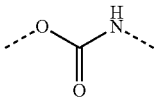 | 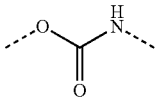 | sing. | sing. | sing. | sing. |
| 543 | 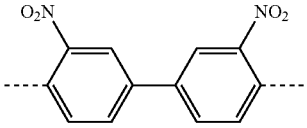 | 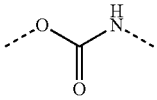 | 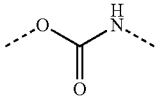 | sing. | sing. | sing. | sing. |
| 544 | 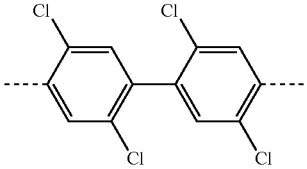 | 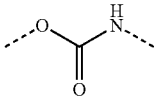 | 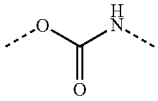 | sing. | sing. | sing. | sing. |
| 545 | 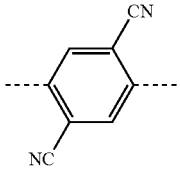 | 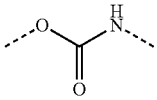 | 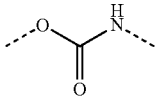 | sing. | sing. | sing. | sing. |
| 546 | ----$(CH_2)_2$---- | 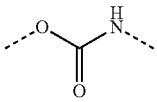 | 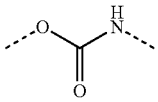 | sing. | sing. | sing. | sing. |
| 547 | ----$(CH_2)_{16}$---- | 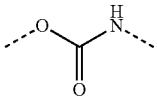 | 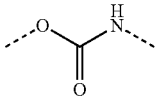 | sing. | sing. | sing. | sing. |
| 548 | 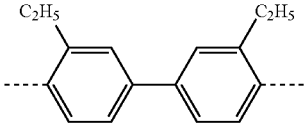 | 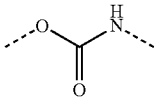 | 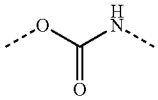 | sing. | sing. | sing. | sing. |
| 549 | 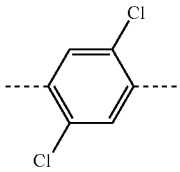 | 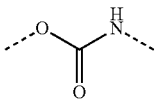 | 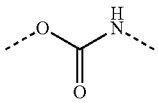 | sing. | sing. | sing. | sing. |

TABLE 11
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 601 | 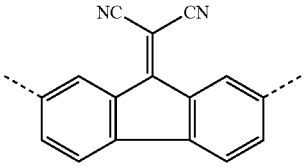 | 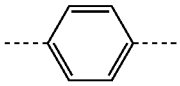 | 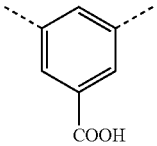 | sing. | sing. | sing. | sing. | sing. | sing. |
| 602 | 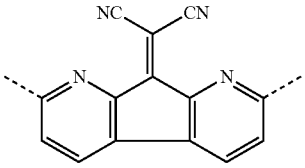 | 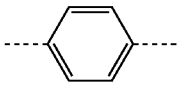 | 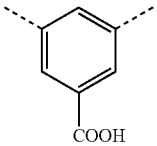 | sing. | sing. | sing. | sing. | sing. | sing. |
| 603 | 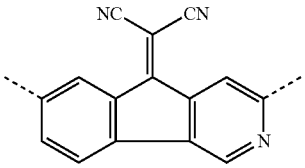 | 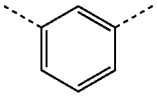 | 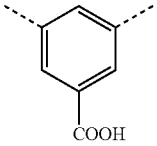 | sing. | sing. | sing. | sing. | sing. | sing. |
| 604 | 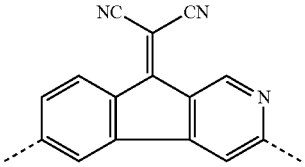 | 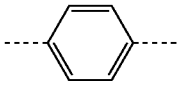 | 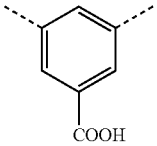 | sing. | sing. | sing. | sing. | sing. | sing. |
TABLE 12A
| | A | $E_1$ | $B_3$ | $E_4$ | $Z_1$ | $Z_2$ | $Z_5$ | $Z_6$ |
|---|---|---|---|---|---|---|---|---|
| 605 | 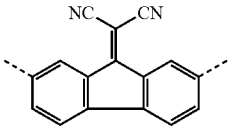 | 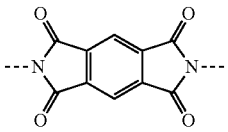 | 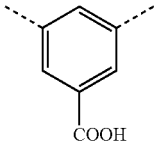 | 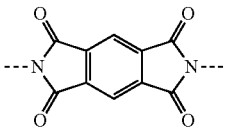 | sing. | sing. | sing. | sing. |
| 606 | 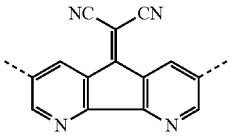 | 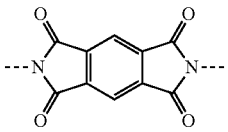 | 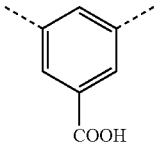 | 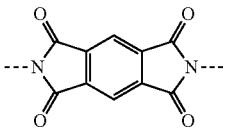 | sing. | sing. | sing. | sing. |
TABLE 12B
| | A | $B_1$ | $B_3$ | $B_4$ |
|---|---|---|---|---|
| 607 | 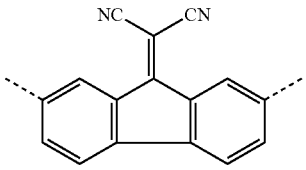 | 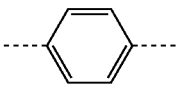 | 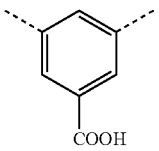 | 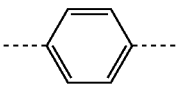 |

TABLE 12B-continued
| | | | | |
|---|---|---|---|---|
| 608 | 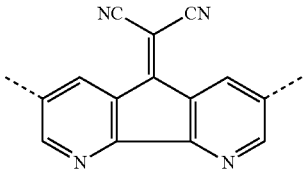 | 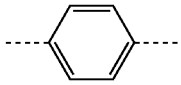 | 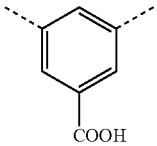 | 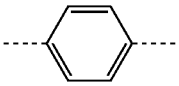 |
| 609 | 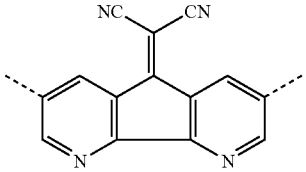 | 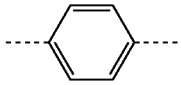 | 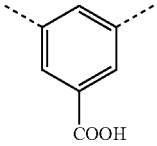 | 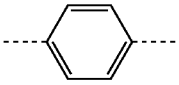 |
| 610 | 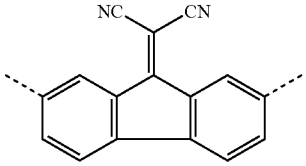 | 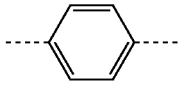 | 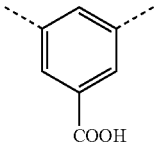 | 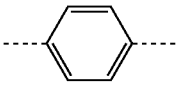 |
| 611 | 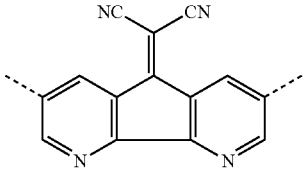 | 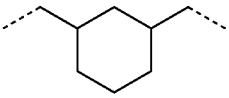 | 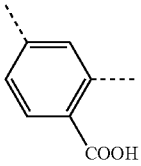 | 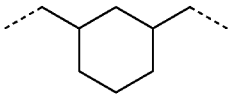 |
| | $W_1$ | $W_3$ | $Z_1$ | $Z_2$ | $Z_5$ | $Z_6$ |
|---|---|---|---|---|---|---|
| 607 | 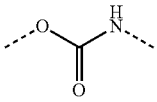 | 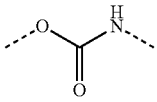 | 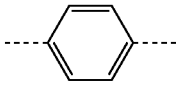 | 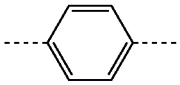 | sing. | sing. |
| 608 | 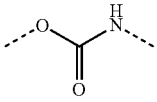 | 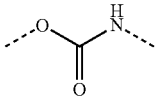 | 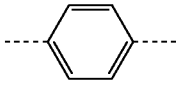 | 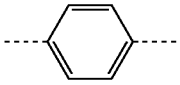 | sing. | sing. |
| 609 | 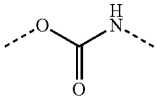 | 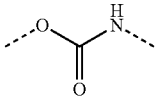 | 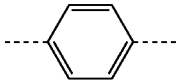 | 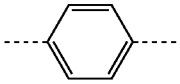 | sing. | sing. |
| 610 | 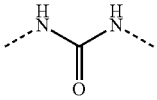 | 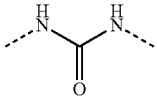 | 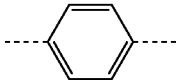 | 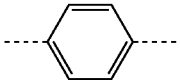 | sing. | sing. |
| 611 | 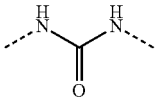 | 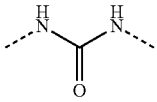 | 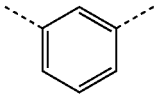 | 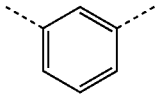 | sing. | sing. |

TABLE 12C
| | A | $B_1$ | $B_3$ | $B_4$ |
|---|---|---|---|---|
| 612 | 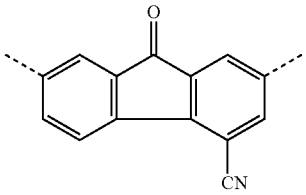 | 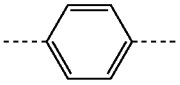 | 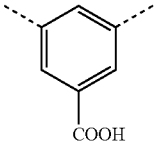 | 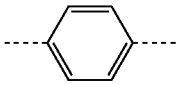 |
| 613 | 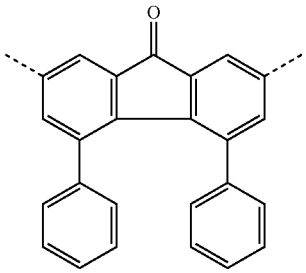 | 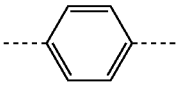 | 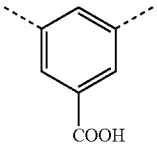 | 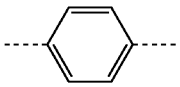 |
| 614 | 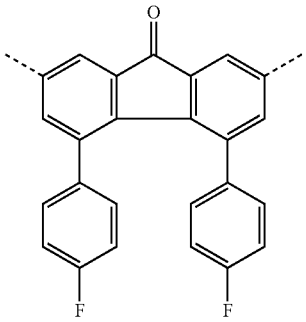 | 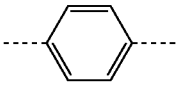 | 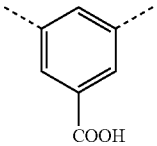 | 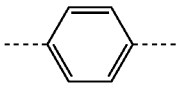 |
| 615 | 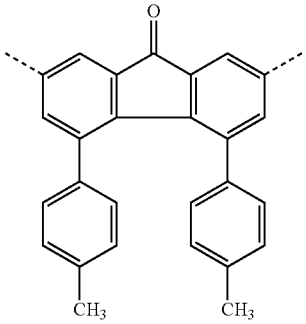 | 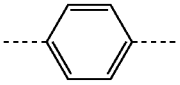 | 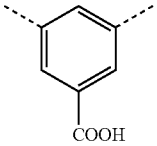 | 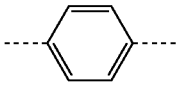 |
| 616 | 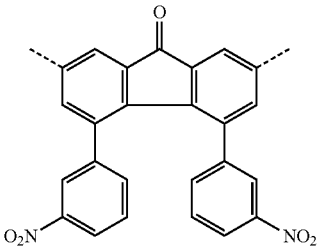 | 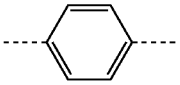 | 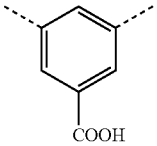 | 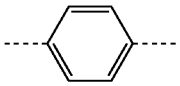 |

TABLE 12C-continued
| | | | | |
|---|---|---|---|---|
| 617 | 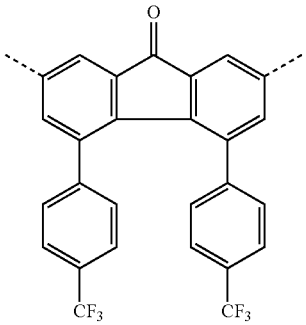 | 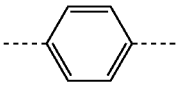 | 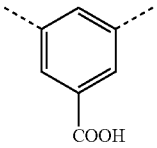 | 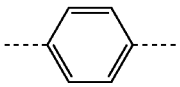 |
| 618 | 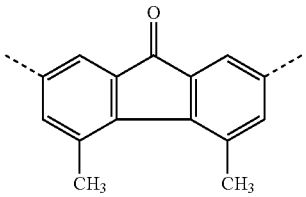 | 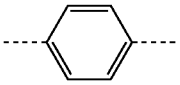 | 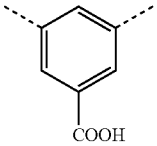 | 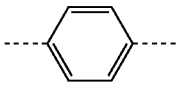 |
| 619 | 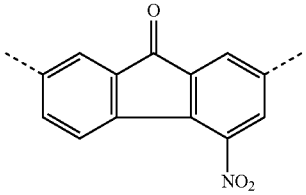 | 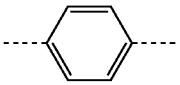 | 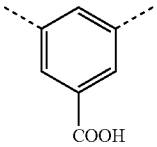 | 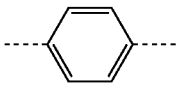 |
| 620 | 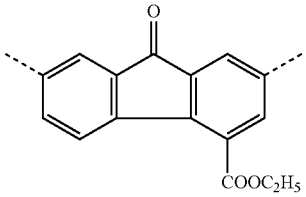 | 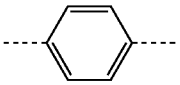 | 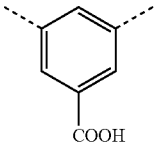 | 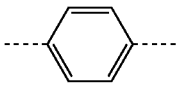 |
| 621 | 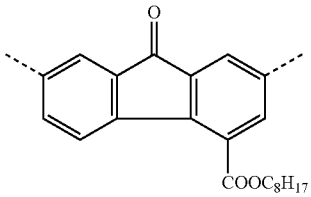 | 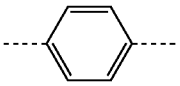 | 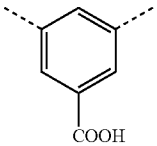 | 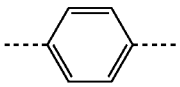 |
| 622 | 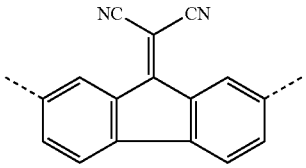 | 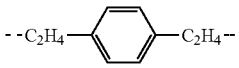 | 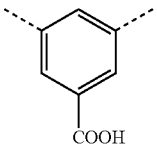 | 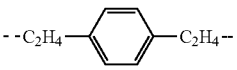 |
| 623 | 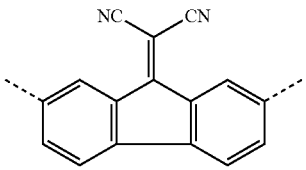 | 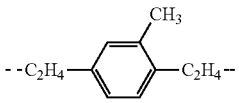 | 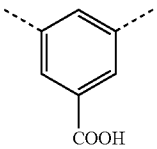 | 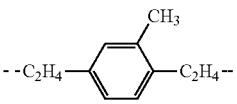 |

TABLE 12C-continued
| | | | | |
|---|---|---|---|---|
| 624 | 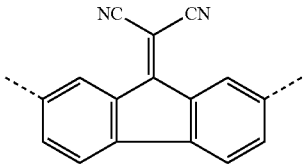 | 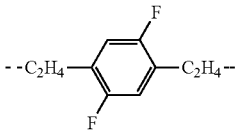 | 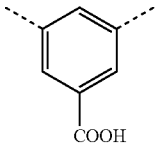 | 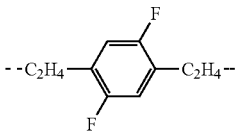 |
| 625 | 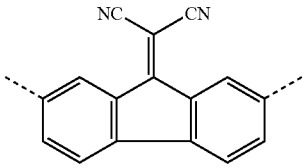 | 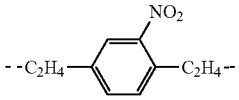 | 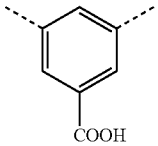 | 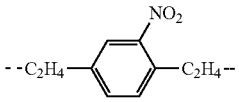 |
| 626 | 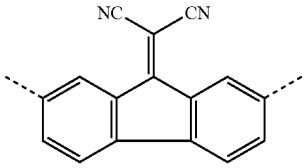 | 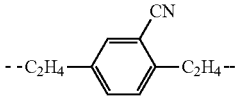 | 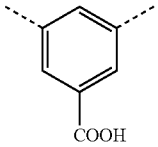 | 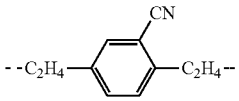 |
| 627 | 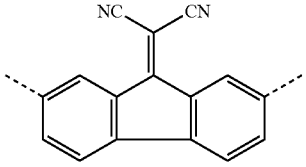 | 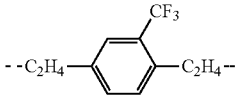 | 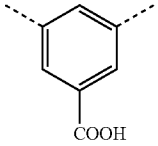 | 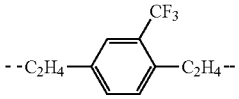 |
| 628 | 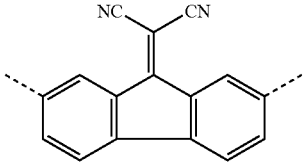 | 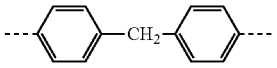 | 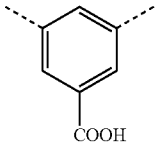 | 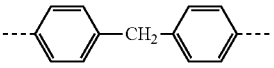 |
| 629 | 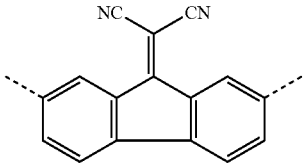 | 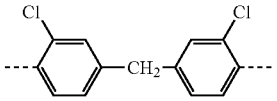 | 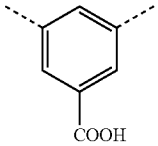 | 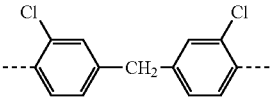 |
| 630 | 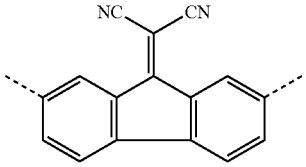 | 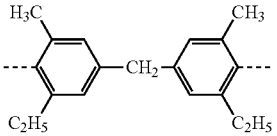 | 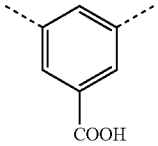 | 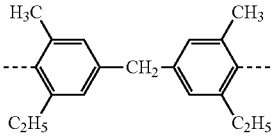 |
| 631 | 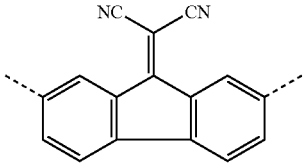 | 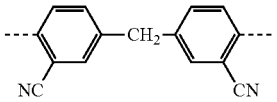 | 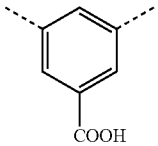 | 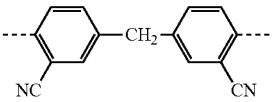 |
| 632 | 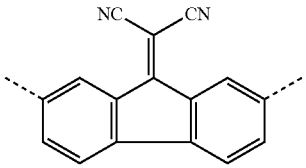 | 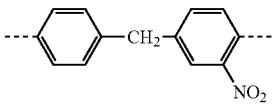 | 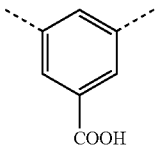 | 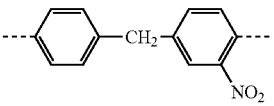 |

TABLE 12C-continued
| | | | | |
|---|---|---|---|---|
| 633 | 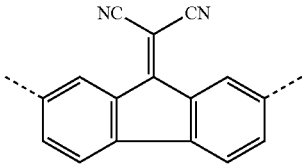 | 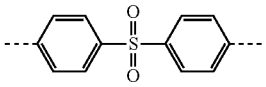 | 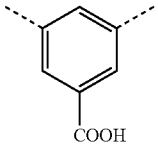 | 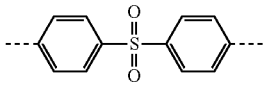 |
| 634 | 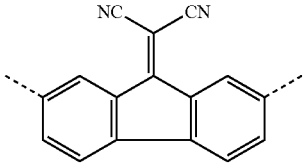 | 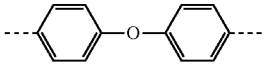 | 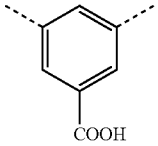 | 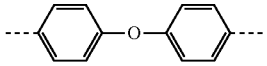 |
| 635 | 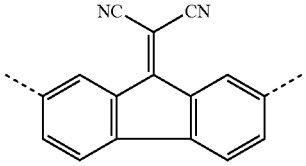 | ----$C_2H_4$—O—$C_2H_4$---- | 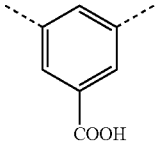 | ----$C_2H_4$—O—$C_2H_4$---- |
| 636 | 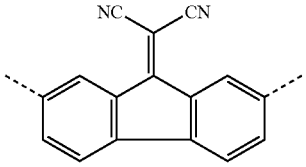 | 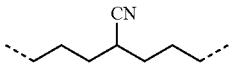 | 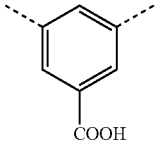 | 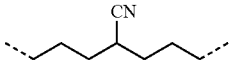 |
| 637 | 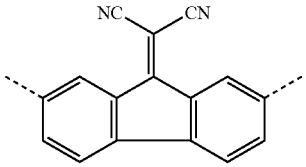 | 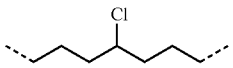 | 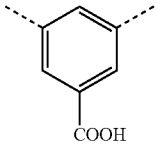 | 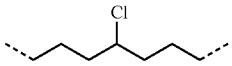 |
| 638 | 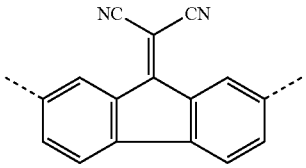 | 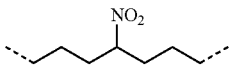 | 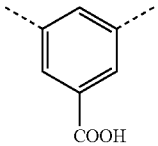 | 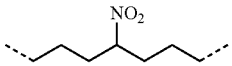 |
| 639 | 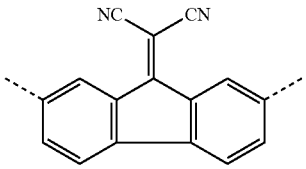 | 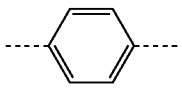 | 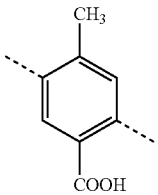 | 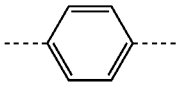 |
| 640 | 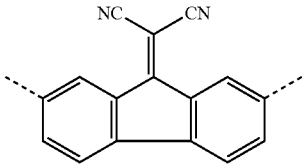 | 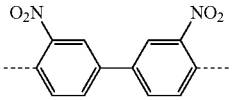 | 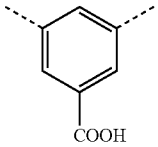 | 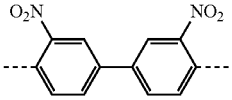 |
| 641 | 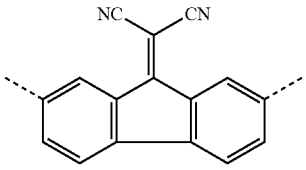 | 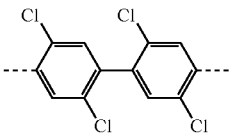 | 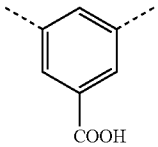 | 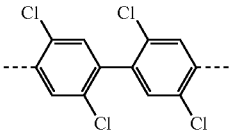 |

TABLE 12C-continued
| | | | | |
|---|---|---|---|---|
| 642 | 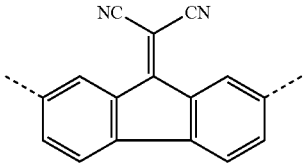 | 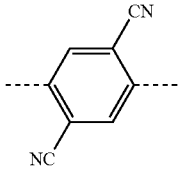 | 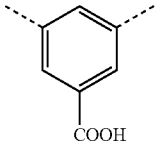 | 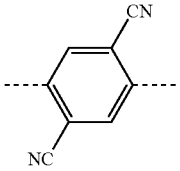 |
| 643 | 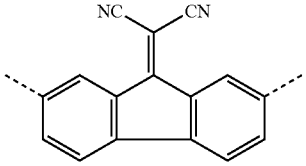 | 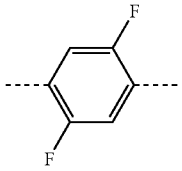 | 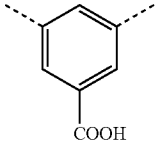 | 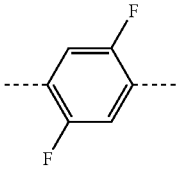 |
| 644 | 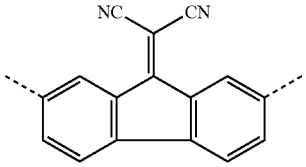 | $(CH_2)_{16}$ | 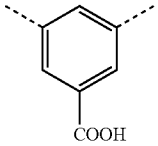 | $(CH_2)_{16}$ |
| 645 | 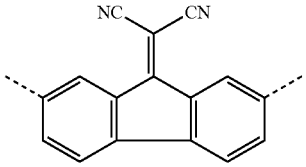 | $(CH_2)_2$ | 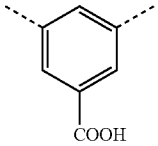 | $(CH_2)_2$ |
| 646 | 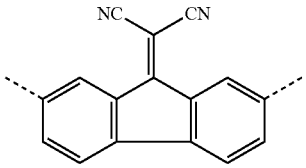 | 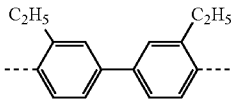 | 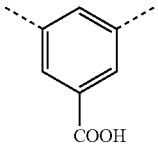 | 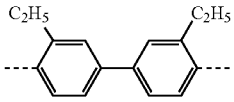 |
| | $W_1$ | $W_3$ | $Z_1$ | $Z_2$ | $Z_5$ | $Z_6$ |
|---|---|---|---|---|---|---|
| 612 | 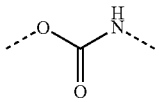 | 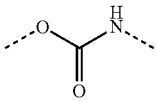 | 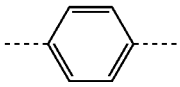 | 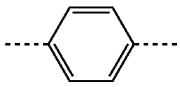 | sing. | sing. |
| 613 | 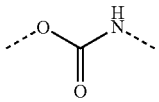 | 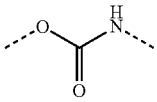 | 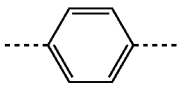 | 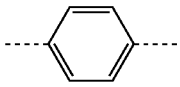 | sing. | sing. |
| 614 | 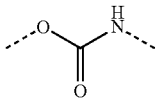 | 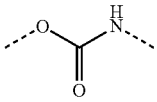 | 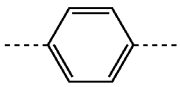 | 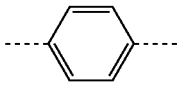 | sing. | sing. |
| 615 | 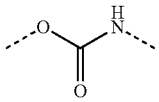 | 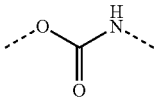 | 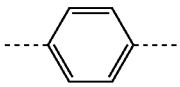 | 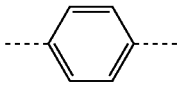 | sing. | sing. |
| 616 | 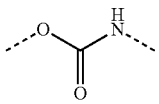 | 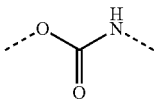 | 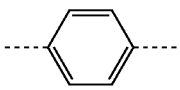 | 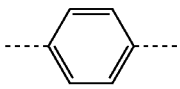 | sing. | sing. |
| 617 | 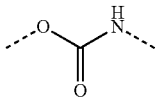 | 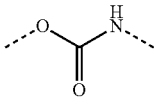 | 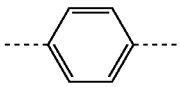 | 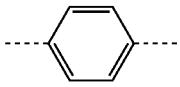 | sing. | sing. |

TABLE 12C-continued
| | | | | | | |
|---|---|---|---|---|---|---|
| 618 | 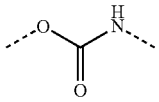 | 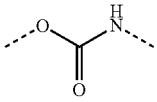 | 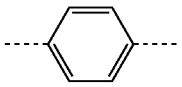 | 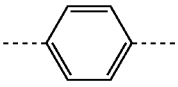 | sing. | sing. |
| 619 | 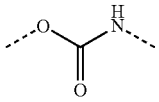 | 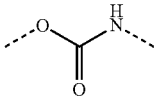 | 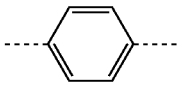 | 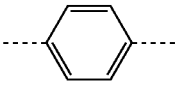 | sing. | sing. |
| 620 | 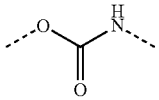 | 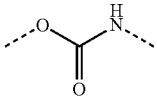 | 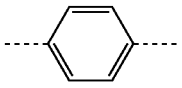 | 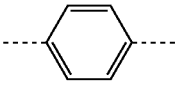 | sing. | sing. |
| 621 | 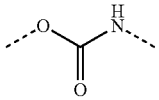 | 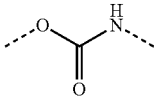 | 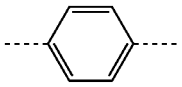 | 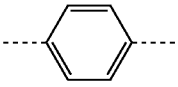 | sing. | sing. |
| 622 | 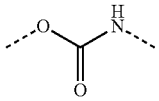 | 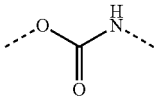 | 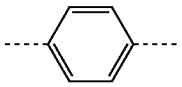 | 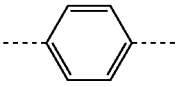 | sing. | sing. |
| 623 | 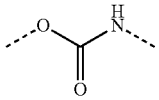 | 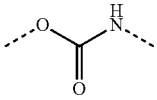 | 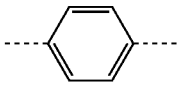 | 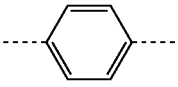 | sing. | sing. |
| 624 | 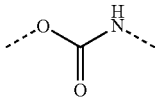 | 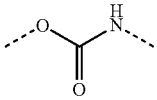 | 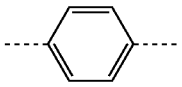 | 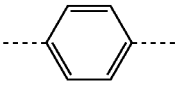 | sing. | sing. |
| 625 | 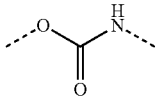 | 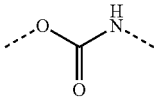 | sing. | sing. | sing. | sing. |
| 626 | 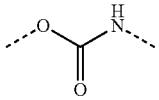 | 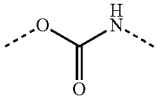 | 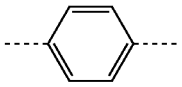 | 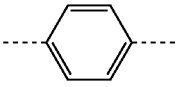 | sing. | sing. |
| 627 | 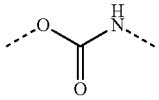 | 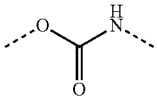 | 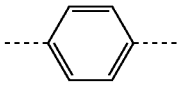 | 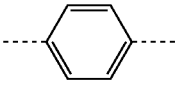 | sing. | sing. |
| 628 | 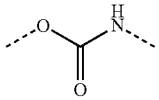 | 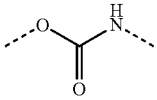 | 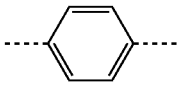 | 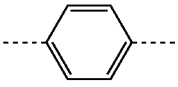 | sing. | sing. |
| 629 | 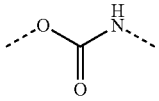 | 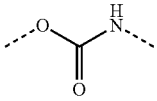 | 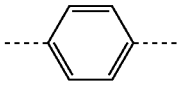 | 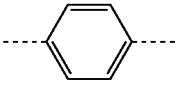 | sing. | sing. |
| 630 | 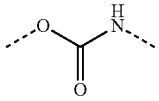 | 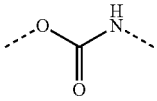 | 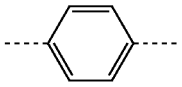 | 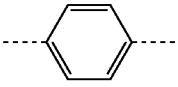 | sing. | sing. |
| 631 | 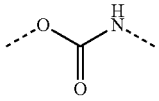 | 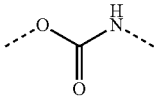 | 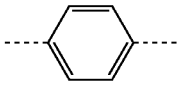 | 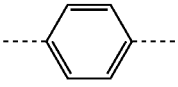 | sing. | sing. |

TABLE 12C-continued
| | | | | | | |
|---|---|---|---|---|---|---|
| 632 | 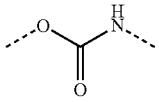 | 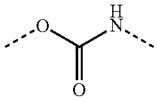 | sing. | sing. | sing. | sing. |
| 633 | 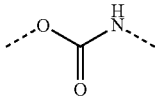 | 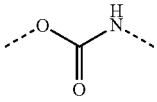 | 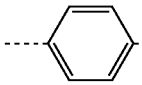 | 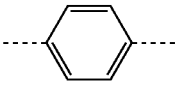 | sing. | sing. |
| 634 | 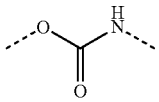 | 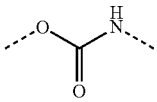 | 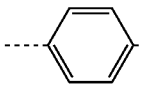 | 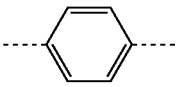 | sing. | sing. |
| 635 | 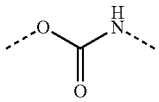 | 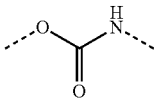 | 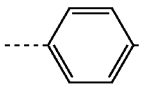 | 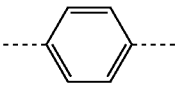 | sing. | sing. |
| 636 | 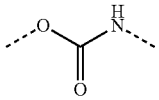 | 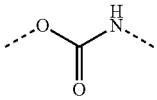 | 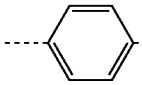 | 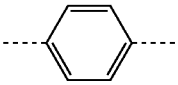 | sing. | sing. |
| 637 | 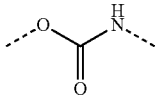 | 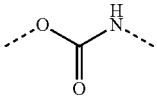 | 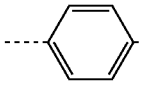 | 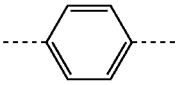 | sing. | sing. |
| 638 | 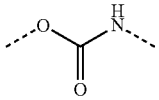 | 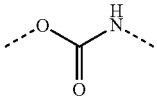 | sing. | sing. | sing. | sing. |
| 639 | 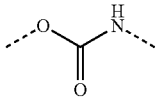 | 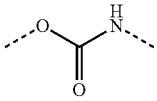 | sing. | sing. | sing. | sing. |
| 640 | 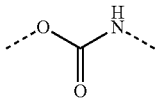 | 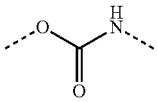 | 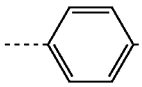 | 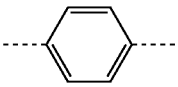 | sing. | sing. |
| 641 | 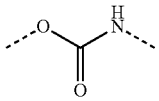 | 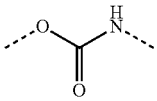 | 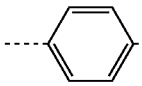 | 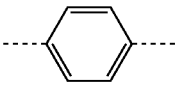 | sing. | sing. |
| 642 | 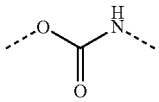 | 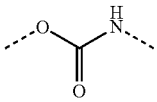 | 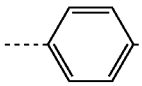 | 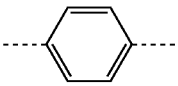 | sing. | sing. |
| 643 | 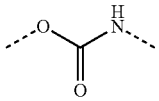 | 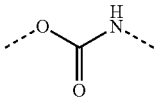 | 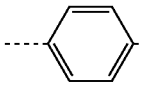 | 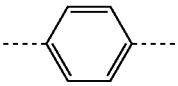 | sing. | sing. |
| 644 | 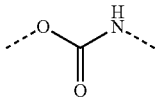 | 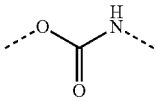 | 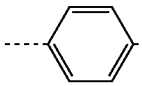 | 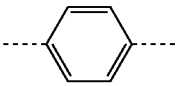 | sing. | sing. |
| 645 | 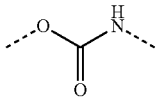 | 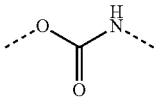 | sing. | sing. | sing. | sing. |

TABLE 12C-continued
| | | | | | | | | | |
|---|---|---|---|---|---|---|---|---|---|
| 646 | 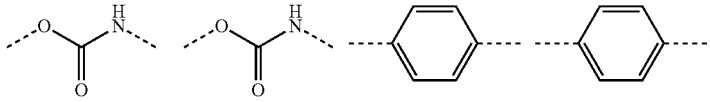 | | | | | | | sing. | sing. |
TABLE 13
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 701 | 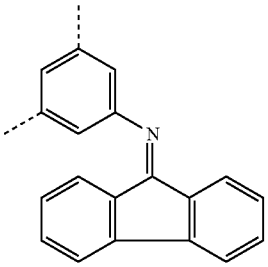 | 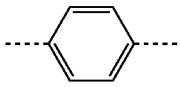 | 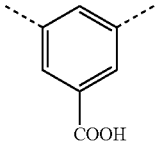 | sing. | sing. | sing. | sing. | sing. | sing. |
| 702 | 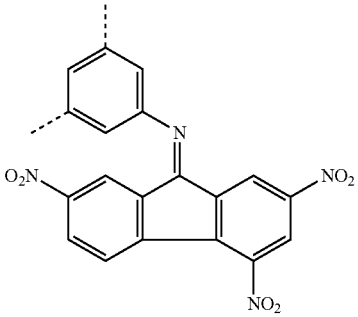 | 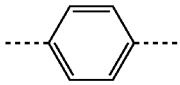 | 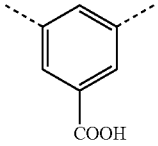 | sing. | sing. | sing. | sing. | sing. | sing. |
| 703 | 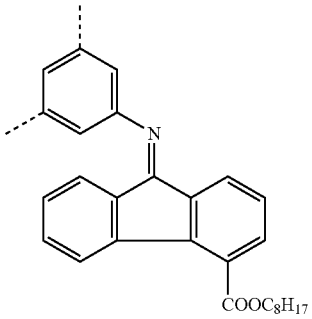 | 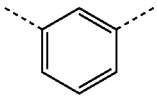 | 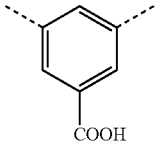 | sing. | sing. | sing. | sing. | sing. | sing. |
| 704 | 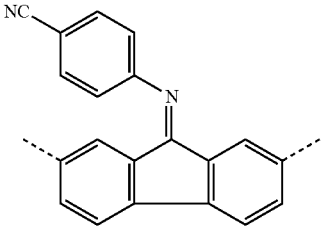 | 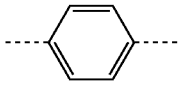 | 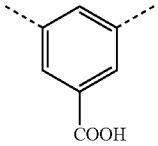 | sing. | sing. | sing. | sing. | sing. | sing. |

TABLE 14A
| | A | $E_1$ | $B_3$ | $E_4$ | $Z_1$ | $Z_2$ | $Z_5$ | $Z_6$ |
|---|---|---|---|---|---|---|---|---|
| 705 | 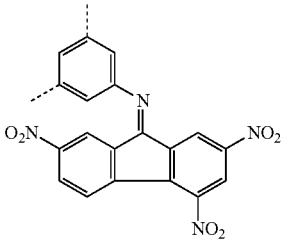 | 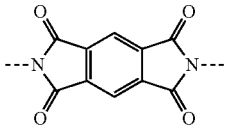 | 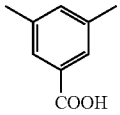 | 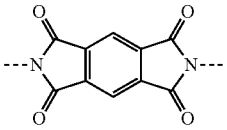 | sing. | sing. | sing. | sing. |
| 706 | 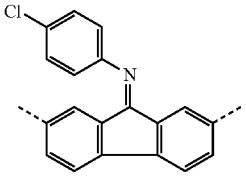 | 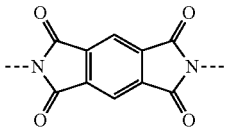 | 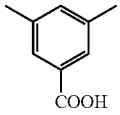 | 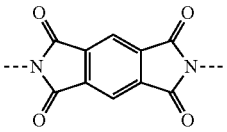 | sing. | sing. | sing. | sing. |
TABLE 14B
| | A | $B_1$ | $B_3$ | $B_4$ |
|---|---|---|---|---|
| 707 | 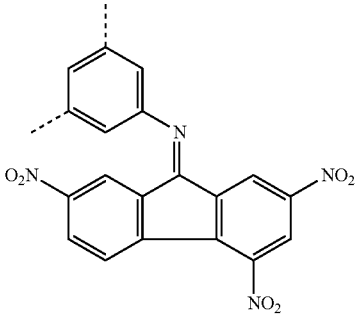 | 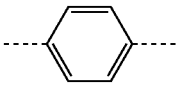 | 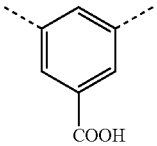 | 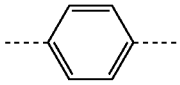 |
| 708 | 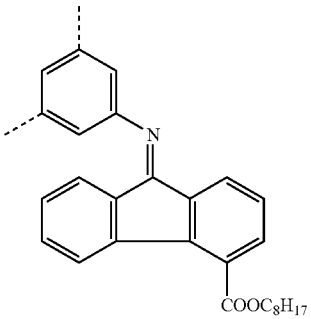 | 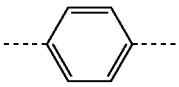 | 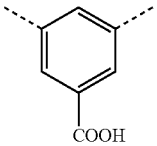 | 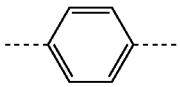 |
| 709 | 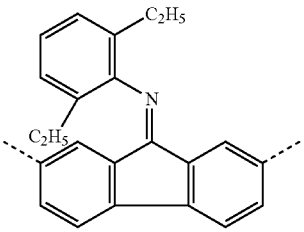 | 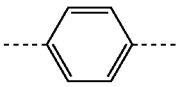 | 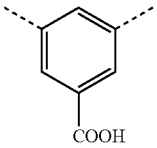 | 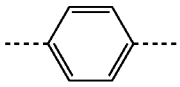 |

TABLE 14B-continued
| | | | | |
|---|---|---|---|---|
| 710 | 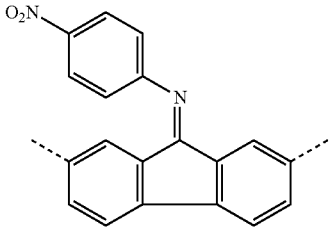 | 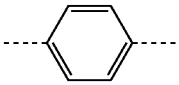 | 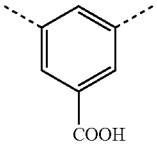 | 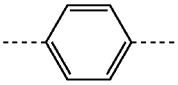 |
| 711 | 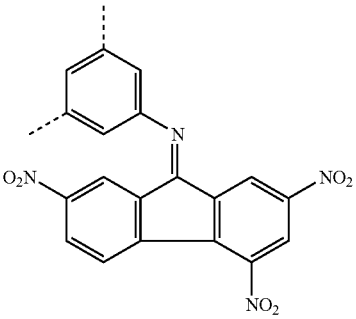 | 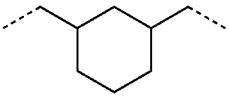 | 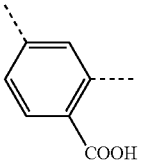 | 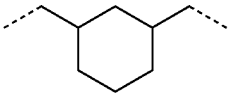 |
| | $W_1$ | $W_3$ | $Z_1$ | $Z_2$ | $Z_5$ | $Z_6$ |
|---|---|---|---|---|---|---|
| 707 | 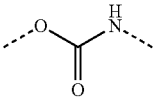 | 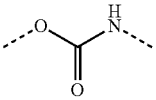 | 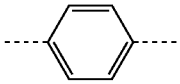 | 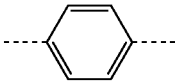 | sing. | sing. |
| 708 | 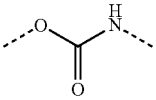 | 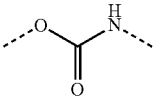 | 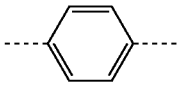 | 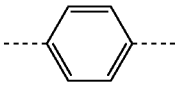 | sing. | sing. |
| 709 | 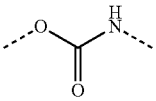 | 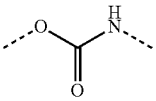 | 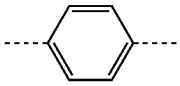 | 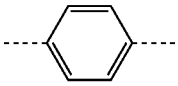 | sing. | sing. |
| 710 | 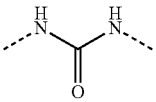 | 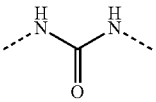 | 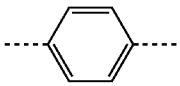 | 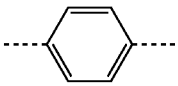 | sing. | sing. |
| 711 | 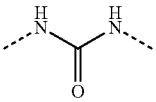 | 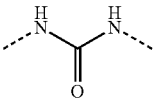 | 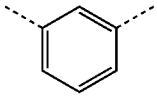 | 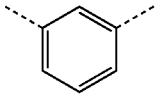 | sing. | sing. |
TABLE 14C
| | A | $B_1$ | $B_3$ | $B_4$ |
|---|---|---|---|---|
| 712 | 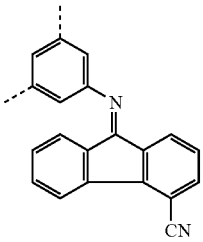 | 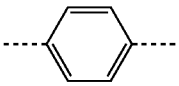 | 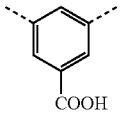 | 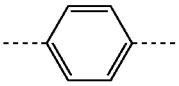 |

TABLE 14C-continued
| | | | | |
|---|---|---|---|---|
| 713 | 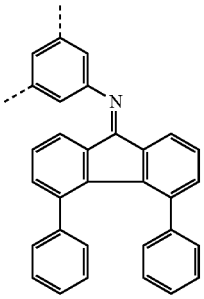 | 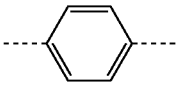 | 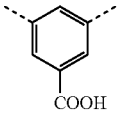 | 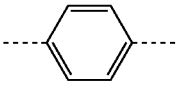 |
| 714 | 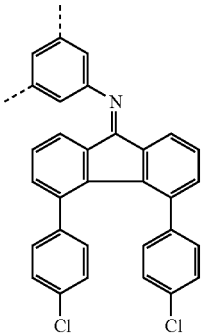 | 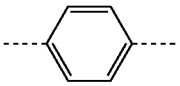 | 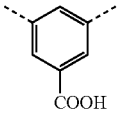 | 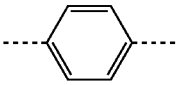 |
| 715 | 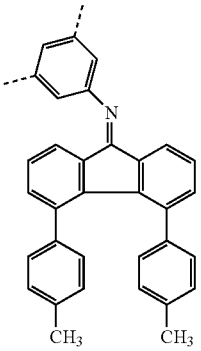 | 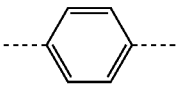 | 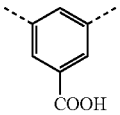 | 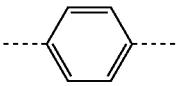 |
| 716 | 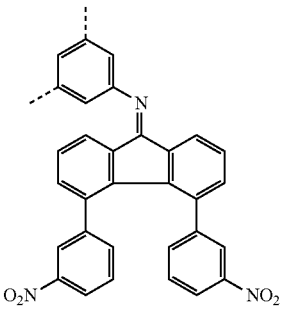 | 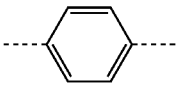 | 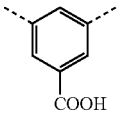 | 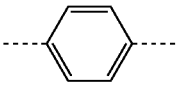 |

TABLE 14C-continued
| | | | | |
|---|---|---|---|---|
| 717 | 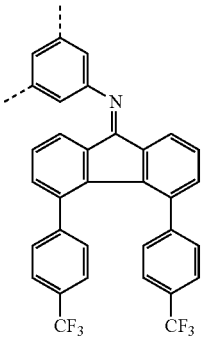 | 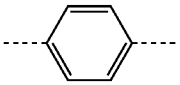 | 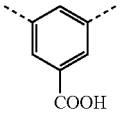 | 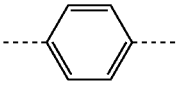 |
| 718 | 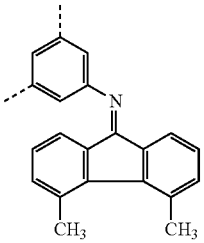 | 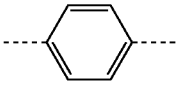 | 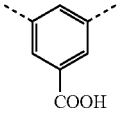 | 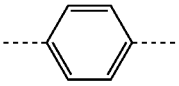 |
| 719 | 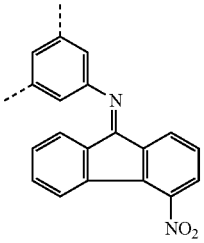 | 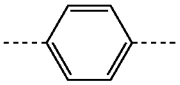 | 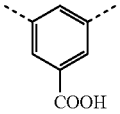 | 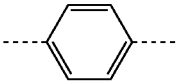 |
| 720 | 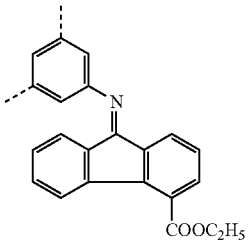 | 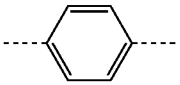 | 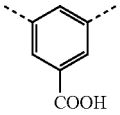 | 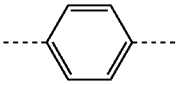 |
| 721 | 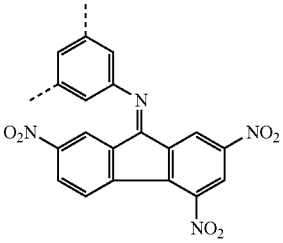 | 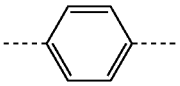 | 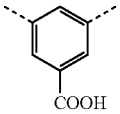 | 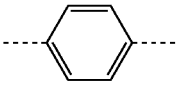 |
| 722 | 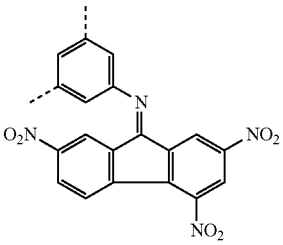 | 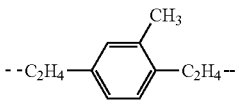 | 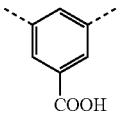 | 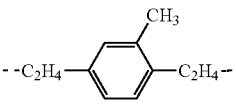 |

TABLE 14C-continued
| | | | | |
|---|---|---|---|---|
| 723 | 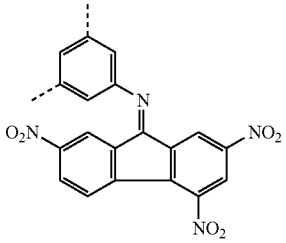 | 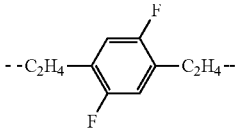 | 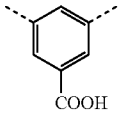 | 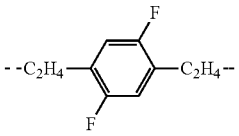 |
| 724 | 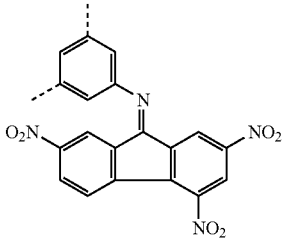 | 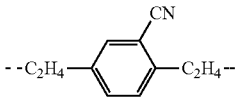 | 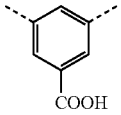 | 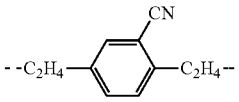 |
| 725 | 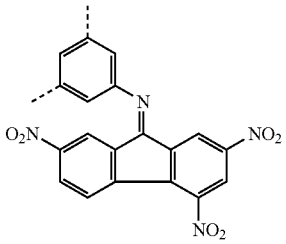 | 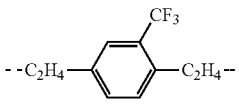 | 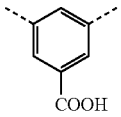 | 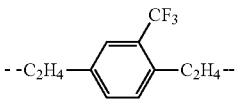 |
| 726 | 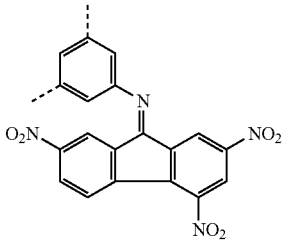 | 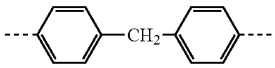 | 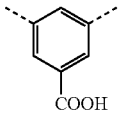 | 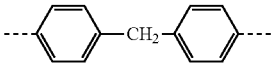 |
| 727 | 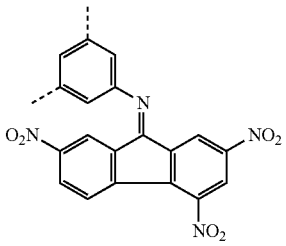 | 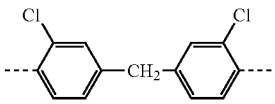 | 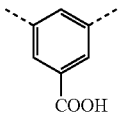 | 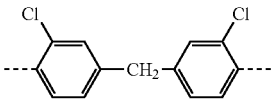 |
| 728 | 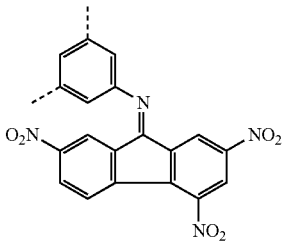 | 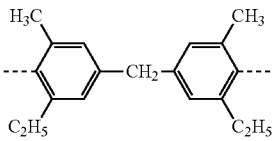 | 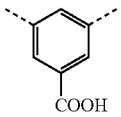 | 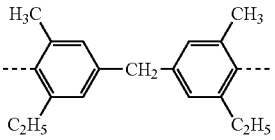 |

TABLE 14C-continued
| | | | | |
|---|---|---|---|---|
| 729 | 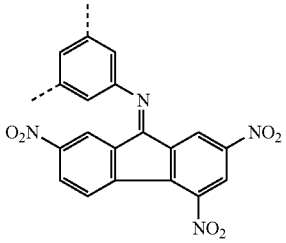 | 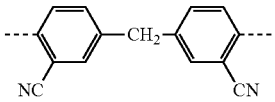 | 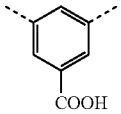 | 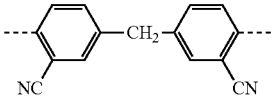 |
| 730 | 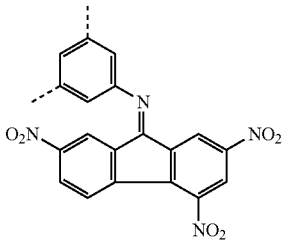 | 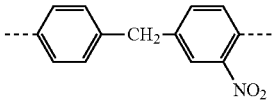 | 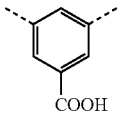 | 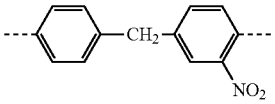 |
| 731 | 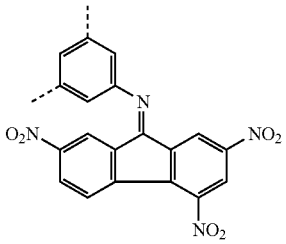 | 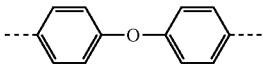 | 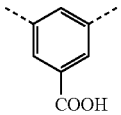 | 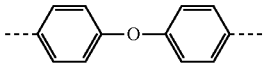 |
| 732 | 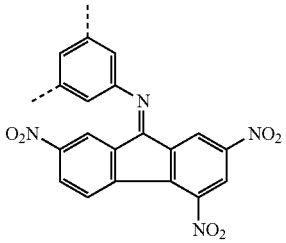 | 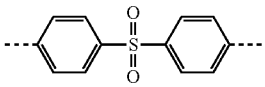 | 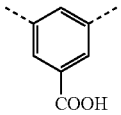 | 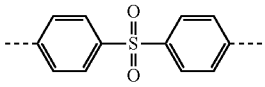 |
| 733 | 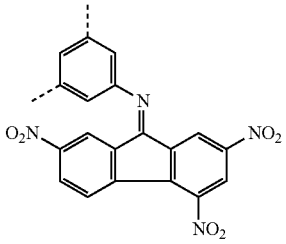 | $-C_2H_4-O-C_2H_4-$ | 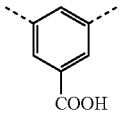 | $-C_2H_4-O-C_2H_4-$ |
| 734 | 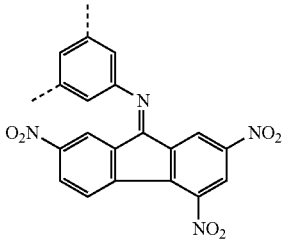 | 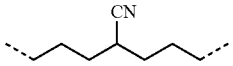 | 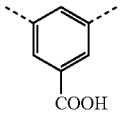 | 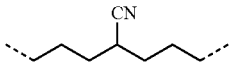 |

TABLE 14C-continued
| | | | | |
|---|---|---|---|---|
| 735 | 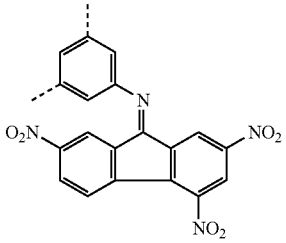 | 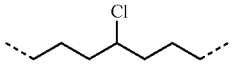 | 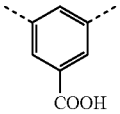 | 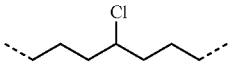 |
| 736 | 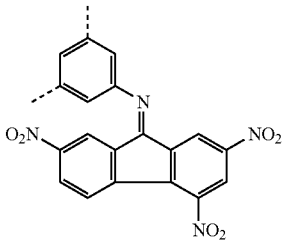 | 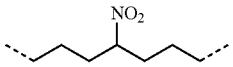 | 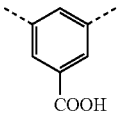 | 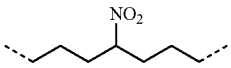 |
| 737 | 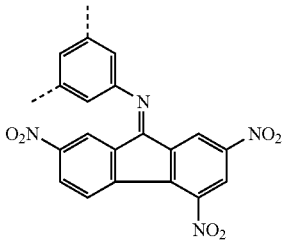 | 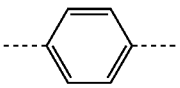 | 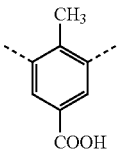 | 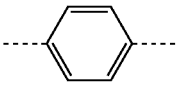 |
| 738 | 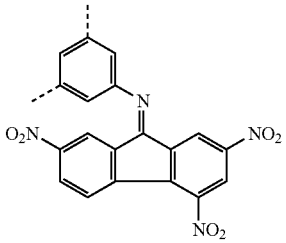 | 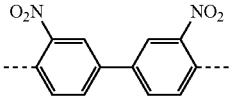 | 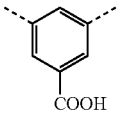 | 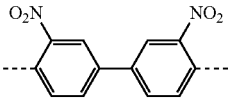 |
| 739 | 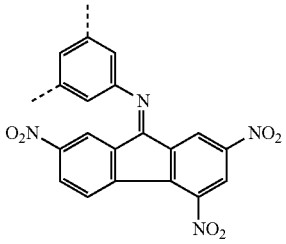 | 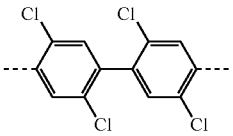 | 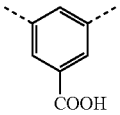 | 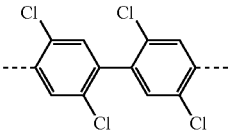 |
| 740 | 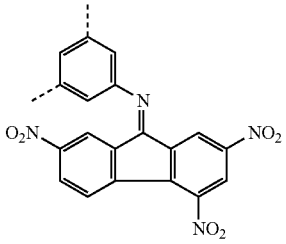 | 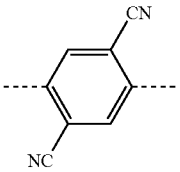 | 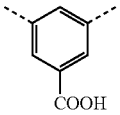 | 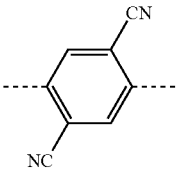 |

TABLE 14C-continued
| | | | | |
|---|---|---|---|---|
| 741 | 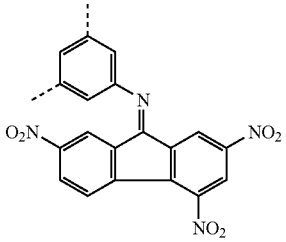 | 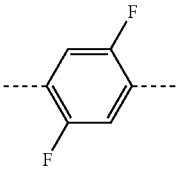 | 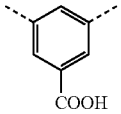 | 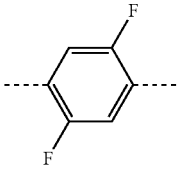 |
| 742 | 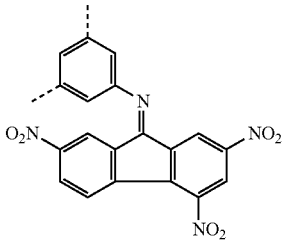 | 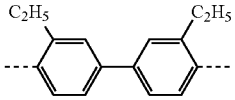 | 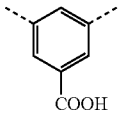 | 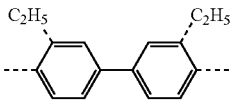 |
| 743 | 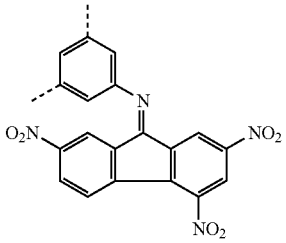 | -----$(CH_2)_{16}$---- | 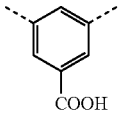 | -----$(CH_2)_{16}$---- |
| 744 | 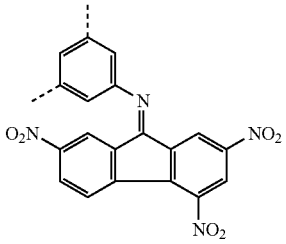 | -----$(CH_2)_2$---- | 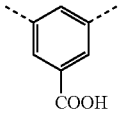 | -----$(CH_2)_2$---- |
| 745 | 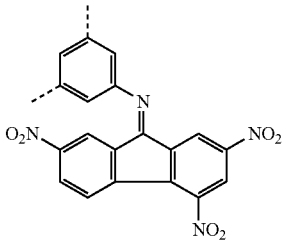 | 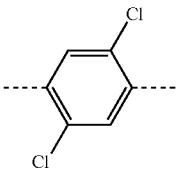 | 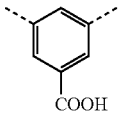 | 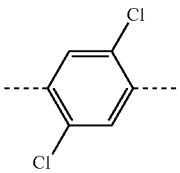 |
| | $W_1$ | $W_3$ | $Z_1$ | $Z_2$ | $Z_5$ | $Z_6$ |
|---|---|---|---|---|---|---|
| 712 | 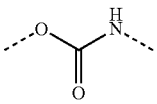 | 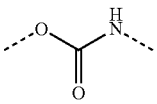 | sing. | sing. | sing. | sing. |
| 713 | 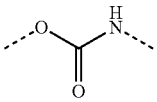 | 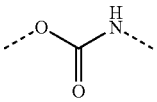 | sing. | sing. | sing. | sing. |
| 714 | 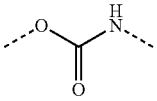 | 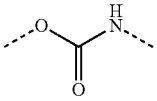 | sing. | sing. | sing. | sing. |

TABLE 14C-continued
| | | | | | | |
|---|---|---|---|---|---|---|
| 715 | 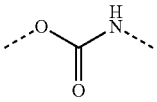 | 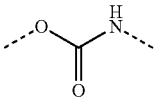 | sing. | sing. | sing. | sing. |
| 716 | 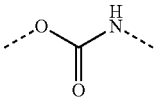 | 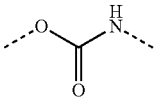 | sing. | sing. | sing. | sing. |
| 717 | 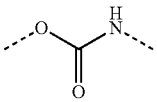 | 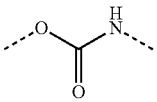 | sing. | sing. | sing. | sing. |
| 718 | 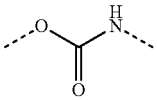 | 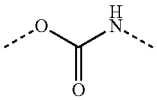 | sing. | sing. | sing. | sing. |
| 719 | 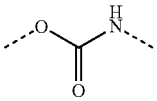 | 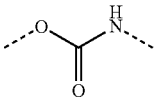 | 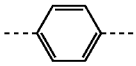 | 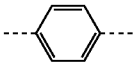 | sing. | sing. |
| 720 | 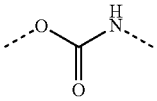 | 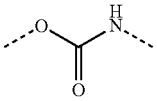 | sing. | sing. | sing. | sing. |
| 721 | 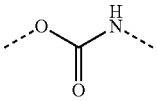 | 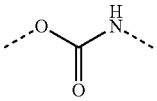 | sing. | sing. | sing. | sing. |
| 722 | 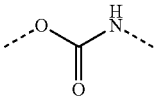 | 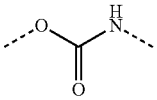 | sing. | sing. | sing. | sing. |
| 723 | 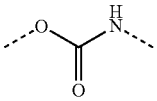 | 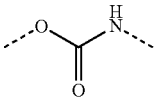 | sing. | sing. | sing. | sing. |
| 724 | 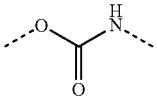 | 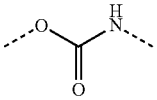 | sing. | sing. | sing. | sing. |
| 725 | 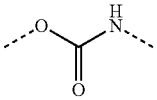 | 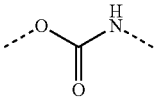 | sing. | sing. | sing. | sing. |
| 726 | 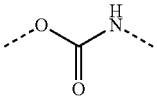 | 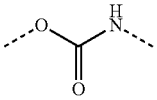 | sing. | sing. | sing. | sing. |
| 727 | 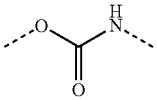 | 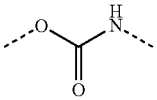 | sing. | sing. | sing. | sing. |
| 728 | 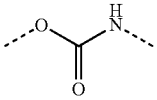 | 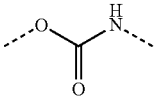 | sing. | sing. | sing. | sing. |

TABLE 14C-continued
| | | | | | | |
|---|---|---|---|---|---|---|
| 729 | 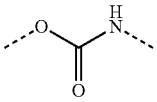 | 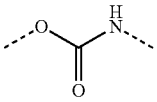 | sing. | sing. | sing. | sing. |
| 730 | 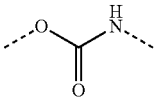 | 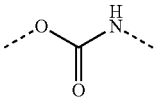 | sing. | sing. | sing. | sing. |
| 731 | 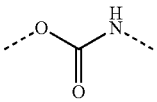 | 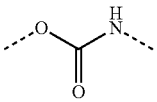 | sing. | sing. | sing. | sing. |
| 732 | 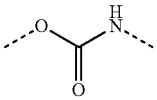 | 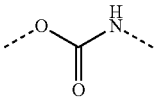 | sing. | sing. | sing. | sing. |
| 733 | 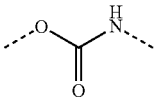 | 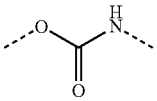 | 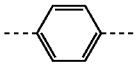 | 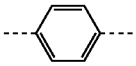 | sing. | sing. |
| 734 | 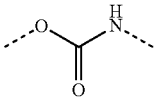 | 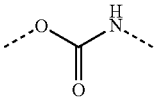 | sing. | sing. | sing. | sing. |
| 735 | 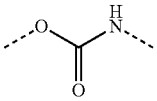 | 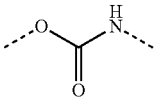 | sing. | sing. | sing. | sing. |
| 736 | 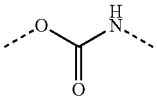 | 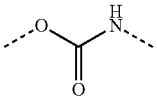 | sing. | sing. | sing. | sing. |
| 737 | 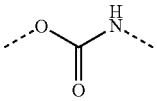 | 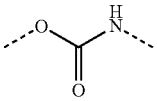 | sing. | sing. | sing. | sing. |
| 738 | 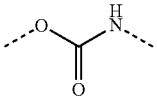 | 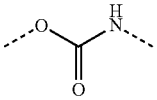 | sing. | sing. | sing. | sing. |
| 739 | 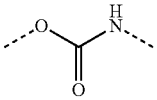 | 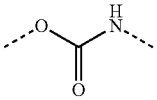 | sing. | sing. | sing. | sing. |
| 740 | 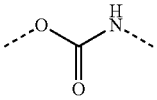 | 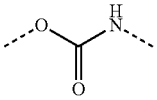 | sing. | sing. | sing. | sing. |
| 741 | 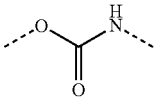 | 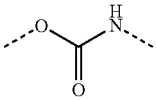 | sing. | sing. | sing. | sing. |
| 742 | 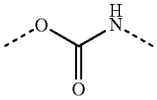 | 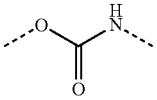 | sing. | sing. | sing. | sing. |

TABLE 14C-continued
| | | | | | | | |
|---|---|---|---|---|---|---|---|
| 743 | 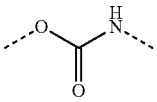 | 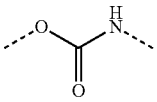 | sing. | sing. | sing. | sing. |
| 744 | 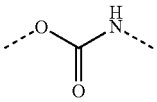 | 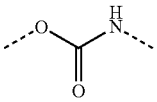 | sing. | sing. | sing. | sing. |
| 745 | 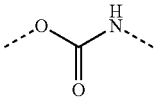 | 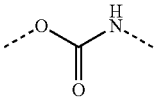 | sing. | sing. | sing. | sing. |
TABLE 15
| | A | $B_1$ | $B_2$ | $W_1$ | $W_2$ | $Z_1$ | $Z_2$ | $Z_3$ | $Z_4$ |
|---|---|---|---|---|---|---|---|---|---|
| 801 | 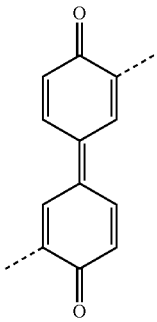 | 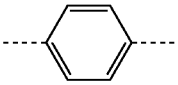 | 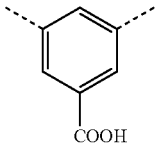 | sing. | sing. | sing. | sing. | sing. | sing. |
| 802 | 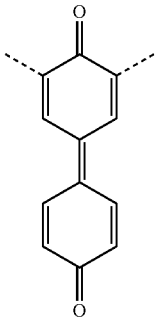 | 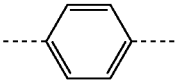 | 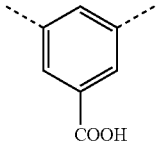 | sing. | sing. | sing. | sing. | sing. | sing. |
| 803 | 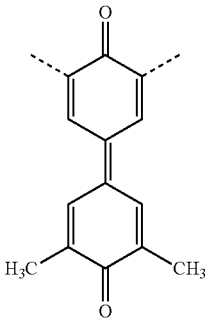 | 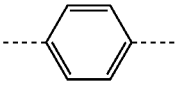 | 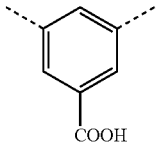 | sing. | sing. | sing. | sing. | sing. | sing. |

TABLE 16A
| | A | $E_1$ | $B_3$ | $E_4$ | $Z_1$ | $Z_2$ | $Z_5$ | $Z_6$ |
|---|---|---|---|---|---|---|---|---|
| 805 | 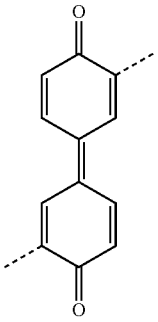 | 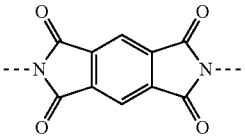 | 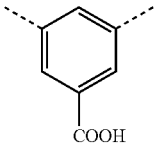 | 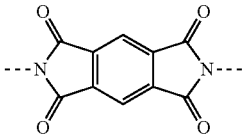 | sing. | sing. | sing. | sing. |
| 806 | 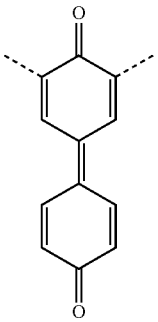 | 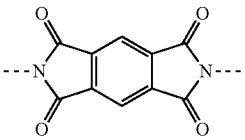 | 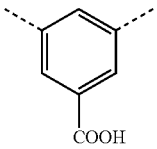 | 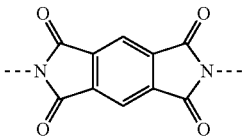 | sing. | sing. | sing. | sing. |
TABLE 16B
| | A | $B_1$ | $B_3$ | $B_4$ | $W_1$ |
|---|---|---|---|---|---|
| 807 | 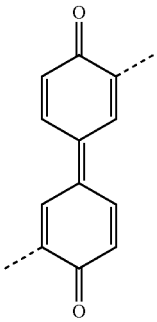 | 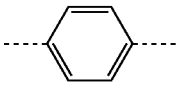 | 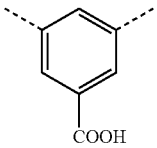 | 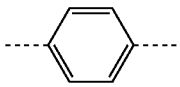 | 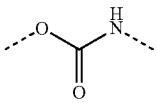 |
| 808 | 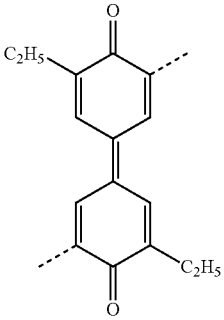 | 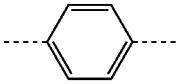 | 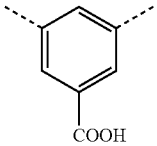 | 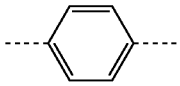 | 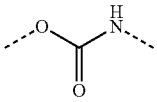 |

TABLE 16B-continued
| | | | | | |
|---|---|---|---|---|---|
| 809 | 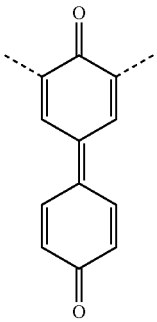 | 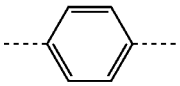 | 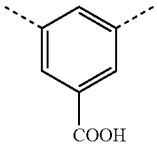 | 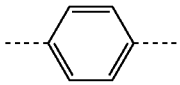 | 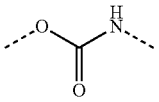 |
| 810 | 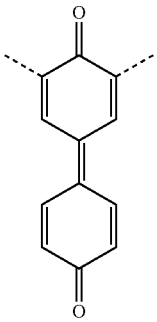 | 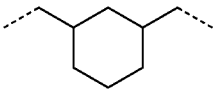 | 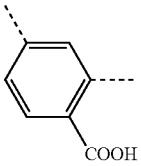 | 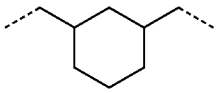 | 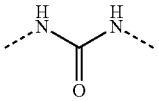 |
| | $W_3$ | $Z_1$ | $Z_2$ | $Z_5$ | $Z_6$ |
|---|---|---|---|---|---|
| 807 | 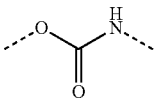 | 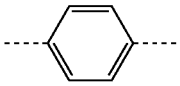 | 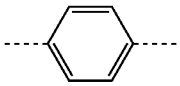 | sing. | sing. |
| 808 | 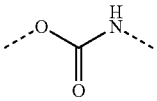 | 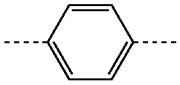 | 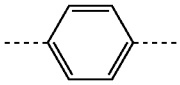 | sing. | sing. |
| 809 | 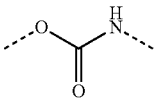 | 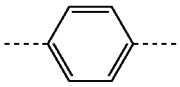 | 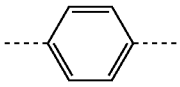 | sing. | sing. |
| 810 | 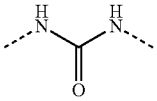 | 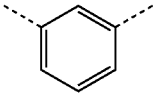 | 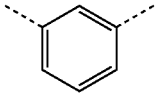 | | |
TABLE 16C
| | A | $B_1$ | $B_3$ | $B_4$ |
|---|---|---|---|---|
| 812 | 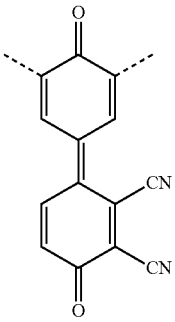 | 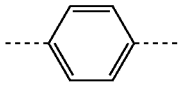 | 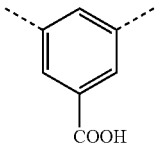 | 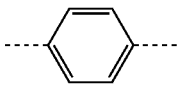 |

TABLE 16C-continued
| | | | | |
|---|---|---|---|---|
| 813 | 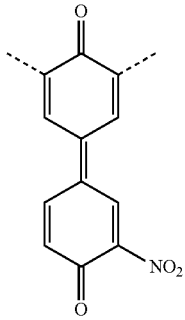 | 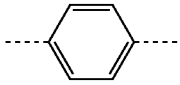 | 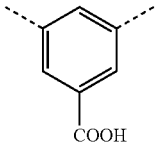 | 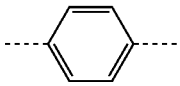 |
| 814 | 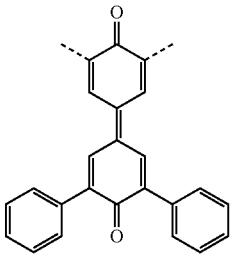 | 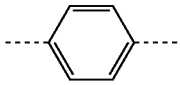 | 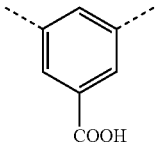 | 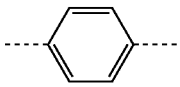 |
| 815 | 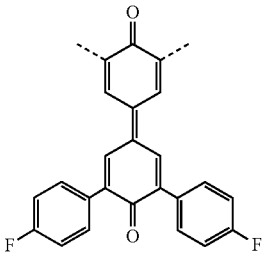 | 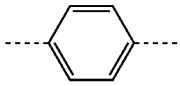 | 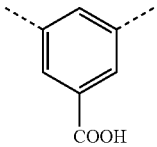 | 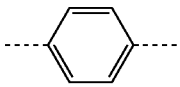 |
| 816 | 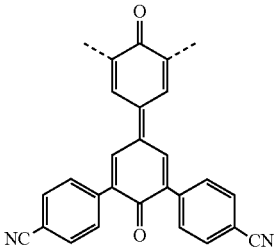 | 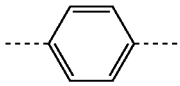 | 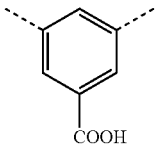 | 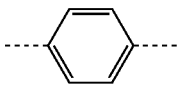 |
| 817 | 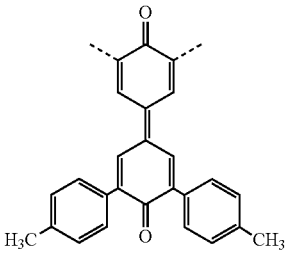 | 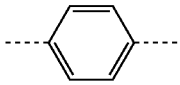 | 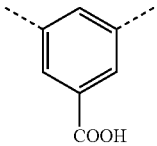 | 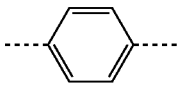 |
| 818 | 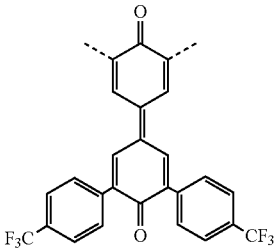 | 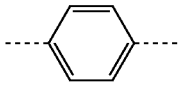 | 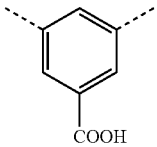 | 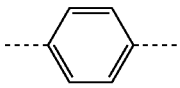 |

TABLE 16C-continued
| | | | | |
|---|---|---|---|---|
| 819 | 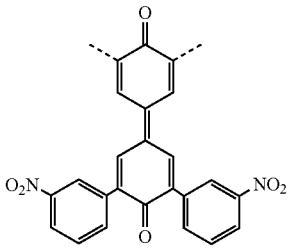 | 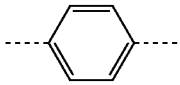 | 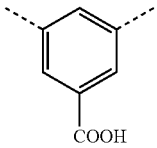 | 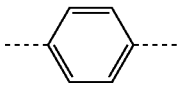 |
| 820 | 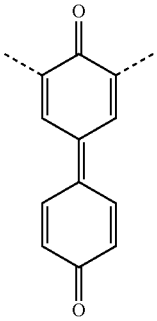 | 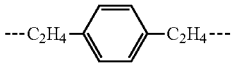 | 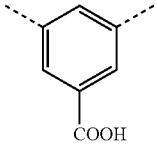 | 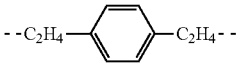 |
| 821 | 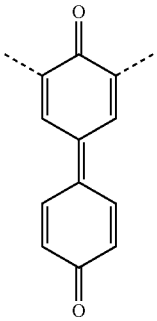 | 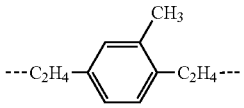 | 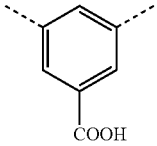 | 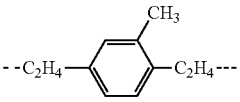 |
| 822 | 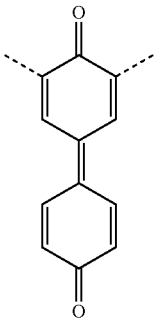 | 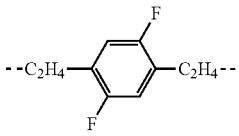 | 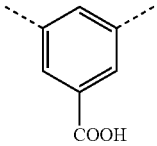 | 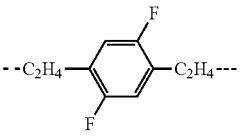 |
| 823 | 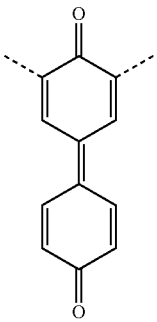 | 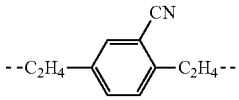 | 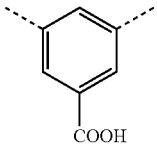 | 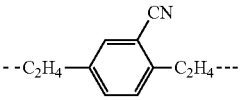 |

TABLE 16C-continued
| | | | | |
|---|---|---|---|---|
| 824 | 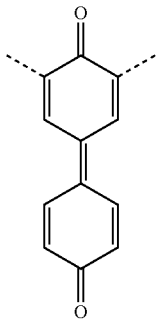 | 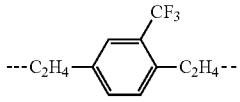 | 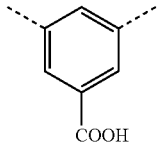 | 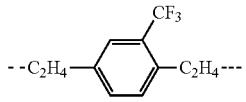 |
| 825 | 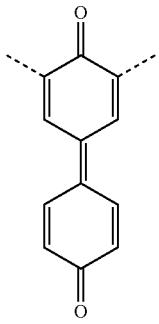 | 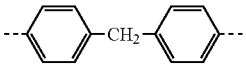 | 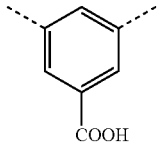 | 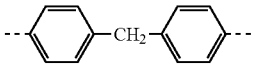 |
| 826 | 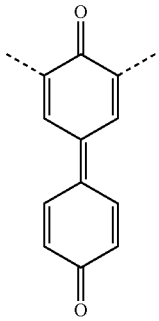 | 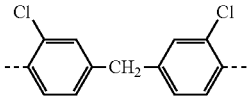 | 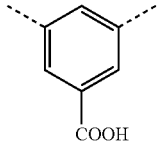 | 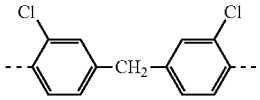 |
| 827 | 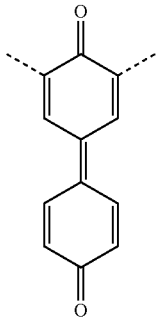 | 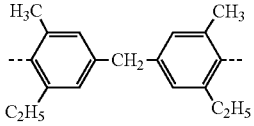 | 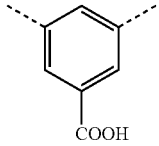 | 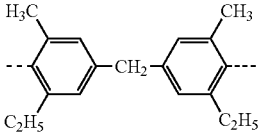 |
| 828 | 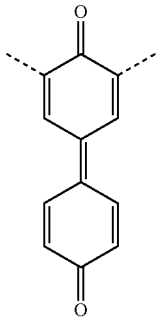 | 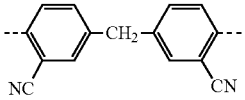 | 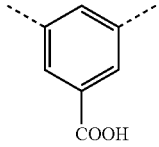 | 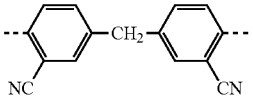 |

TABLE 16C-continued
| | | | | |
|---|---|---|---|---|
| 829 | 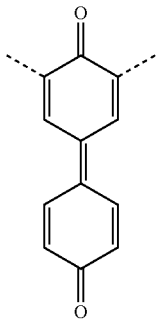 | 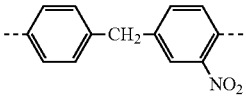 | 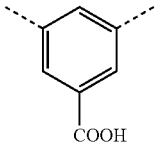 | 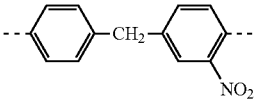 |
| 830 | 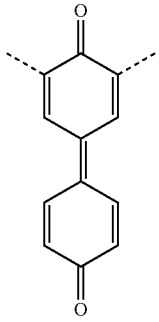 | 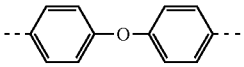 | 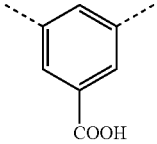 | 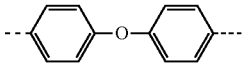 |
| 831 | 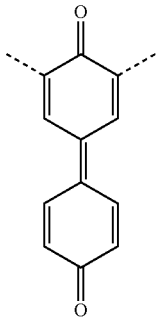 | 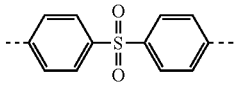 | 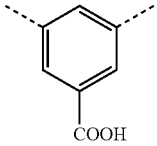 | 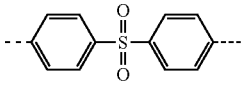 |
| 832 | 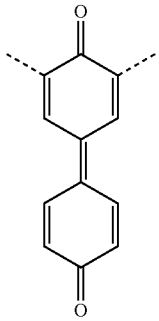 | ----$C_2H_4$—O—$C_2H_4$---- | 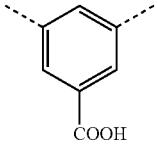 | ----$C_2H_4$—O—$C_2H_4$---- |
| 833 | 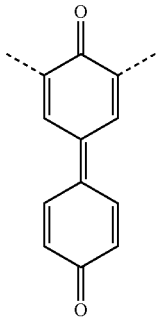 | 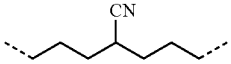 | 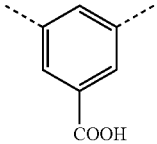 | 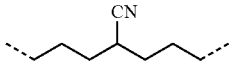 |

TABLE 16C-continued
| | | | | |
|---|---|---|---|---|
| 834 | 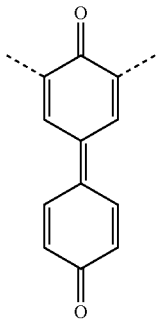 | 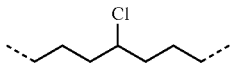 | 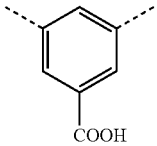 | 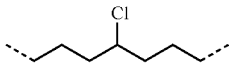 |
| 835 | 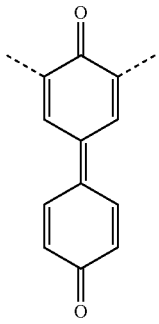 | 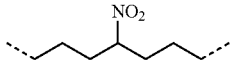 | 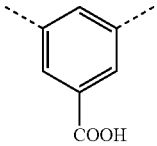 | 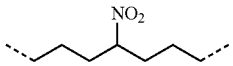 |
| 836 | 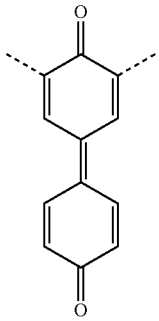 | 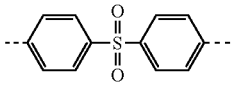 | 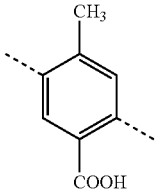 | 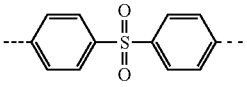 |
| 837 | 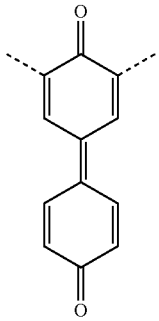 | 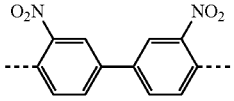 | 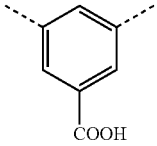 | 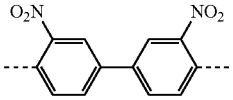 |
| 838 | 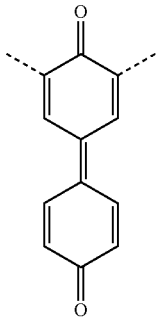 | 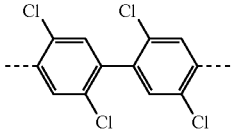 | 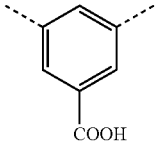 | 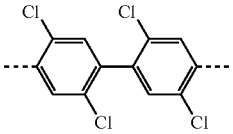 |

TABLE 16C-continued
| | | | | |
|---|---|---|---|---|
| 839 | 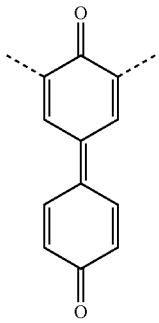 | 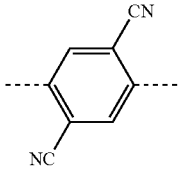 | 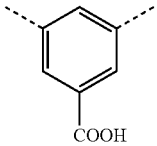 | 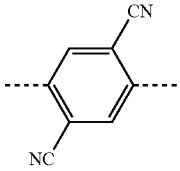 |
| 840 | 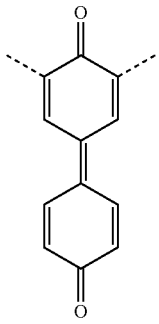 | 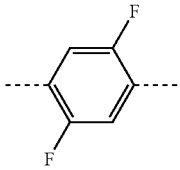 | 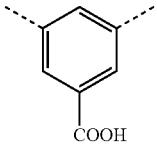 | 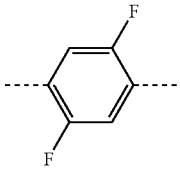 |
| 841 | 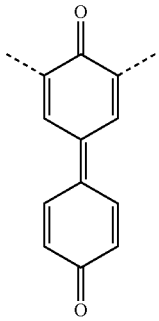 | 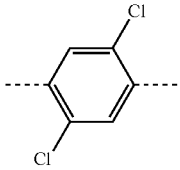 | 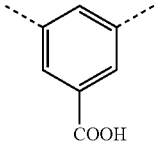 | 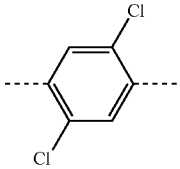 |
| 842 | 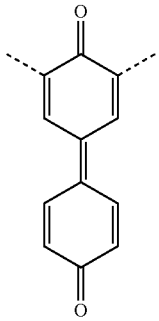 | ----$(CH_2)_2$---- | 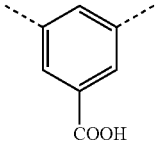 | ----$(CH_2)_2$---- |
| 843 | 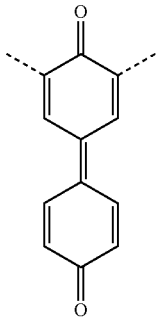 | ----$(CH_2)_{16}$---- | 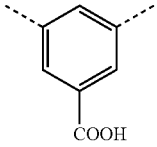 | ----$(CH_2)_{16}$---- |

TABLE 16C-continued
| | | | | | | |
|---|---|---|---|---|---|---|
| 844 | 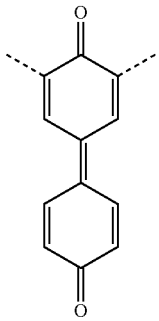 | 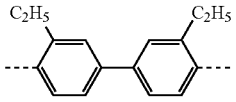 | 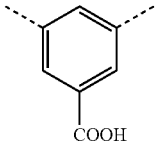 | 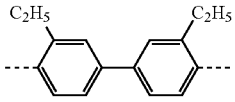 | | |
| | $W_1$ | $W_3$ | $Z_1$ | $Z_2$ | $Z_5$ | $Z_8$ |
| 812 | 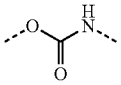 | 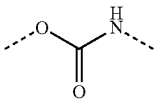 | 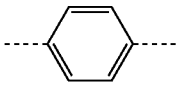 | 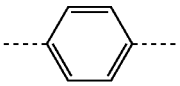 | sing. | sing. |
| 813 | 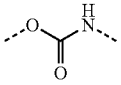 | 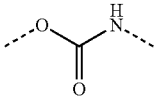 | 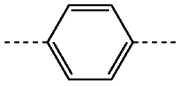 | 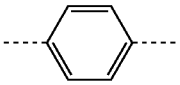 | sing. | sing. |
| 814 | 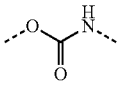 | 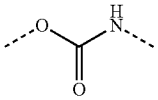 | 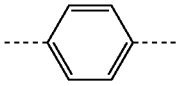 | 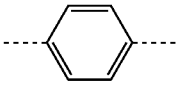 | sing. | sing. |
| 815 | 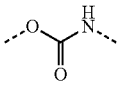 | 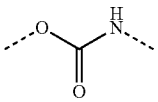 | 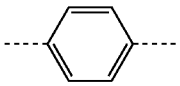 | 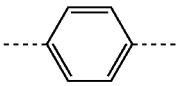 | sing. | sing. |
| 816 | 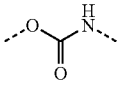 | 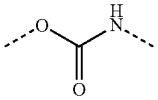 | 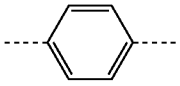 | 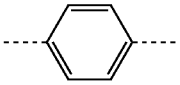 | sing. | sing. |
| 817 | 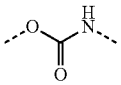 | 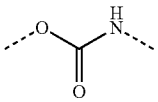 | 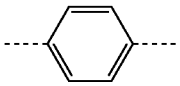 | 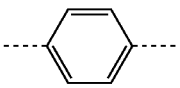 | sing. | sing. |
| 818 | 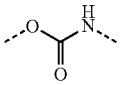 | 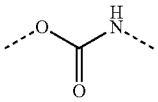 | 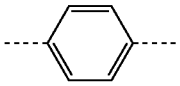 | 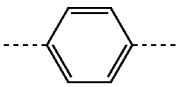 | sing. | sing. |
| 819 | 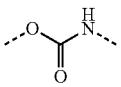 | 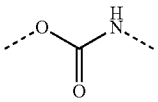 | 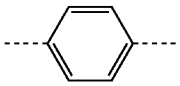 | 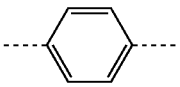 | sing. | sing. |
| 820 | 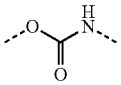 | 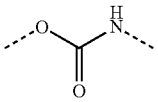 | 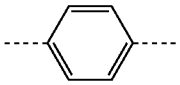 | 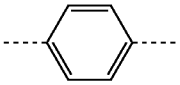 | sing. | sing. |
| 821 | 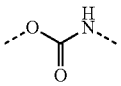 | 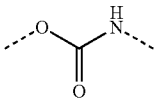 | 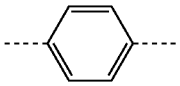 | 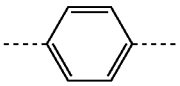 | sing. | sing. |
| 822 | 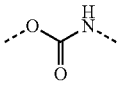 | 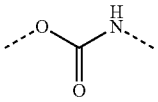 | 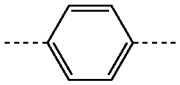 | 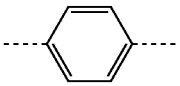 | sing. | sing. |

TABLE 16C-continued
| | | | | | | |
|---|---|---|---|---|---|---|
| 823 | 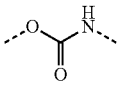 | 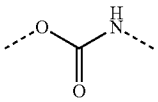 | 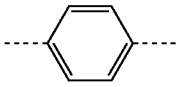 | 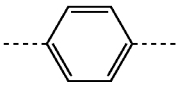 | sing. | sing. |
| 824 | 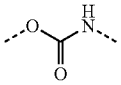 | 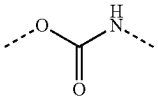 | 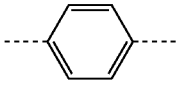 | 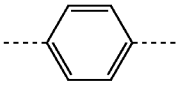 | sing. | sing. |
| 825 | 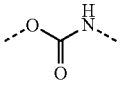 | 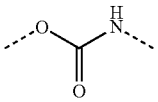 | 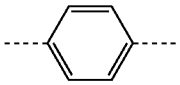 | 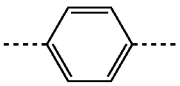 | sing. | sing. |
| 826 | 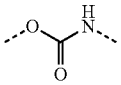 | 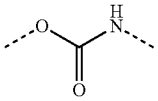 | 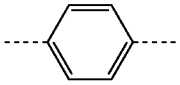 | 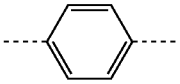 | sing. | sing. |
| 827 | 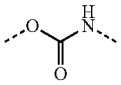 | 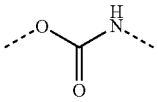 | 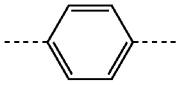 | 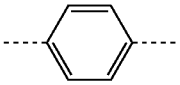 | sing. | sing. |
| 828 | 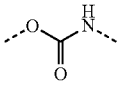 | 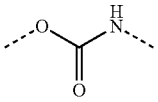 | 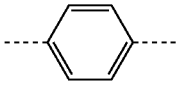 | 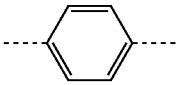 | sing. | sing. |
| 829 | 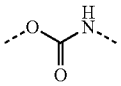 | 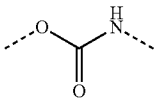 | 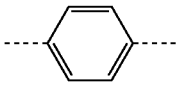 | 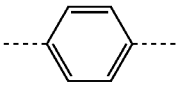 | sing. | sing. |
| 830 | 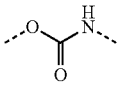 | 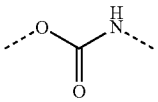 | 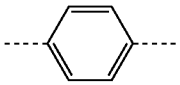 | 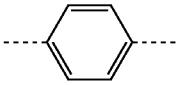 | sing. | sing. |
| 831 | 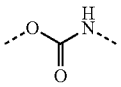 | 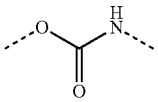 | 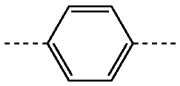 | 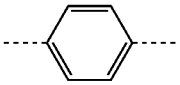 | sing. | sing. |
| 832 | 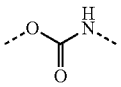 | 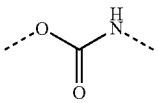 | 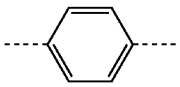 | 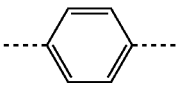 | sing. | sing. |
| 833 | 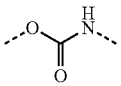 | 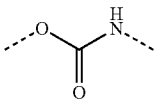 | 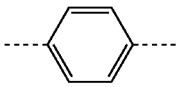 | 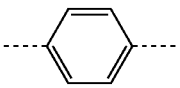 | sing. | sing. |
| 834 | 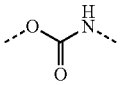 | 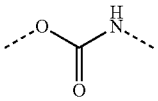 | 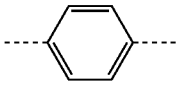 | 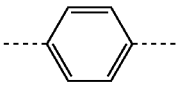 | sing. | sing. |
| 835 | 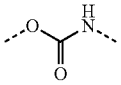 | 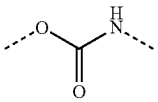 | 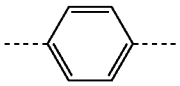 | 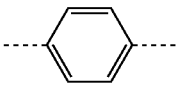 | sing. | sing. |
| 836 | 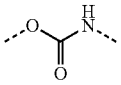 | 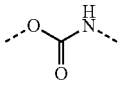 | 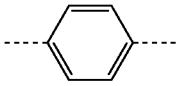 | 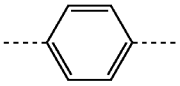 | sing. | sing. |

TABLE 16C-continued

| | | | | | | |
|---|---|---|---|---|---|---|
| 837 | 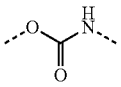 | 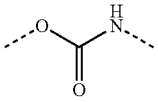 | 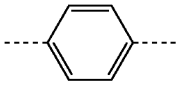 | 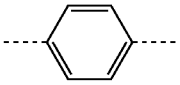 | sing. | sing. |
| 838 | 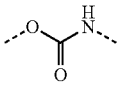 | 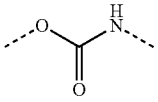 | 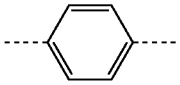 | 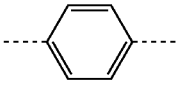 | sing. | sing. |
| 839 | 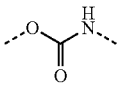 | 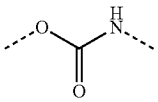 | 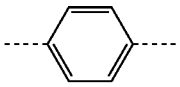 | 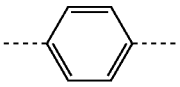 | sing. | sing. |
| 840 | 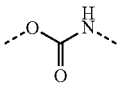 | 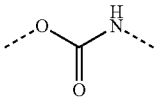 | 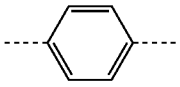 | 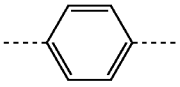 | sing. | sing. |
| 841 | 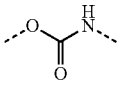 | 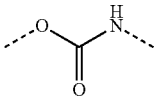 | 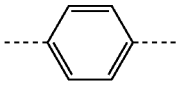 | 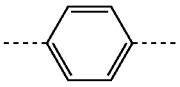 | sing. | sing. |
| 842 | 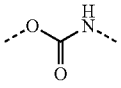 | 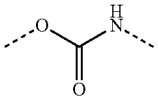 | 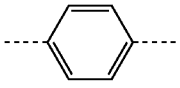 | 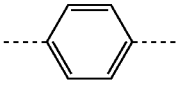 | sing. | sing. |
| 843 | 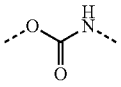 | 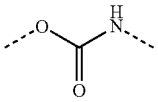 | 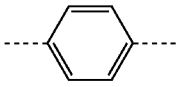 | 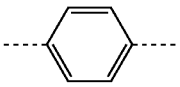 | sing. | sing. |
| 844 | 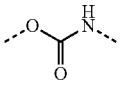 | 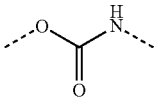 | 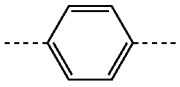 | 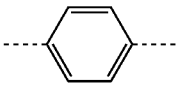 | sing. | sing. |

The copolymer used in the present invention may preferably have a molecular weight in the range of, but not particularly limited to, from 5,000 to 15,000 in weight average molecular weight (Mw). The copolymer used in the present invention may also be synthesized through, but not particularly limited to, e.g., the following reaction process, in order to form the bonds or linkages of $W_1$ to $W_3$ in the formulas (1) to (3).

Where the linkages of $W_1$ to $W_3$ are urethane linkages, the copolymer may be formed by, e.g., allowing a compound having a hydroxyl group to react with a compound having an isocyanate group ("The Foundation and Application of Polyurethane", CMC Publishing Co., Ltd., p. 3, 1986). In the present invention, however, the reaction is by no means limited to this reaction.

Where the linkages of $W_1$ to $W_3$ are urea linkages, the copolymer may be formed by allowing a compound having an amino group to react with a compound having an isocyanate group ("The Synthesis and Reaction of High Polymers (2)", Kyoritu Shuppan Co., Ltd., p. 326, 1991). In the present invention, however, the reaction is by no means limited to this reaction.

Where the linkages of $W_1$ to $W_3$ are imide linkages, the copolymer may be formed by allowing a compound having an acid dianhydride group to react with a compound having an amino group ("The Dictionary of High Polymers", Maruzen Co., Ltd., p. 1001, 1994). In the present invention, however, the reaction is by no means limited to this reaction.

Where the linkages of $W_1$ to $W_3$ are single bonds, the copolymer may be formed by, e.g., coupling reaction carried out using a urea compound and a boric acid derivative as raw materials, under basic conditions and making use of a palladium catalyst, e.g., tetrakis(triphenylphosphine)palladium (Angew. Chem. Int. Ed. 2005, 44, 4442). The single bonds, however, are known to be produced by other various reactions, and in the present invention the reaction is by no means limited to this reaction.

The copolymer used in the present invention may be synthesized by mutually polymerizing the compounds having the above polymerizable functional groups. Where the copolymer is synthesized in this way, it is necessary to first obtain a compound having a polymerizable functional group such as an amino group, a hydroxyl group, an isocyanate group, a halogen group, a boric acid group or an acid anhydride group and also having a skeleton corresponding to any of the above formulas (A-1) to (A-8). Then, it is necessary, using such a compound, to carry out polymerization reaction that forms the bonds or linkages represented by $W_1$ to $W_3$.

Derivatives having the (A-1) structure as a main skeleton (which refers to compounds having the polymerizable functional group and also having the skeleton corresponding to the formula (A-1); the same applies alike hereinafter) may be synthesized by using a synthesis method disclosed in, e.g., U.S. Pat. No. 4,442,193, No. 4,992,349 or No. 5,468,583, or Chemistry of Materials, Vol. 19, No. 11, pp. 2703-2705, 2007). These may be synthesized by the reaction of a naphthalenetetracarboxylic dianhydride with a monoamine derivative; the both being commercially available from, e.g., Tokyo Chemical Industry Co., Ltd., Sigma-Aldrich Japan Co. or Johnson Matthey Japan Incorporated as a reagent.

To make the compound have the polymerizable functional group, available are, e.g., a method in which a skeleton corresponding to the formula (A-1) of what has been synthesized by the above synthesis method is synthesized and thereafter the polymerizable functional group is introduced, and besides a method which makes use of a naphthalenetetracarboxylic dianhydride derivative, or a monoamine derivative, having the polymerizable functional group or a functional group which can be a precursor of the polymerizable functional group, or having a functional group which can combine with other compound having the polymerizable functional group.

A method is also available in which a naphthalenetetracarboxylic dianhydride derivative is allowed to react with a diamine derivative to produce a polymer directly. In this case, $Z_1$ to $Z_6$ and $W_1$ to $W_3$ in the formulas (1) to (3) are single bonds.

Derivatives having the (A-2) structure as a main skeleton may be synthesized by using a synthesis method disclosed in, e.g., Journal of the American Chemical Society, Vol. 129, No. 49, pp. 15259-78, 2007, and may be synthesized by the reaction of a perylenetetracarboxylic dianhydride derivative with a monoamine derivative; the both being commercially available from, e.g., Tokyo Chemical Industry Co., Ltd., Sigma-Aldrich Japan Co. or Johnson Matthey Japan Incorporated as a reagent.

To make the compound have the polymerizable functional group, available are, e.g., a method in which a skeleton corresponding to the formula (A-2) of what has been synthesized by the above synthesis method is synthesized and thereafter the polymerizable functional group is introduced, and besides a method which makes use of a perylenetetracarboxylic dianhydride derivative, or a monoamine derivative, having the polymerizable functional group or a functional group which can be a precursor of the polymerizable functional group, or having a functional group which can combine with other compound having the polymerizable functional group.

A method is also available in which a perylenetetracarboxylic dianhydride derivative is allowed to react with a diamine derivative to produce a polymer directly. In this case, $Z_1$ to $Z_6$ and $W_1$ to $W_3$ in the formulas (1) to (3) are single bonds.

Some derivatives having the (A-3) structure as a main skeleton are commercially available from, e.g., Tokyo Chemical Industry Co., Ltd., Sigma-Aldrich Japan Co. or Johnson Matthey Japan Incorporated as reagents. Then, these may also be synthesized, using a commercially available phenanthrene derivative or phenanthroline derivative as a material, by a synthesis method disclosed in Bull. Chem. Soc., Jpn., Vol. 65, pp. 1006-1011, 1992, Chem. Educator No. 6, pp. 227-234, 2001, Journal of Synthetic Organic Chemistry, Japan, Vol. 15, pp. 29-32, 1957, or Journal of Synthetic Organic Chemistry, Japan, Vol. 15, pp. 32-34, 1957. A dicyanomethylene group may also be introduced by the reaction with malononitrile.

To make the compound have the polymerizable functional group, available are, e.g., a method in which a skeleton corresponding to the formula (A-3) of what has been synthesized by the above synthesis method is synthesized and thereafter the polymerizable functional group is introduced, and besides a method in which a structure having the polymerizable functional group or a functional group which can be a precursor of the polymerizable functional group is introduced (e.g., a process carried out by cross-coupling reaction making use of a palladium catalyst, using a halide of a phenanthrene derivative or phenanthroline derivative as a material).

Some derivatives having the (A-4) structure as a main skeleton are commercially available from, e.g., Tokyo Chemical Industry Co., Ltd., Sigma-Aldrich Japan Co. or Johnson Matthey Japan Incorporated as reagents. Then, these may also be synthesized, using a commercially available acenaphthenequinone derivative as a material, by a synthesis method disclosed in Tetrahedron Letters, 43(16), pp. 2991-2994, 2002, or Tetrahedron Letters, 44(10), pp. 2087-2091, 2003. A dicyanomethylene group may also be introduced by the reaction with malononitrile.

To make the compound have the polymerizable functional group, available are, e.g., a method in which a skeleton corresponding to the formula (A-4) of what has been synthesized by the above synthesis method is synthesized and thereafter the polymerizable functional group is introduced, and besides a method in which a structure having the polymerizable functional group or a functional group which can be a precursor of the polymerizable functional group is introduced (e.g., a process carried out by cross-coupling reaction making use of a palladium catalyst, using a halide of an acenaphthenequinone derivative as a material).

Some derivatives having the (A-5) structure as a main skeleton are commercially available from, e.g., Tokyo Chemical Industry Co., Ltd., Sigma-Aldrich Japan Co. or Johnson Matthey Japan Incorporated as reagents. Then, these may also be synthesized, using a commercially available compound as a material, by a synthesis method disclosed in Synthesis, Vo. 5, pp. 388-389, 1988. A dicyanomethylene group may also be introduced by the reaction with malononitrile.

To make the compound have the polymerizable functional group, available are, e.g., a method in which a skeleton corresponding to the formula (A-5) of what has been synthesized by the above synthesis method is synthesized and thereafter the polymerizable functional group is introduced, and besides a method in which a structure having the polymerizable functional group or a functional group which can be a precursor of the polymerizable functional group is introduced (e.g., a process carried out by cross-coupling reaction making use of a palladium catalyst, using a halide of an anthraquinone derivative as a material).

Derivatives having the (A-6) structure as a main skeleton may be synthesized by using a synthesis method disclosed in U.S. Pat. No. 4,562,132, using a fluorenone derivative and malononitrile; the former being commercially available from, e.g., Tokyo Chemical Industry Co., Ltd., Sigma-Aldrich Japan Co. or Johnson Matthey Japan Incorporated as a reagent.

To make the compound have the polymerizable functional group, available are, e.g., a method in which a skeleton corresponding to the formula (A-6) of what has been synthesized by the above synthesis method is synthesized and thereafter the polymerizable functional group is introduced, and besides a method in which a structure having the polymerizable functional group or a functional group which can be a precursor of the polymerizable functional group is introduced.

Derivatives having the (A-7) structure as a main skeleton may be synthesized by using a synthesis method disclosed in Japanese Patent Application Laid-open No. H05-279582 or No. H07-70038, using a fluorenone derivative and an aniline derivative; the both being commercially available from, e.g., Tokyo Chemical Industry Co., Ltd., Sigma-Aldrich Japan Co. or Johnson Matthey Japan Incorporated as a reagent.

To make the compound have the polymerizable functional group, available are, e.g., a method in which a skeleton corresponding to the formula (A-7) of what has been synthesized by the above synthesis method is synthesized and thereafter the polymerizable functional group is introduced, and besides a method in which a structure having the polymerizable functional group or a functional group which can be a precursor of the polymerizable functional group is introduced and a method which makes use of, as the above aniline derivative, an aniline derivative having the polymerizable functional group or a functional group which can be a precursor of the polymerizable functional group, or having a functional group which can combine with other compound having the polymerizable functional group.

Derivatives having the (A-8) structure as a main skeleton may be synthesized by using a synthesis method disclosed in Japanese Patent Application Laid-open No. H01-206349 or PPCI/Japan Hardcopy '98 Papers, p. 207, 1998, and may be synthesized by using as a raw material a phenol derivative commercially available from, e.g., Tokyo Chemical Industry Co., Ltd. or Sigma-Aldrich Japan Co. as a reagent.

To make the compound have the polymerizable functional group, available are, e.g., a method in which a skeleton corresponding to the formula (A-8) of what has been synthesized by the above synthesis method is synthesized and thereafter the polymerizable functional group is introduced, and besides a method in which a structure having the polymerizable functional group or a functional group which can be a precursor of the polymerizable functional group is introduced.

Derivatives having as main skeletons the structures according to $B_1$ to $B_4$ (which refer to those into which the above polymerizable functional group has been introduced at the sites of bonding of the $B_1$ to $B_4$ divalent groups to the Z's; the $B_1$ to $B_4$ are hereinafter also "B's" collectively) are commercially available from, e.g., Tokyo Chemical Industry Co., Ltd. or Sigma-Aldrich Japan Co. as reagents. These may also be synthesized by introducing the polymerizable functional group into commercially available compounds. Such commercially available products may include, e.g., as commercially available products of isocyanate-containing compounds, TAKENATE and COSMONATE, available from Mitsui Takeda Chemicals, Inc.; DURANATE, available from Asahi Chemical Industry Co., Ltd.; and NIPPOLAN, available from Nippon Polyurethane Industry Co., Ltd. As commercially available products of amino group-containing compounds, they may include POLYMENT, available from Nippon Shokubai Co., Ltd.; and "2100 Series", available from Three Bond Co., Ltd. Also, as commercially available products of hydroxyl group-containing compounds, they may include TAKELAC, available from Mitsui Chemicals Polyurethane, Inc.; and POLYLITE, available from DIC Corporation.

Of the B's, $B_2$ and $B_3$ are each required to have a carboxyl group. Accordingly, in order to incorporate such a structure into the copolymer, a method is available in which a compound having a structure containing the carboxyl group is further polymerized into the derivatives having as main skeletons the $B_2$ and $B_3$ structures each having the polymerizable functional group, or a compound having a structure containing a functional group which can be derived into the carboxyl group after being polymerized, such as a carboxylate group.

The copolymer and so forth used in the present invention were confirmed by the following methods.

Confirmation of raw materials for synthesizing copolymer:

Raw materials were confirmed by mass spectrometry.

Using a mass spectrometer (MALDI-TOF MS; ultraflex, manufactured by Bruker Daltonics Corp.), molecular weight was measured under conditions of accelerating voltage: 20 kV; mode: reflector; and molecular-weight standard molecule: $C_{60}$ fullerene. Confirmation was made by peak top values obtained.

Confirmation of Copolymer:

Its structures were confirmed by NMR. The structures were confirmed by $^1$H-NMR and $^{13}$C-NMR analysis (FT-NMR: JNM-EX400 Model, manufactured by JEOL Ltd.) at 120° C. in 1,1,2,2-tetrachloroethane (d2) or dimethyl sulfoxide (d6). For the quantitative determination of carboxyl group content, the content of carboxyl groups in the copolymer was also quantitatively determined by using FT-IR, and preparing a calibration curve based on absorption of carboxyl groups, using samples in which benzoic acid was added to KBr powder in different amounts by using a KBr-tab method.

As methods for forming the layers that constitute the electrophotographic photosensitive member, such as the charge generation layer, the hole transport layer and the electron transport layer, methods are preferable in which coating fluids prepared by dissolving or dispersing materials making up the respective layers are coated to form the layers. Methods for coating may include, e.g., dip coating, spray coating, curtain coating and spin coating. From the viewpoint of efficiency and productivity, dip coating is preferred.

The process cartridge of the present invention is a process cartridge which integrally supports the electrophotographic photosensitive member of the present invention and at least one device selected from the group consisting of a charging device, a developing device, a transfer device and a cleaning device, and is detachably mountable to the main body of an electrophotographic apparatus.

The electrophotographic apparatus of the present invention is an electrophotographic apparatus comprising the electrophotographic photosensitive member of the present invention, a charging device, an exposure device, a developing device and a transfer device.

FIG. 1 schematically illustrates the construction of an electrophotographic apparatus provided with a process cartridge having the electrophotographic photosensitive member of the present invention.

In FIG. 1, reference numeral 1 denotes a drum-shaped electrophotographic photosensitive member of the present invention, which is rotatingly driven around an axis 2 in the direction of an arrow at a stated peripheral speed. The electrophotographic photosensitive member 1 is, in the course of its rotation, uniformly electrostatically charged on its surface (peripheral surface) to a positive or negative, given potential through a charging device 3 (e.g., a contact primary charging device or a non-contact primary charging device). The electrophotographic photosensitive member thus charged is then exposed to exposure light 4 (e.g., laser light) emitted from an exposure device (not shown) for slit exposure or laser beam scanning exposure. In this way, electrostatic latent images are successively formed on the surface of the electrophotographic photosensitive member 1.

The electrostatic latent images thus formed are then developed with a toner held in a developing device 5 (which may be either of a contact type and a non-contact type). The toner images thus formed are successively transferred through a transfer device 6 to a transfer material 7 (e.g., paper) fed from a paper feed section (not shown) to the part between the electrophotographic photosensitive member 1 and the transfer device 6 (e.g., a transfer charging assembly) in the manner synchronized with the rotation of the electrophotographic photosensitive member 1.

The transfer material 7 to which the toner images have been transferred is separated from the surface of the electrophotographic photosensitive member, is guided into a fixing device 8, where the toner images are fixed, and is then put out of the apparatus as a duplicate (a copy).

The surface of the electrophotographic photosensitive member 1 from which the toner images have been transferred is brought to removal of transfer residual toner through a cleaning device 9. Thus the electrophotographic photosensitive member is cleaned on its surface, and is further subjected to charge elimination by pre-exposure light emitted from a pre-exposure device (not shown), and then repeatedly used for the formation of images.

The charging device 3 may be either of a scorotron charging assembly and a corotron charging assembly, which utilizes corona discharge. A contact charging device may also be used which makes use of, e.g., a roller-shaped, blade-shaped or brush-shaped charging member.

In the present invention, the above electrophotographic photosensitive member 1 and at least one device selected from the constituents such as the charging device 3, the developing device 5, the transfer device 6 and the cleaning device 9 may be so set up as to be integrally joined as a process cartridge. This process cartridge may be so set up as to be detachably mountable to the main body of an electrophotographic apparatus such as a copying machine or a laser beam printer.

For example, at least one device of the charging device 3, the developing device 5 and the cleaning device 9 may integrally be supported together with the electrophotographic photosensitive member 1 to form a cartridge to set up a process cartridge 10 detachably mountable to the main body of the electrophotographic apparatus through a guide such as rails 11 and 12 provided in the main body of the electrophotographic apparatus.

In the case when the electrophotographic apparatus is a copying machine or a printer, the exposure light 4 is light reflected from, or transmitted through, an original; or light irradiated by the scanning of a laser beam, the driving of an LED array or the driving of a liquid crystal shutter array according to signals obtained by reading an original through a sensor and converting the information into signals.

The electrophotographic photosensitive member in the present invention is adaptable to electrophotographic apparatus in general, such as copying machines, laser beam printers, LED printers, and liquid-crystal shutter printers. It may further be widely applicable to display, recording, light printing, platemaking, facsimile and the like equipment to which electrophotographic techniques have been applied.

EXAMPLES

The present invention is described below in greater detail by giving specific working examples. Note, however, that the present invention is by no means limited to these.

Synthesis examples of the copolymer to be incorporated in the photosensitive layer of the electrophotographic photosensitive member of the present invention are given first. Note, however, that the synthesis of the copolymer used in the present invention is by no means limited to the following compounds and synthesis methods.

Herein, the molecular weight of each copolymer having been synthesized was measured by GPC (measured with a gel permeation chromatograph "HLC-8120", manufactured by Tosoh Corporation, and calculated in terms of polystyrene).

Synthesis Example 1

Copolymer of Exemplary Compound 101

To 200 parts by mass of dimethylacetamide, 5.4 parts by mass of naphthalenetetracarboxylic dianhydride, 2.1 parts by mass of 1,4-phenylenediamine and 0.15 part by mass of 3,5-diaminobenzoic acid were added in an atmosphere of nitrogen, and these were stirred at room temperature for 1 hour. After these raw materials became dissolved, reflux was carried out for 8 hours, and the precipitate formed was separated by filtration, followed by washing with acetone to obtain 6.2 parts by mass of an object copolymer (Exemplary Compound 101). The product obtained stood particulate.

Synthesis Example 2

Copolymer of Exemplary Compound 102

To 200 parts by mass of dimethylacetamide, 8.2 parts by mass of dibromonaphthalenetetracarboxylic dianhydride synthesized by the synthesis method described in Chemistry of Materials, Vol. 19, No. 11, pp. 2703-2705 (2007), 2.1 parts by mass of 1,4-phenylenediamine and 0.15 part by mass of 3,5-diaminobenzoic acid were added in an atmosphere of nitrogen, and these were stirred at room temperature for 1 hour. After these raw materials became dissolved, reflux was carried out for 8 hours, and the precipitate formed was separated by filtration, followed by washing with acetone to obtain 7.5 parts by mass of an object copolymer (Exemplary Compound 102). The product obtained stood particulate.

Synthesis Example 3

Copolymer of Exemplary Compound 125

To 200 parts by mass of dimethylacetamide, 5.4 parts by mass of naphthalenetetracarboxylic dianhydride and 4.4 parts by mass of 4-hydroxyaniline were added in an atmosphere of nitrogen, and these were stirred at room temperature for 1 hour. After these raw materials became dissolved, reflux was carried out for 8 hours, and the precipitate formed was separated by filtration, followed by recrystallization with ethyl acetate to obtain 5.0 parts by mass of a compound represented by the following structural formula.

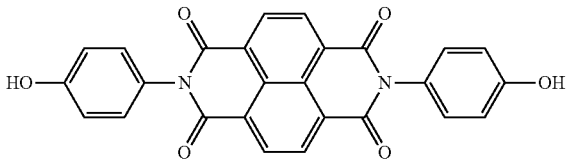

To 4.3 parts by mass of the compound represented by the above structural formula, 1.6 parts by mass of 1,4-phenylene diisocyanate and 0.08 part by mass of 3,5-dihydroxybenzoic acid were added, and reflux was carried out for 8 hours in toluene, and the precipitate formed was separated by filtration, followed by washing with acetone to obtain 3.6 parts by mass of an object copolymer (Exemplary Compound 125). The product obtained stood particulate.

Synthesis Example 4

Copolymer of Exemplary Compound 304

To 20 parts by mass of diaminophenanthrenequinone synthesized by the synthesis method described in Journal of Synthetic Organic Chemistry, Japan, Vol. 15, pp. 29-32 (1957) and Journal of Synthetic Organic Chemistry, Japan, Vol. 15, pp. 32-34 (1957), 8 parts by mass of dicyanomethylene malononitrile was added, and reflux was carried out for 12 hours in tetrahydrofuran. After being left to cool, the purple crystals precipitated were separated by filtration, followed by recrystallization with ethyl acetate to obtain 4.8 parts by mass of a compound represented by the following structural formula.

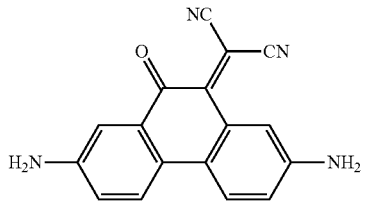

To 200 parts by mass of dimethylacetamide, 4.5 parts by mass of the compound represented by the above structural formula, 0.15 part by mass of 3,5-diaminobenzoic acid and 4.4 parts by mass of pyromellitic anhydride were added in an atmosphere of nitrogen, and these were stirred at room temperature for 1 hour. After these raw materials became dissolved, reflux was carried out for 8 hours, and the precipitate formed was separated by filtration, followed by washing with acetone to obtain 5.2 parts by mass of an object copolymer (Exemplary Compound 304). The product obtained stood particulate.

Synthesis Example 5

Copolymer of Exemplary Compound 310

To a mixed solvent of 100 parts by mass of toluene and 50 parts by mass of ethanol, 2.8 parts by mass of 3-hydroxyphenylboric acid and 7.4 parts by mass of 3,6-dibromo-9,10-phenathrenedion synthesized by the synthesis method described in Chem. Educator No. 6, pp. 227-234 (2001) were added in an atmosphere of nitrogen. To the mixture obtained, 100 parts by mass of an aqueous 20% sodium carbonate solution was dropwise added, and thereafter 0.55 part by mass of tetrakis(triphenylphosphine)palladium (0) was added, followed by reflux for 2 hours. After the reaction, the organic phase was extracted with chloroform, and then washed with water, followed by drying with anhydrous sodium sulfate. The solvent was removed under reduced pressure, and thereafter the residue formed was purified by silica gel chromatography to obtain 5.2 parts by mass of a compound represented by the following structural formula.

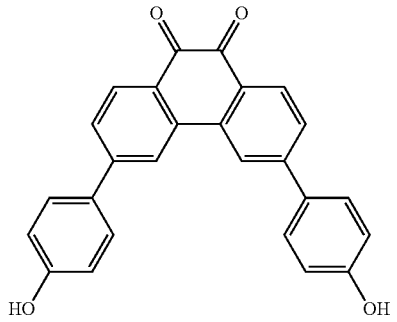

To 3.7 parts by mass of the compound represented by the above structural formula, 1.6 parts by mass of 1,4-phenylene diisocyanate and 0.08 part by mass of 3,5-dihydroxybenzoic acid were added, and reflux was carried out for 12 hours in 100 parts by mass of toluene to obtain 2.2 parts by mass of an object copolymer (Exemplary Compound 310). The product obtained stood particulate.

Next, electrophotographic photosensitive members were produced and evaluated as shown below.

Example 1

An aluminum cylinder (JIS A 3003, aluminum alloy) of 260.5 mm in length and 30 mm in diameter was used as a support (a conductive support).

Next, 50 parts by mass of oxygen deficient $SnO_2$ coated $TiO_2$ particles (powder resistivity: 120 Ω·cm; coverage of $SnO_2$ in mass percentage: 40%) as conductive particles, 40 parts by mass of phenol resin (PLYOPHEN J-325; available from Dainippon Ink & Chemicals, Incorporated; resin solid content: 60%) as a binder resin and 40 parts of methoxypropanol as a solvent (a dispersion medium) were subjected to dispersion for 3 hours by means of a sand mill making use of glass beads of 1 mm in diameter, to prepare a conductive layer coating fluid (a liquid dispersion).

The oxygen deficient $SnO_2$ coated $TiO_2$ particles in this conductive layer coating fluid were 0.33 μm in average particle diameter (measured by centrifugal sedimentation at a number of revolutions of 5,000 rpm, using a particle size distribution meter CAPA700 (trade name), manufactured by Horiba Ltd., and using tetrahydrofuran as a dispersion medium).

This conductive layer coating fluid was dip-coated on the support, and the wet coating formed was dried and cured by heating, at 145° C. for 30 minutes to form a conductive layer of 16 μm in layer thickness.

Next, to 40 parts by mass of particles of the copolymer of Exemplary Compound 101 (the proportion of carboxyl group-containing moiety in this copolymer and its molecular weight were as shown in Table 17), 300 parts by mass of distilled water as a dispersion medium, 500 parts by mass of methanol and 8 parts by mass of triethylamine were added, and these were subjected to dispersion for 2 hours by means of a sand mill making use of glass beads of 1 mm in diameter, to prepare an electron transport layer coating fluid (a liquid dispersion).

Before and after this electron transport layer coating fluid was prepared, the particle diameter of the copolymer was also measured by centrifugal sedimentation at a number of revolutions of 7,000 rpm, using the particle size distribution meter CAPA700 (trade name), manufactured by Horiba Ltd., and using methanol as a dispersion medium. Results obtained are also shown in Table 17.

This electron transport layer coating fluid was dip-coated on the conductive layer, and this was heated at 120° C. for 10 minutes to make the dispersion medium evaporate and at the same time make the particles of the copolymer agglomerate (make them dry) to form an electron transport layer of 1.0 μm in layer thickness.

Next, 10 parts by mass of hydroxygallium phthalocyanine crystals with a crystal form having strong peaks at Bragg angles)(2θ±0.2° ) of 7.5°, 9.9°, 12.5°, 16.3°, 18.6°, 25.1° and 28.3° in CuKα characteristic X-ray diffraction, 5 parts by mass of polyvinyl butyral (trade name: S-LEC BX-1, available from Sekisui Chemical Co., Ltd.) and 260 parts by mass of cyclohexanone were subjected to dispersion for 1.5 hours by means of a sand mill making use of glass beads of 1 mm in diameter. Next, 240 parts of ethyl acetate was added to this to prepare a charge generation layer coating fluid.

This charge generation layer coating fluid was dip-coated on the electron transport layer, and this was dried at 95° C. for 10 minutes to form a charge generation layer of 0.18 μm in layer thickness.

Next, 7 parts by mass of an amine compound (a hole transporting material) represented by the following structural formula:

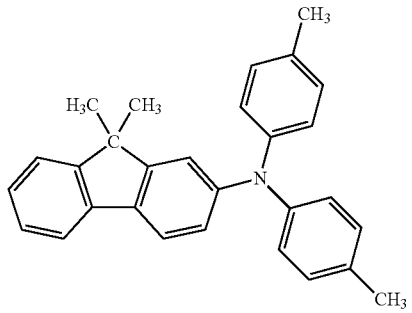

and 10 parts by mass of a polyarylate having a repeating structural unit represented by the following structural formula and of 10,000 in weight average molecular weight (Mw) (measured with a gel permeation chromatograph "HLC-8120", manufactured by Tosoh Corporation, and calculated in terms of polystyrene) were dissolved in a mixed solvent of 30 parts by mass of dimethoxymethane and 70 parts by mass of chlorobenzene to prepare a hole transport layer coating fluid.

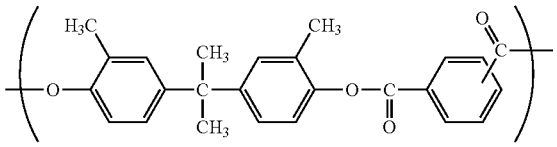

This hole transport layer coating fluid was dip-coated on the charge generation layer, and this was dried at 120° C. for 40 minutes to form a hole transport layer of 18 μm in layer thickness.

Thus, an electrophotographic photosensitive member was produced the hole transport layer of which was a surface layer.

The layer thickness of the conductive layer, electron transport layer and hole transport layer each was determined in the following way: Using a sample prepared by winding an aluminum sheet on an aluminum cylinder having the same size as the above support and forming thereon, under the same conditions as the above, films corresponding to the conductive layer, electron transport layer and hole transport layer, the layer thickness of each layer at six spots at the middle portion of the sample was measured with a dial gauge (2109FH, manufactured by Mitutoyo Corporation, and an average of the values thus obtained was calculated.

To determine the layer thickness of the charge generation layer, a sample prepared by forming in the same way as the above a film corresponding to the charge generation layer was cut out at its middle portion by 100 mm×50 mm in area, and the film at that area was wiped off with acetone, where the layer thickness was calculated from the weights measured before and after the film was wiped off (calculated at a density of 1.3 g/cm$^3$).

The electrophotographic photosensitive member produced was set in a laser beam printer LBP-2510, manufactured by CA° NON INC. in an environment of 23° C. and 50% RH, and its surface potential and images having been reproduced were evaluated. Details are as set out below.

Surface Potential Evaluation:

A process cartridge for cyan color of the above laser beam printer LBP-2510 was converted to attach a potential probe (Model 6000B-8, manufactured by Trek Japan Corporation) to the position of development, and the potential at the middle portion of the electrophotographic photosensitive member (photosensitive drum) was measured with a surface potentiometer (Model 1344, manufactured by Trek Japan Corporation) to evaluate the surface potential. The amount of light was so set that dark-area potential was −500 V and light-area potential was −100 V. Incidentally, in other Examples each, the amount of light that was the same as that for bringing the light-area potential to −100 V in this Example 1 was used as the amount of light in evaluating the light-area potential.

Image Evaluation:

The electrophotographic photosensitive member produced was set in the process cartridge for cyan color of the laser beam printer LBP-2510. This process cartridge was set at the station of the cyan process cartridge, and images were reproduced. On that occasion, the amount of light was so set that dark-area potential was −500 V and light-area potential was −100 V.

First, using A4-size plain paper, full-color images (character images of 1% in print percentage for each color) were reproduced on 3,000 sheets of paper.

Thereafter, images were continuously reproduced in the order of solid white image (1 sheet), ghost image (5 sheets), solid black image (1 sheet) and ghost image (5 sheets).

Figure 2:
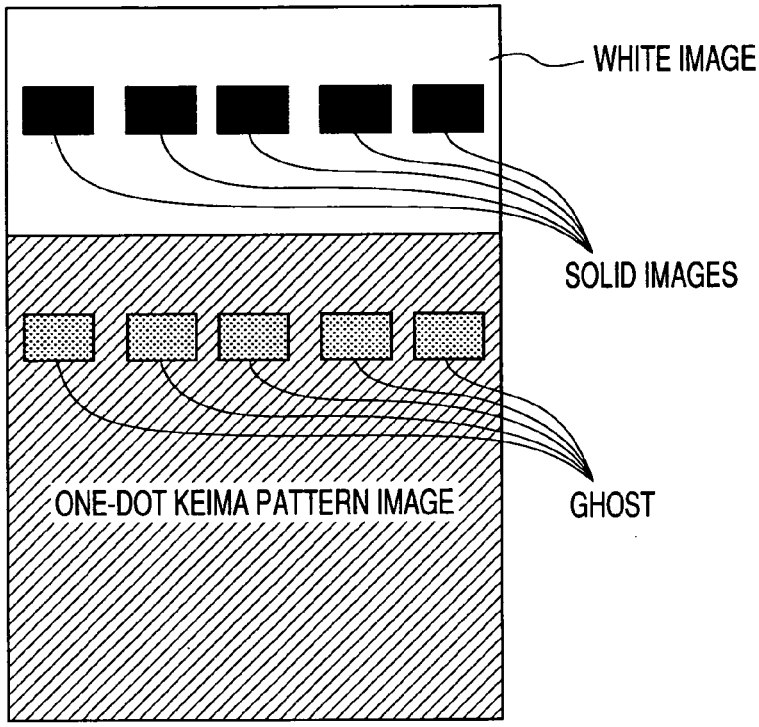
FIG. 2 is a view to illustrate ghost images (a print for evaluation on ghost).
Figure 3:
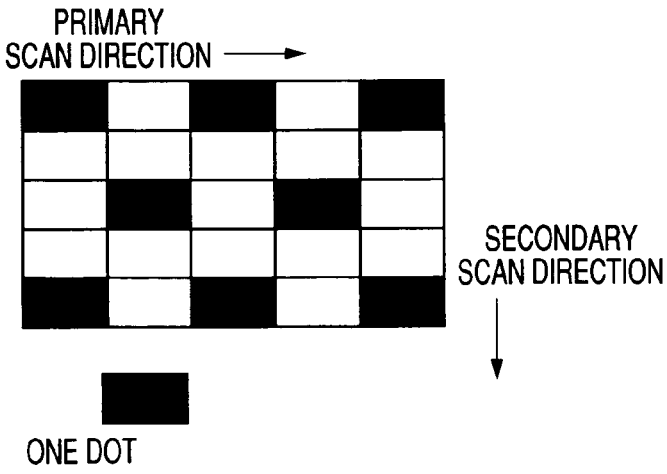
FIG. 3 is a view to illustrate an image of one-dot "Keima" pattern (the "Keima" patter is similar to knight's move pattern).

The ghost images are those in which square images in solid were reproduced at the leading head area of image as shown in FIG. 2 and thereafter a halftone image was formed in a one-dot "Keima" pattern as shown in FIG. 3.

The ghost images were evaluated by measuring the difference in density between the image density of the one-dot "Keima" pattern and the image density of ghost areas. The difference in density was measured at 10 spots in ghost images on one sheet by using a spectral densitometer (trade name: X-Rite 504/508, manufactured by X-Rite Ltd.). This operation was conducted for all the ghost images on the 10 sheets, and an average of values at 100 spots was calculated. The results are shown in Table 17. Images higher in density at the ghost areas are positive ghost images. This difference in density (Macbeth density difference) means that, the smaller the value is, the less the positive ghost images have been made to occur.

Examples 2 to 11

Electrophotographic photosensitive members were produced in the same way as in Example 1 except that the copolymer used in the electron transport layer was changed for the copolymers shown respectively in Table 17. Evaluation was made in the same way. The results are shown in Table 17.

Example 12

An electrophotographic photosensitive member was produced in the same way as in Example 1 except that the copolymer used in the electron transport layer was changed for the copolymer shown in Table 17 and that 10 parts by mass of a polyamide resin (TORESIN EF30T, available from Nagase ChemteX Corporation) was further added when the electron transport layer coating fluid was prepared. Evaluation was made in the same way. The results are shown in Table 17.

Examples 13 to 18

Electrophotographic photosensitive members were produced in the same way as in Example 1 except that the copolymer used in the electron transport layer was changed for the copolymers shown respectively in Table 17. Evaluation was made in the same way. The results are shown in Table 17.

Example 19

An electrophotographic photosensitive member was produced in the same way as in Example 1 except that the copolymer used in the electron transport layer was changed for the copolymer shown in Table 17 and that 10 parts by mass of a polyamide resin (TORESIN EF30T, available from Nagase ChemteX Corporation) was further added when the electron transport layer coating fluid was prepared. Evaluation was made in the same way. The results are shown in Table 17.

Examples 20 to 27

Electrophotographic photosensitive members were produced in the same way as in Example 1 except that the copolymer used in the electron transport layer was changed for the copolymers shown respectively in Table 17.

Evaluation was made in the same way. The results are shown in Table 17.

Examples 28 to 30

Electrophotographic photosensitive members were produced in the same way as in Example 1 except that the copolymer used in the electron transport layer was changed for the copolymers shown respectively in Table 17 and that, in Examples 28, 29 and 30, 10 parts by mass, 13.3 parts by mass and 40 parts by mass, respectively, of a polyamide resin (TORESIN EF30T, available from Nagase ChemteX Corporation) was further added when the electron transport layer coating fluids were prepared. Evaluation was made in the same way. The results are shown in Table 17.

Examples 31 to 37

Electrophotographic photosensitive members were produced in the same way as in Example 1 except that the copolymer used in the electron transport layer was changed for the copolymers shown respectively in Table 17. Evaluation was made in the same way. The results are shown in Table 17.

Example 38

An electrophotographic photosensitive member was produced in the same way as in Example 1 except that the copolymer used in the electron transport layer was changed for the copolymer shown in Table 17 and that 10 parts by mass of a phenol resin (PLYOPHEN J-325; available from Dainippon Ink & Chemicals, Incorporated) was further added when the electron transport layer coating fluid was prepared. Evaluation was made in the same way. The results are shown in Table 17.

Examples 39 to 51

Electrophotographic photosensitive members were produced in the same way as in Example 1 except that the copolymer used in the electron transport layer was changed for the copolymers shown respectively in Table 17. Evaluation was made in the same way. The results are shown in Table 17.

Examples 52 to 54

Electrophotographic photosensitive members were produced in the same way as in Example 1 except that the copolymer used in the electron transport layer was changed for the copolymers shown respectively in Table 17 and that, in Examples 52, 53 and 54, 10 parts by mass, 13.3 parts by mass and 40 parts by mass, respectively, of a polyamide resin (TORESIN EF30T, available from Nagase ChemteX Corporation) was further added when the electron transport layer coating fluids were prepared. Evaluation was made in the same way. The results are shown in Table 17.

Examples 55 to 229

Electrophotographic photosensitive members were produced in the same way as in Example 1 except that the copolymer used in the electron transport layer was changed for the copolymers shown respectively in Table 17. Evaluation was made in the same way. The results are shown in Table 17.

Comparative Example 1

An electrophotographic photosensitive member was produced in the same way as in Example 1 except that, in place of the electron transport layer, a coating fluid composed of 40 parts by mass of a polyamide resin (TORESIN EF30T, available from Nagase ChemteX Corporation), 300 parts by mass of n-butanol and 500 parts by mass of methanol was prepared and this was coated, followed by drying at 120° C. for 10 minutes to form an intermediate layer of 0.8 μm in layer thickness. Evaluation was made in the same way. The results are shown in Table 18.

Comparative Example 2

An electrophotographic photosensitive member was produced in the same way as in Example 1 except that the electron transport layer was formed using, in place of the copolymer used in the present invention, a block copolymer represented by the following structural formula (I-1) (Japanese Patent Application Laid-open No. 2001-83726). Evaluation was made in the same way. The results are shown in Table 18.

Structural Formula (I-1)

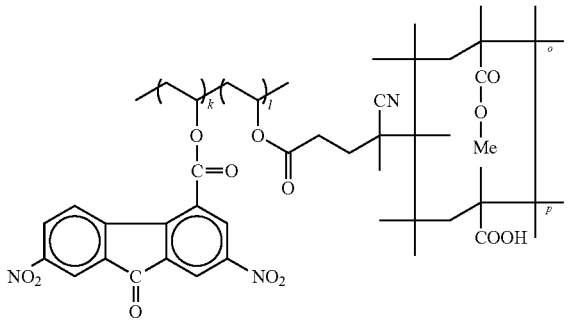

Comparative Example 3

An electrophotographic photosensitive member was produced in the same way as in Example 1 except that the electron transport layer was formed using, in place of the copolymer used in the present invention, a compound represented by the following structural formula (Japanese Patent Application Laid-open No. 2003-345044). Evaluation was made in the same way. The results are shown in Table 18.

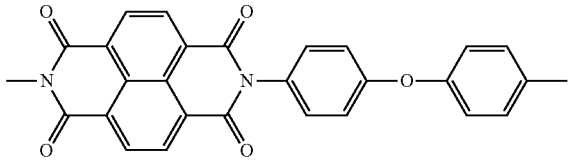

TABLE 17

| | Copolymer | | | | | | |
|---|---|---|---|---|---|---|---|
| | | Proportion of carboxyl | | Particle diameter | | | |
| Example | Exemplary Compound | group = containing moiety ($B_2$ or $B_3$) (mol %) | Molecular weight (Mw) | Before preparation of coating fluid (μm) | After preparation of coating fluid (μm) | Macbeth density difference | Vl (−V) |
| 1 | 101 | 5 | 10,000 | 3.5 | 0.3 | 0.021 | 100 |
| 2 | 102 | 5 | 8,000 | 4.0 | 0.3 | 0.022 | 105 |
| 3 | 105 | 5 | 5,000 | 4.1 | 0.3 | 0.023 | 100 |
| 4 | 123 | 5 | 12,000 | 5.2 | 0.4 | 0.024 | 120 |
| 5 | 128 | 5 | 15,000 | 3.8 | 0.3 | 0.024 | 130 |
| 6 | 125 | 5 | 11,000 | 4.5 | 0.3 | 0.025 | 140 |
| 7 | 101 | 0.4 | 10,000 | 2.9 | 1.2 | 0.036 | 100 |
| 8 | 101 | 1 | 9,000 | 2.9 | 0.8 | 0.025 | 100 |
| 9 | 101 | 30 | 10,000 | 3.0 | 0.4 | 0.024 | 110 |
| 10 | 101 | 35 | 12,000 | 3.2 | 0.4 | 0.024 | 135 |
| 11 | 101 | 50 | 15,000 | 2.0 | 0.3 | 0.025 | 140 |
| 12 | 101 | 80 | 13,000 | 2.0 | 0.3 | 0.022 | 110 |
| 13 | 101 | 5 | 10,000 | 3.5 | 0.3 | 0.024 | 135 |
| 14 | 101 | 5 | 10,000 | 3.5 | 0.3 | 0.025 | 145 |
| 15 | 202 | 5 | 13,000 | 8.6 | 0.3 | 0.026 | 100 |
| 16 | 207 | 5 | 12,000 | 7.2 | 0.3 | 0.027 | 120 |
| 17 | 208 | 5 | 8,000 | 5.9 | 0.3 | 0.028 | 130 |
| 18 | 209 | 5 | 7,000 | 7.2 | 0.3 | 0.029 | 140 |
| 19 | 202 | 5 | 12,000 | 6.8 | 0.3 | 0.026 | 110 |
| 20 | 307 | 5 | 6,000 | 4.9 | 0.3 | 0.021 | 100 |
| 21 | 307 | 5 | 14,000 | 8.2 | 0.4 | 0.022 | 100 |
| 22 | 307 | 5 | 13,000 | 6.9 | 0.5 | 0.022 | 105 |
| 23 | 304 | 5 | 8,000 | 4.1 | 0.3 | 0.023 | 125 |
| 24 | 311 | 5 | 6,000 | 5.4 | 0.3 | 0.024 | 130 |
| 25 | 310 | 5 | 10,000 | 3.9 | 0.4 | 0.025 | 140 |
| 26 | 307 | 1 | 11,000 | 5.6 | 0.8 | 0.025 | 100 |
| 27 | 307 | 30 | 6,000 | 2.8 | 0.3 | 0.025 | 110 |
| 28 | 307 | 5 | 12,000 | 3.8 | 0.5 | 0.024 | 110 |
| 29 | 307 | 5 | 12,000 | 3.8 | 0.3 | 0.024 | 135 |
| 30 | 307 | 5 | 14,000 | 8.4 | 0.3 | 0.025 | 140 |
| 31 | 304 | 30 | 9,000 | 7.5 | 0.3 | 0.024 | 125 |
| 32 | 311 | 30 | 10,000 | 5.6 | 0.3 | 0.025 | 135 |
| 33 | 310 | 30 | 12,000 | 8.2 | 0.4 | 0.025 | 145 |
| 34 | 406 | 5 | 12,000 | 8.2 | 0.3 | 0.026 | 100 |
| 35 | 405 | 5 | 8,000 | 5.4 | 0.4 | 0.027 | 120 |
| 36 | 410 | 5 | 7,000 | 7.1 | 0.4 | 0.028 | 135 |
| 37 | 407 | 5 | 12,000 | 9.0 | 0.3 | 0.029 | 140 |
| 38 | 406 | 5 | 6,000 | 8.5 | 0.3 | 0.026 | 110 |
| 39 | 508 | 5 | 6,000 | 4.6 | 0.3 | 0.031 | 105 |
| 40 | 506 | 5 | 13,000 | 7.2 | 0.7 | 0.032 | 120 |
| 41 | 512 | 5 | 8,000 | 8.2 | 0.3 | 0.033 | 130 |
| 42 | 510 | 5 | 6,000 | 8.1 | 0.4 | 0.034 | 140 |
| 43 | 508 | 1 | 10,000 | 6.9 | 0.3 | 0.032 | 100 |
| 44 | 508 | 30 | 11,000 | 6.2 | 0.3 | 0.033 | 110 |
| 45 | 506 | 30 | 6,000 | 8.1 | 0.3 | 0.033 | 125 |
| 46 | 512 | 30 | 10,000 | 5.5 | 0.3 | 0.033 | 135 |
| 47 | 510 | 30 | 12,000 | 4.9 | 0.4 | 0.035 | 145 |
| 48 | 607 | 5 | 11,000 | 7.1 | 0.5 | 0.040 | 105 |
| 49 | 605 | 5 | 9,000 | 7.9 | 0.3 | 0.041 | 120 |
| 50 | 611 | 5 | 5,000 | 4.2 | 0.3 | 0.042 | 130 |
| 51 | 609 | 5 | 12,000 | 7.1 | 0.3 | 0.043 | 140 |
| 52 | 605 | 5 | 12,000 | 5.0 | 0.3 | 0.041 | 125 |
| 53 | 605 | 5 | 8,000 | 6.5 | 0.4 | 0.041 | 140 |
| 54 | 605 | 5 | 7,000 | 3.9 | 0.3 | 0.042 | 145 |
| 55 | 702 | 5 | 12,000 | 4.7 | 0.5 | 0.040 | 100 |
| 56 | 705 | 5 | 6,000 | 6.8 | 0.3 | 0.041 | 125 |
| 57 | 711 | 5 | 14,000 | 7.1 | 0.3 | 0.042 | 135 |
| 58 | 708 | 5 | 10,000 | 4.9 | 0.3 | 0.043 | 140 |

TABLE 17-continued

| | Copolymer | | | | | | |
|---|---|---|---|---|---|---|---|
| | | | | Particle diameter | | | |
| Example | Exemplary Compound | Proportion of carboxyl group = containing moiety ($B_2$ or $B_3$) (mol %) | Molecular weight (Mw) | Before preparation of coating fluid (μm) | After preparation of coating fluid (μm) | Macbeth density difference | Vl (−V) |
| 59 | 708 | 1 | 8,000 | 4.2 | 0.3 | 0.043 | 140 |
| 60 | 708 | 30 | 6,000 | 8.4 | 0.3 | 0.045 | 145 |
| 61 | 807 | 5 | 10,000 | 7.6 | 0.3 | 0.036 | 100 |
| 62 | 805 | 5 | 11,000 | 8.8 | 0.4 | 0.037 | 125 |
| 63 | 810 | 5 | 8,000 | 6.4 | 0.4 | 0.038 | 130 |
| 64 | 808 | 5 | 13,000 | 7.7 | 0.3 | 0.039 | 140 |
| 65 | 808 | 1 | 11,000 | 5.6 | 0.3 | 0.039 | 140 |
| 66 | 808 | 30 | 6,000 | 9.9 | 0.3 | 0.039 | 145 |
| 67 | 120 | 5 | 8,000 | 6.5 | 0.4 | 0.022 | 100 |
| 68 | 131 | 5 | 8,000 | 8.1 | 0.3 | 0.024 | 110 |
| 69 | 132 | 5 | 7,000 | 6.2 | 0.4 | 0.025 | 105 |
| 70 | 133 | 5 | 6,000 | 4.9 | 0.3 | 0.022 | 105 |
| 71 | 139 | 5 | 8,000 | 7.1 | 0.3 | 0.022 | 100 |
| 72 | 140 | 5 | 14,000 | 7.9 | 0.5 | 0.024 | 105 |
| 73 | 141 | 5 | 13,000 | 4.2 | 0.3 | 0.023 | 110 |
| 74 | 144 | 5 | 8,000 | 7.2 | 0.6 | 0.022 | 100 |
| 75 | 145 | 5 | 6,000 | 8.0 | 0.3 | 0.025 | 100 |
| 76 | 146 | 5 | 6,000 | 6.5 | 0.3 | 0.021 | 105 |
| 77 | 148 | 5 | 10,000 | 3.5 | 0.7 | 0.022 | 100 |
| 78 | 150 | 5 | 6,000 | 4.7 | 0.3 | 0.025 | 105 |
| 79 | 151 | 5 | 11,000 | 6.2 | 0.3 | 0.021 | 105 |
| 80 | 153 | 5 | 12,000 | 7.1 | 0.3 | 0.022 | 110 |
| 81 | 154 | 5 | 5,000 | 4.9 | 0.4 | 0.023 | 110 |
| 82 | 155 | 5 | 6,000 | 8.2 | 0.3 | 0.023 | 105 |
| 83 | 156 | 5 | 8,000 | 6.3 | 0.3 | 0.023 | 105 |
| 84 | 157 | 5 | 5,000 | 7.5 | 0.3 | 0.025 | 100 |
| 85 | 158 | 5 | 6,000 | 7.9 | 0.5 | 0.025 | 110 |
| 86 | 159 | 5 | 8,000 | 5.9 | 0.4 | 0.022 | 110 |
| 87 | 160 | 5 | 7,000 | 8.2 | 0.5 | 0.024 | 110 |
| 88 | 162 | 5 | 5,000 | 4.9 | 0.4 | 0.025 | 105 |
| 89 | 164 | 5 | 8,000 | 5.5 | 0.5 | 0.025 | 105 |
| 90 | 210 | 5 | 6,000 | 8.2 | 0.3 | 0.026 | 100 |
| 91 | 212 | 5 | 10,000 | 8.2 | 0.4 | 0.027 | 110 |
| 92 | 213 | 5 | 11,000 | 7.6 | 0.3 | 0.030 | 105 |
| 93 | 214 | 5 | 12,000 | 8.8 | 0.3 | 0.026 | 110 |
| 94 | 215 | 5 | 8,000 | 8.2 | 0.3 | 0.028 | 110 |
| 95 | 216 | 5 | 7,000 | 6.2 | 0.3 | 0.028 | 100 |
| 96 | 217 | 5 | 5,000 | 8.1 | 0.5 | 0.029 | 100 |
| 97 | 219 | 5 | 8,000 | 5.5 | 0.3 | 0.026 | 100 |
| 98 | 220 | 5 | 14,000 | 6.9 | 0.3 | 0.027 | 100 |
| 99 | 228 | 5 | 10,000 | 7.1 | 0.3 | 0.026 | 105 |
| 100 | 229 | 5 | 8,000 | 8.9 | 0.3 | 0.029 | 110 |
| 101 | 230 | 5 | 6,000 | 4.2 | 0.3 | 0.030 | 110 |
| 102 | 233 | 5 | 10,000 | 8.5 | 0.3 | 0.026 | 105 |
| 103 | 234 | 5 | 11,000 | 5.0 | 0.3 | 0.026 | 100 |
| 104 | 238 | 5 | 6,000 | 6.0 | 0.3 | 0.027 | 100 |
| 105 | 239 | 5 | 11,000 | 3.9 | 0.3 | 0.028 | 105 |
| 106 | 240 | 5 | 8,000 | 5.5 | 0.4 | 0.027 | 105 |
| 107 | 242 | 5 | 10,000 | 9.6 | 0.4 | 0.027 | 105 |
| 108 | 243 | 5 | 6,000 | 8.2 | 0.3 | 0.026 | 110 |
| 109 | 244 | 5 | 5,000 | 6.8 | 0.3 | 0.028 | 105 |
| 110 | 245 | 5 | 5,000 | 7.7 | 0.3 | 0.028 | 110 |
| 111 | 314 | 5 | 9,000 | 8.7 | 0.4 | 0.021 | 120 |
| 112 | 315 | 5 | 9,000 | 6.8 | 0.3 | 0.022 | 120 |
| 113 | 322 | 5 | 9,000 | 7.2 | 0.3 | 0.024 | 140 |
| 114 | 327 | 5 | 10,000 | 8.2 | 0.3 | 0.021 | 145 |
| 115 | 328 | 5 | 12,000 | 4.5 | 0.3 | 0.024 | 140 |
| 116 | 339 | 5 | 12,000 | 8.0 | 0.5 | 0.023 | 140 |
| 117 | 342 | 5 | 8,000 | 7.6 | 0.3 | 0.023 | 140 |
| 118 | 343 | 5 | 7,000 | 8.8 | 0.3 | 0.022 | 145 |
| 119 | 344 | 5 | 12,000 | 6.2 | 0.3 | 0.022 | 145 |
| 120 | 349 | 5 | 6,000 | 8.2 | 0.3 | 0.025 | 145 |
| 121 | 350 | 5 | 14,000 | 8.1 | 0.3 | 0.022 | 140 |
| 122 | 352 | 5 | 13,000 | 5.5 | 0.4 | 0.021 | 150 |
| 123 | 354 | 5 | 10,000 | 6.0 | 0.3 | 0.023 | 145 |
| 124 | 355 | 5 | 10,000 | 8.0 | 0.3 | 0.022 | 145 |
| 125 | 356 | 5 | 8,000 | 7.6 | 0.4 | 0.023 | 140 |
| 126 | 357 | 5 | 7,000 | 6.7 | 0.4 | 0.022 | 145 |
| 127 | 411 | 5 | 6,000 | 7.1 | 0.3 | 0.026 | 120 |
| 128 | 421 | 5 | 10,000 | 7.9 | 0.3 | 0.027 | 145 |

TABLE 17-continued

| | Copolymer | | | | | | |
|---|---|---|---|---|---|---|---|
| | | | | Particle diameter | | | |
| Example | Exemplary Compound | Proportion of carboxyl group = containing moiety ($B_2$ or $B_3$) (mol %) | Molecular weight (Mw) | Before preparation of coating fluid (μm) | After preparation of coating fluid (μm) | Macbeth density difference | Vl (−V) |
| 129 | 422 | 5 | 11,000 | 7.2 | 0.3 | 0.027 | 140 |
| 130 | 425 | 5 | 6,000 | 7.2 | 0.3 | 0.029 | 140 |
| 131 | 426 | 5 | 12,000 | 5.5 | 0.3 | 0.026 | 145 |
| 132 | 427 | 5 | 12,000 | 8.5 | 0.3 | 0.029 | 145 |
| 133 | 431 | 5 | 14,000 | 3.9 | 0.3 | 0.030 | 150 |
| 134 | 432 | 5 | 9,000 | 4.7 | 0.4 | 0.027 | 140 |
| 135 | 437 | 5 | 10,000 | 6.0 | 0.3 | 0.027 | 145 |
| 136 | 438 | 5 | 12,000 | 7.1 | 0.3 | 0.028 | 145 |
| 137 | 440 | 5 | 12,000 | 4.2 | 0.3 | 0.030 | 140 |
| 138 | 441 | 5 | 10,000 | 7.8 | 0.3 | 0.030 | 145 |
| 139 | 442 | 5 | 9,000 | 8.0 | 0.3 | 0.029 | 145 |
| 140 | 443 | 5 | 8,000 | 8.2 | 0.3 | 0.029 | 140 |
| 141 | 513 | 5 | 9,000 | 8.4 | 0.3 | 0.031 | 135 |
| 142 | 514 | 5 | 12,000 | 7.6 | 0.3 | 0.035 | 140 |
| 143 | 515 | 5 | 6,000 | 6.8 | 0.3 | 0.032 | 145 |
| 144 | 516 | 5 | 14,000 | 7.4 | 0.3 | 0.032 | 145 |
| 145 | 517 | 5 | 13,000 | 6.2 | 0.3 | 0.033 | 135 |
| 146 | 518 | 5 | 8,000 | 8.1 | 0.3 | 0.034 | 135 |
| 147 | 519 | 5 | 6,000 | 5.5 | 0.3 | 0.035 | 135 |
| 148 | 521 | 5 | 10,000 | 8.5 | 0.3 | 0.031 | 140 |
| 149 | 522 | 5 | 9,000 | 7.1 | 0.3 | 0.033 | 140 |
| 150 | 524 | 5 | 6,000 | 7.9 | 0.5 | 0.032 | 140 |
| 151 | 525 | 5 | 15,000 | 8.2 | 0.3 | 0.033 | 135 |
| 152 | 531 | 5 | 10,000 | 7.1 | 0.3 | 0.033 | 145 |
| 153 | 532 | 5 | 14,000 | 6.0 | 0.4 | 0.035 | 140 |
| 154 | 533 | 5 | 9,000 | 6.2 | 0.3 | 0.030 | 140 |
| 155 | 534 | 5 | 8,000 | 8.5 | 0.3 | 0.032 | 140 |
| 156 | 536 | 5 | 9,000 | 4.7 | 0.3 | 0.031 | 145 |
| 157 | 537 | 5 | 12,000 | 6.2 | 0.3 | 0.032 | 145 |
| 158 | 538 | 5 | 8,000 | 6.1 | 0.3 | 0.032 | 140 |
| 159 | 542 | 5 | 7,000 | 4.9 | 0.2 | 0.035 | 135 |
| 160 | 543 | 5 | 10,000 | 4.2 | 0.3 | 0.034 | 135 |
| 161 | 544 | 5 | 6,000 | 8.4 | 0.3 | 0.034 | 140 |
| 162 | 545 | 5 | 14,000 | 7.5 | 0.3 | 0.030 | 145 |
| 163 | 546 | 5 | 10,000 | 6.8 | 0.5 | 0.032 | 145 |
| 164 | 547 | 5 | 8,000 | 6.2 | 0.3 | 0.033 | 145 |
| 165 | 548 | 5 | 11,000 | 5.9 | 0.3 | 0.034 | 140 |
| 166 | 549 | 5 | 7,000 | 8.2 | 0.3 | 0.033 | 135 |
| 167 | 613 | 5 | 7,000 | 8.2 | 0.3 | 0.040 | 145 |
| 168 | 614 | 5 | 10,000 | 8.1 | 0.3 | 0.042 | 140 |
| 169 | 615 | 5 | 5,000 | 5.5 | 0.3 | 0.041 | 140 |
| 170 | 616 | 5 | 15,000 | 5.9 | 0.3 | 0.043 | 145 |
| 171 | 617 | 5 | 12,000 | 7.1 | 0.3 | 0.040 | 145 |
| 172 | 620 | 5 | 11,000 | 5.5 | 0.3 | 0.041 | 145 |
| 173 | 621 | 5 | 11,000 | 7.9 | 0.3 | 0.045 | 135 |
| 174 | 622 | 5 | 14,000 | 4.2 | 0.3 | 0.043 | 140 |
| 175 | 628 | 5 | 8,000 | 7.0 | 0.3 | 0.043 | 140 |
| 176 | 629 | 5 | 7,000 | 5.0 | 0.3 | 0.042 | 145 |
| 177 | 630 | 5 | 11,000 | 8.5 | 0.3 | 0.044 | 135 |
| 178 | 633 | 5 | 12,000 | 3.9 | 0.3 | 0.044 | 145 |
| 179 | 634 | 5 | 9,000 | 4.0 | 0.3 | 0.041 | 135 |
| 180 | 640 | 5 | 7,000 | 6.8 | 0.3 | 0.045 | 140 |
| 181 | 641 | 5 | 10,000 | 6.2 | 0.3 | 0.042 | 140 |
| 182 | 643 | 5 | 6,000 | 4.9 | 0.3 | 0.043 | 140 |
| 183 | 644 | 5 | 10,000 | 5.3 | 0.4 | 0.042 | 135 |
| 184 | 645 | 5 | 9,000 | 5.4 | 0.3 | 0.043 | 140 |
| 185 | 646 | 5 | 8,000 | 5.9 | 0.3 | 0.042 | 140 |
| 186 | 713 | 5 | 11,000 | 8.4 | 0.3 | 0.040 | 140 |
| 187 | 714 | 5 | 8,000 | 6.6 | 0.3 | 0.045 | 145 |
| 188 | 715 | 5 | 6,000 | 8.8 | 0.3 | 0.045 | 145 |
| 189 | 716 | 5 | 10,000 | 6.4 | 0.3 | 0.045 | 140 |
| 190 | 717 | 5 | 11,000 | 6.2 | 0.3 | 0.042 | 140 |
| 191 | 718 | 5 | 6,000 | 8.1 | 0.3 | 0.041 | 140 |
| 192 | 719 | 5 | 12,000 | 5.5 | 0.3 | 0.043 | 150 |
| 193 | 720 | 5 | 10,000 | 8.2 | 0.4 | 0.042 | 145 |
| 194 | 726 | 5 | 8,000 | 8.2 | 0.3 | 0.041 | 145 |
| 195 | 727 | 5 | 8,000 | 8.5 | 0.3 | 0.041 | 140 |
| 196 | 728 | 5 | 9,000 | 7.9 | 0.3 | 0.040 | 140 |
| 197 | 730 | 5 | 10,000 | 6.2 | 0.3 | 0.044 | 140 |
| 198 | 731 | 5 | 10,000 | 8.2 | 0.3 | 0.045 | 145 |

TABLE 17-continued

| Example | Exemplary Compound | Copolymer: Proportion of carboxyl group = containing moiety ($B_2$ or $B_3$) (mol %) | Copolymer: Molecular weight (Mw) | Particle diameter: Before preparation of coating fluid (μm) | Particle diameter: After preparation of coating fluid (μm) | Macbeth density difference | Vl (−V) |
|---|---|---|---|---|---|---|---|
| 199 | 732 | 5 | 8,000 | 5.0 | 0.3 | 0.042 | 145 |
| 200 | 733 | 5 | 8,000 | 6.5 | 0.3 | 0.043 | 140 |
| 201 | 738 | 5 | 7,000 | 3.0 | 0.3 | 0.041 | 140 |
| 202 | 739 | 5 | 10,000 | 4.7 | 0.3 | 0.040 | 145 |
| 203 | 740 | 5 | 6,000 | 8.8 | 0.3 | 0.045 | 145 |
| 204 | 741 | 5 | 14,000 | 7.1 | 0.3 | 0.044 | 140 |
| 205 | 742 | 5 | 10,000 | 7.2 | 0.3 | 0.044 | 140 |
| 206 | 743 | 5 | 10,000 | 5.5 | 0.3 | 0.045 | 140 |
| 207 | 744 | 5 | 9,000 | 6.4 | 0.3 | 0.043 | 145 |
| 208 | 812 | 5 | 8,000 | 4.2 | 0.3 | 0.039 | 140 |
| 209 | 813 | 5 | 7,000 | 8.4 | 0.3 | 0.037 | 150 |
| 210 | 814 | 5 | 13,000 | 8.0 | 0.3 | 0.039 | 140 |
| 211 | 815 | 5 | 11,000 | 6.8 | 0.3 | 0.036 | 140 |
| 212 | 816 | 5 | 8,000 | 6.4 | 0.3 | 0.036 | 150 |
| 213 | 817 | 5 | 8,000 | 6.2 | 0.3 | 0.036 | 145 |
| 214 | 818 | 5 | 12,000 | 8.1 | 0.3 | 0.039 | 145 |
| 215 | 819 | 5 | 12,000 | 8.5 | 0.3 | 0.038 | 150 |
| 216 | 820 | 5 | 9,000 | 4.7 | 0.3 | 0.037 | 150 |
| 217 | 825 | 5 | 10,000 | 6.1 | 0.3 | 0.037 | 140 |
| 218 | 826 | 5 | 10,000 | 7.9 | 0.3 | 0.038 | 150 |
| 219 | 827 | 5 | 12,000 | 4.2 | 0.3 | 0.039 | 140 |
| 220 | 830 | 5 | 6,000 | 7.2 | 0.3 | 0.037 | 140 |
| 221 | 831 | 5 | 7,000 | 8.5 | 0.3 | 0.039 | 150 |
| 222 | 832 | 5 | 12,000 | 6.5 | 0.3 | 0.036 | 145 |
| 223 | 837 | 5 | 6,000 | 3.7 | 0.3 | 0.039 | 140 |
| 224 | 838 | 5 | 12,000 | 6.7 | 0.3 | 0.037 | 145 |
| 225 | 840 | 5 | 12,000 | 6.8 | 0.3 | 0.037 | 140 |
| 226 | 841 | 5 | 10,000 | 7.2 | 0.4 | 0.038 | 140 |
| 227 | 842 | 5 | 8,000 | 5.2 | 0.4 | 0.038 | 140 |
| 228 | 843 | 5 | 7,000 | 8.4 | 0.3 | 0.037 | 145 |
| 229 | 844 | 5 | 9,000 | 6.4 | 0.3 | 0.037 | 145 |

TABLE 18

| Comparative Example | Macbeth density difference | Vl (−V) |
|---|---|---|
| 1 | 0.070 | 165 |
| 2 | 0.085 | 170 |
| 3 | 0.070 | 130 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-019744, filed Jan. 30, 2009, No. 2010-017706, filed Jan. 29, 2010, which are hereby incorporated by reference herein in their entirety.

The invention claimed is:

1. An electrophotographic photosensitive member comprising a support and a photosensitive layer formed on the support, wherein the photosensitive layer contains a copolymer having a repeating structural unit represented by the following formula (1) and a repeating structural unit represented by the following formula (2), or a copolymer having a repeating structural unit represented by the following formula (1) and a repeating structural unit represented by the following formula (3):

$$-(Z_1\text{-}A\text{-}Z_2\text{-}E_1)- \quad (1)$$

$$-(Z_3\text{-}A\text{-}Z_4—W_2—B_2—W_2)- \quad (2)$$

$$-(Z_5—B_3—Z_6\text{-}E_4)- \quad (3)$$

where, in the formulas (1), (2) and (3);

$Z_1$ to $Z_6$ each independently represent a single bond, an alkylene group, an arylene group, or an arylene group substituted with an alkyl group;

$E_1$ represents a divalent group represented by —$W_1$—$B_1$—$W_1$—, or a divalent group represented by the following formula (E11):

(E11)

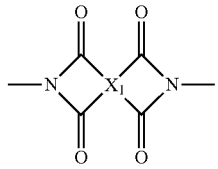

wherein $X_1$ represents a tetravalent group formed by removing four hydrogen atoms from a cyclic hydrocarbon;

$E_4$ represents a divalent group represented by —$W_3$—$B_4$—$W_3$—, or a divalent group represented by the following formula (E41):

(E41)

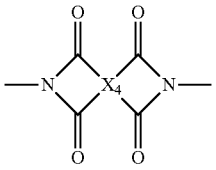

wherein $X_4$ represents a tetravalent group formed by removing four hydrogen atoms from a cyclic hydrocarbon;

$W_1$ to $W_3$ each independently represent a single bond, a urethane linkage, a urea linkage or an imide linkage;

A represents a divalent group represented by any of the following formulas (A-1) to (A-8):

A-1

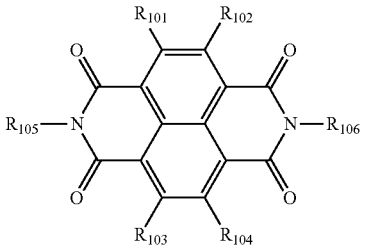

A-2

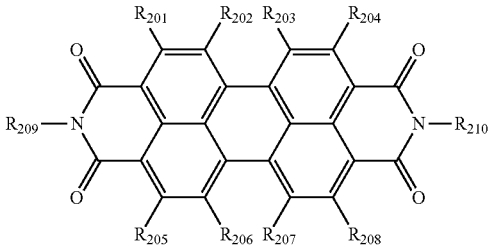

A-3

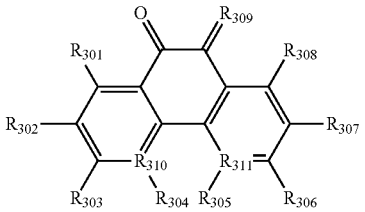

A-4

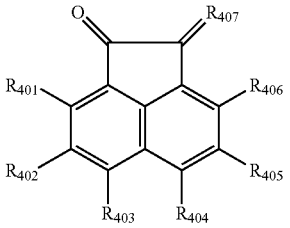

A-5

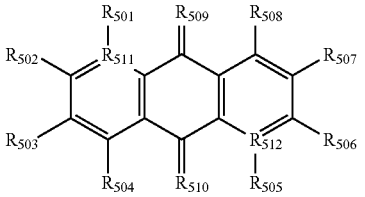

-continued

A-6

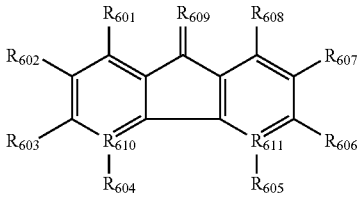

A-7

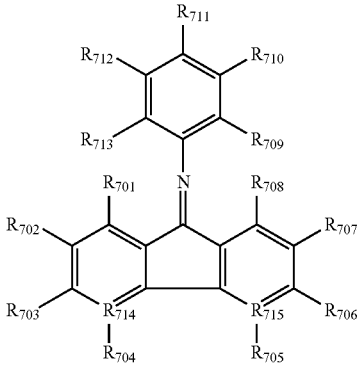

A-8

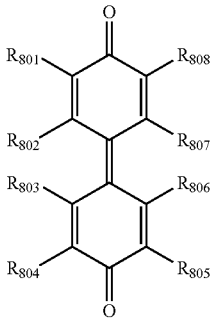

where, in the formulas (A-1) to (A-8);

$R_{101}$ to $R_{104}$ each independently represent a hydrogen atom, an aryl group, an aryl group substituted with a halogen atom, nitro group, cyano group, alkyl group or alkyl halide group, an alkyl group, or a cyano group, or represent a bonding site; and $R_{105}$ and $R_{106}$ each independently represent a hydrogen atom, an aryl group, an aryl group substituted with an alkyl group or halogen atom, or an alkyl group, or represent a bonding site; provided that any two of $R_{101}$ to $R_{106}$ are bonding sites;

$R_{201}$ to $R_{208}$ each independently represent a hydrogen atom, an aryl group, an aryl group substituted with a halogen atom, nitro group, cyano group, alkyl group or alkyl halide group, an alkyl group, or a cyano group, or represent a bonding site; and $R_{209}$ and $R_{210}$ each independently represent a hydrogen atom, an aryl group, an aryl group substituted with an alkyl group or halogen atom, or an alkyl group, or represent a bonding site; provided that any two of $R_{201}$ to $R_{210}$ are bonding sites;

$R_{301}$ to $R_{308}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{309}$ represents an oxygen atom or a dicyanomethylene group; and $R_{310}$ and $R_{311}$ each independently represent a carbon atom or a nitrogen atom, and, in the case of the nitrogen atom, $R_{304}$ and $R_{305}$ are not present; provided that any two of $R_{301}$ to $R_{308}$ are bonding sites;

$R_{401}$ to $R_{406}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; and $R_{407}$ represents an oxygen atom or a dicyanomethylene group; provided that any two of $R_{401}$ to $R_{406}$ are bonding sites;

$R_{501}$ to $R_{508}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; $R_{509}$ and $R_{510}$ each independently represent an oxygen atom or a dicyanomethylene group; and $R_{511}$ and $R_{512}$ each independently represent a carbon atom or a nitrogen atom, and, in the case of the nitrogen atom, $R_{501}$ and $R_{505}$ are not present; provided that any two of $R_{501}$ to $R_{508}$ are bonding sites;

$R_{601}$ to $R_{608}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{610}$ and $R_{611}$ each independently represent a carbon atom or a nitrogen atom, and, in the case of the nitrogen atom, $R_{604}$ and $R_{605}$ are not present; and $R_{609}$ represents a dicyanomethylene group; provided that any two of $R_{601}$ to $R_{608}$ are bonding sites;

$R_{701}$ to $R_{713}$ each independently represent a hydrogen atom, an aryl group, an aryl group substituted with a halogen atom, nitro group, cyano group, alkyl group or alkyl halide group, an alkyl group, a cyano group, a nitro group, or a carboxylate group, or represent a bonding site; $R_{714}$ and $R_{715}$ each independently represent a carbon atom or a nitrogen atom, and, in the case of the nitrogen atom, $R_{704}$ and $R_{705}$ are not present; provided that any two of $R_{701}$ to $R_{713}$ are bonding sites; and $R_{801}$ to $R_{808}$ each independently represent a hydrogen atom, an aryl group, an aryl group substituted with a halogen atom, nitro group, cyano group, alkyl group or alkyl halide group, an alkyl group, a cyano group, or a nitro group, or represent a bonding site; provided that any two of $R_{801}$ to $R_{808}$ are bonding sites;

$B_1$ and $B_4$ each independently represent an arylene group, an alkylene group, an alkarylene group, an arylene group substituted with an alkyl group, halogen atom, cyano group or nitro group, an alkylene group substituted with a halogen atom, cyano group or nitro group, an alkarylene group substituted with an alkyl group, halogen atom, cyano group or nitro group, an arylene group interrupted by an ether or sulfonyl, or an alkylene group interrupted by an ether; and $B_2$ and $B_3$ each independently represent an arylene group substituted with a carboxyl group only, an arylene group substituted with a carboxyl group and an alkyl group only, or an alkylene group substituted with a carboxyl group only.

2. The electrophotographic photosensitive member according to claim 1, wherein the photosensitive layer is a photosensitive layer having an electron transport layer, a charge generation layer and a hole transport layer which are layered in this order from the support side, and the electron transport layer contains the copolymer having a repeating structural unit represented by the formula (1) and a repeating structural unit represented by the formula (2) or the copolymer having a repeating structural unit represented by the formula (1) and a repeating structural unit represented by the formula (3).

3. The electrophotographic photosensitive member according to claim 1, wherein the photosensitive layer is a photosensitive layer having an electron transport layer, a charge generation layer and a hole transport layer which are layered in this order from the support side, and the electron transport layer contains the copolymer having a repeating structural unit represented by the formula (1) and a repeating structural unit represented by the formula (2) or the copolymer having a repeating structural unit represented by the formula (1) and a repeating structural unit represented by the formula (3), in an amount of from 80% by mass to 100% by mass based on the total mass of the electron transport layer.

4. The electrophotographic photosensitive member according to claim 1, wherein the photosensitive layer contains the copolymer having a repeating structural unit represented by the formula (1) and a repeating structural unit represented by the formula (2), and the repeating structural unit represented by the formula (1) is in a proportion of from 50 mol % to 99 mol % based on all the repeating structural units in the copolymer.

5. The electrophotographic photosensitive member according to claim 1, wherein the photosensitive layer contains the copolymer having a repeating structural unit represented by the formula (1) and a repeating structural unit represented by the formula (2), and the repeating structural unit represented by the formula (1) is in a proportion of from 70 mol % to 99 mol % based on all the repeating structural units in the copolymer.

6. The electrophotographic photosensitive member according to claim 1, wherein the photosensitive layer contains the copolymer having a repeating structural unit represented by the formula (1) and a repeating structural unit represented by the formula (2), and the repeating structural unit represented by the formula (2) is in a proportion of from 1 mol % to 30 mol % based on all the repeating structural units in the copolymer.

7. The electrophotographic photosensitive member according to claim 1, wherein the photosensitive layer contains the copolymer having a repeating structural unit represented by the formula (1) and a repeating structural unit represented by the formula (3), and the repeating structural unit represented by the formula (1) is in a proportion of from 50 mol % to 99 mol % based on all the repeating structural units in the copolymer.

8. The electrophotographic photosensitive member according to claim 1, wherein the photosensitive layer contains the copolymer having a repeating structural unit represented by the formula (1) and a repeating structural unit represented by the formula (3), and the repeating structural unit represented by the formula (1) is in a proportion of from 70 mol % to 99 mol % based on all the repeating structural units in the copolymer.

9. The electrophotographic photosensitive member according to claim 1, wherein the photosensitive layer contains the copolymer having a repeating structural unit represented by the formula (1) and a repeating structural unit represented by the formula (3), and the repeating structural unit represented by the formula (3) is in a proportion of from 1 mol % to 30 mol % based on all the repeating structural units in the copolymer.

10. A process cartridge which integrally supports the electrophotographic photosensitive member according to claim 1 and at least one device selected from the group consisting of a charging device, a developing device, a transfer device and a cleaning device, and is detachably mountable to the main body of an electrophotographic apparatus.

11. An electrophotographic apparatus comprising the electrophotographic photosensitive member according to claim 1, a charging device, an exposure device, a developing device and a transfer device.

* * * * *